US007314321B2

(12) United States Patent
Kurashina

(10) Patent No.: US 7,314,321 B2
(45) Date of Patent: Jan. 1, 2008

(54) TAPE PRINTING APPARATUS, LABEL PRODUCING METHOD, DATA PROCESSING METHOD FOR TAPE PRINTING APPARATUS, PRINTING SYSTEM, LABEL PRODUCING METHOD FOR PRINTING SYSTEM, PROGRAM, AND STORAGE MEDIUM

(75) Inventor: Hiroyasu Kurashina, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 531 days.

(21) Appl. No.: 10/839,794

(22) Filed: May 5, 2004

(65) Prior Publication Data

US 2005/0012950 A1 Jan. 20, 2005

(30) Foreign Application Priority Data

Jul. 16, 2003 (JP) ..... 2003-198024
Jul. 16, 2003 (JP) ..... 2003-198025
Jul. 16, 2003 (JP) ..... 2003-198026
Jul. 16, 2003 (JP) ..... 2003-198027
Jul. 16, 2003 (JP) ..... 2003-198028

(51) Int. Cl.
*B41J 11/44* (2006.01)

(52) U.S. Cl. ..... 400/76; 400/62; 400/615.2

(58) Field of Classification Search ..... 400/62, 400/76, 615.2
See application file for complete search history.

(56) References Cited

U.S. PATENT DOCUMENTS 5,462,372 A * 10/1995 Hirono ..... 400/615.2
5,549,399 A * 8/1996 Sakuragi et al. ..... 400/63
6,644,873 B2 11/2003 Kurashina
7,052,196 B2 * 5/2006 Ueno et al. ..... 400/615.2
2004/0021774 A1 * 2/2004 Ito ..... 348/207.1

FOREIGN PATENT DOCUMENTS

EP 1317132 6/2003
JP 2002-137483 5/2002
JP 2002-178589 6/2002
KR 2002-46993 A 6/2002

* cited by examiner

*Primary Examiner*—Minh Chau
(74) *Attorney, Agent, or Firm*—Hogan & Hartson LLP

(57) ABSTRACT

In case where any one of longitudinal direction printing in which an arranging direction of character strings coincides with a longitudinal direction of a tape, and width direction printing in which the arranging direction coincides with a width direction, is selected and a print image having the character strings arranged therein is printed on the tape to produce a label, a size in the longitudinal direction of the tape which is made into a label is set as a label width in the width direction printing. Character strings for the width direction printing are inputted and arrangement widths of respective lines of the character strings are set. A print image is created and printed according to the arrangement widths and the tape is cut in accordance with the set label width, whereby a label is produced.

32 Claims, 49 Drawing Sheets

TAPE PRINTING APPARATUS, LABEL PRODUCING METHOD, DATA PROCESSING METHOD FOR TAPE PRINTING APPARATUS, PRINTING SYSTEM, LABEL PRODUCING METHOD FOR PRINTING SYSTEM, PROGRAM, AND STORAGE MEDIUM

BACKGROUND OF THE INVENTION

1. Field of the Invention

This invention relates to: a tape printing apparatus capable of width direction printing in which an arranging direction of character strings coincides with a tape width direction; a label producing method capable of producing a label by using the width direction printing; a data processing method for the tape printing apparatus suitable for the width direction printing; a printing system that is a tape printing apparatus of a separate type, which includes a supply unit for supplying print image data and a tape printing apparatus for receiving the print image data to be printed on a tape; a label producing method for the printing system; a program; and a storage medium.

2. Description of the Related Art

Regarding stand-alone tape printing apparatuses, there has been conventionally known a tape printing apparatus capable of width direction printing in which an arranging direction of character strings coincides with a tape width direction, as well as longitudinal direction printing in which an arranging direction of character strings coincides with a tape longitudinal direction. In this type of tape printing apparatus, character strings are created and edited in accordance with the longitudinal direction printing and images of the character strings are rotated by 90 degrees to create a print image for the width direction printing. Thereafter, the print image is printed in the width direction by its character size or while being somewhat reduced in size.

However, generally, the tape printing apparatus of the above-described type is based on the longitudinal direction printing. Thus, various fine settings which are effective only in the width direction printing (specific to the width direction printing) regarding printing and label production cannot be performed. Specifically, the various settings include: creating and editing character strings on the premise of the width direction printing; setting a label width corresponding to a tape longitudinal direction on the premise of the width direction printing; adjusting various print widths of a print image in which character string images are arranged in accordance with the label width; producing a variety of labels by printing the print image to run off the label width; and the like. Moreover, no tape printing apparatus of the separate type which is capable of the width direction printing has been known.

Generally, tape printing apparatuses are based on the longitudinal direction printing. Thus, data which are once edited and the like for creating a print image are basically subjected to file registration as files for the longitudinal direction printing. Consequently, in order to use the files for the width direction printing, it is required to perform anew various instructions and settings for the width direction printing after the files are read.

The tape longitudinal direction is a width direction of a label produced by the width direction printing (a label width direction). Thus, setting of a print length or a label length in the tape longitudinal direction in the longitudinal direction printing (setting of a length for so-called fixed length printing: fixed length setting) can be diverted to setting of a print width or a label width in the width direction printing. However, generally, the fixed length setting is applied to all printing after settings and is not an individual setting for each of the files. Thus, in order to perform the width direction printing of a desired file by a desired individual setting (a print width and a label width), it is required to perform resetting before each time of printing so as to have a desired individual setting.

However, in case where data which are edited and the like for the width direction printing are allowed to be registered as files for the width direction printing and a number of files of that type are prepared, it is inconvenient in that the data described above can be used only for the width direction printing. Moreover, as a whole, working efficiency is poor and operability is not good.

SUMMARY OF THE INVENTION

It is an advantage of this invention to provide a tape printing apparatus, a label producing method, a program and a storage medium, the tape printing apparatus being capable of easily and quickly creating, editing and printing a print image suitable for width direction printing as well as producing a label. It is another advantage of this invention to provide a tape printing apparatus, a label producing method, a program and a storage medium, the tape printing apparatus being capable of freely setting various combinations of a label width and a print width in performing label production by the width direction printing. It is still another advantage of this invention to provide a tape printing apparatus, a label producing method, a program and a storage medium, the tape printing apparatus being capable of easily and quickly performing label production based on a desired individual setting only by reading registered files without requiring resetting related to the width direction printing. It is yet another advantage of this invention to provide a tape printing apparatus, a data processing method for the tape printing apparatus, a program and a storage medium, the tape printing apparatus being capable of diverting data of files prepared and registered for the width direction printing to longitudinal direction printing as well as improving convenience and working efficiency. It is another advantage of this invention to provide a printing system, a label producing method for the printing system, a program and a storage medium, the printing system being capable of easily and quickly creating and printing a print image suitable for the width direction printing as well as producing a label.

A first tape printing apparatus according to this invention is capable of producing a label in such a manner that: any one of longitudinal direction printing in which an arranging direction of character strings coincides with a longitudinal direction of a tape and width direction printing in which the arranging direction coincides with a width direction of the tape, is selected; images of the character strings are arranged in an arrangement area of a print image and printed on the tape; and the tape is cut in the width direction. The apparatus comprises: label width setting means for setting a label width as a size of a label in the longitudinal direction when the width direction printing is selected; width direction character string input means capable of inputting character strings for the width direction printing when the width direction printing is selected; arrangement width setting means for setting a size in the longitudinal direction of the character string images in the arrangement area as an arrangement width when the width direction printing is selected; print image creation means for creating the print image by arranging the character string images in the arrangement area according to the arrangement width; print means for printing the created print image; and cut means for cutting the tape having the print image printed thereon in accordance with the label width.

A first label producing method according to this invention is for producing a label in such a manner that: any one of longitudinal direction printing in which an arranging direction of character strings coincides with a longitudinal direction of a tape, and width direction printing in which the arranging direction coincides with a width direction of the tape is selected; images of the character strings are arranged in an arrangement area of a print image and printed on the tape; and the tape is cut in the width direction. The method comprises: a label width setting step of setting a label width as a size of a label in the longitudinal direction when the width direction printing is selected; a width direction character string input step capable of inputting character strings for the width direction printing when the width direction printing is selected; an arrangement width setting step of setting a size in the longitudinal direction of the character string images in the arrangement area as an arrangement width when the width direction printing is selected; a print image creation step of creating the print image by arranging the character string images in the arrangement area according to the arrangement width; a print step of printing the created print image; and a cut step of cutting the tape having the print image printed thereon in accordance with the label width.

In the tape printing apparatus and the label producing method described above, the longitudinal direction printing and the width direction printing can be selectively performed. In the width direction printing, the size in the longitudinal direction of the tape in making a label is set as the label width, the character strings for the width direction printing are inputted, the size in the tape longitudinal direction of the character string images in the arrangement area of the print image is set as the arrangement width and the print image is created according to the arrangement width. Thus, the print image can be created more easily and quickly than a conventional case in which functions for the longitudinal direction printing are utilized and the print image is diverted (rotated by 90 degrees or the like) to create the print image. Moreover, the print image can be edited directly (without being returned once for the longitudinal direction printing) and can be printed while being edited. In addition, the label can be produced by cutting the tape in accordance with the set label width. Consequently, it is possible to easily and quickly perform creation, editing and printing of a print image, which is suitable for the width direction printing, as well as label production.

When there are multiple lines of the character string images in the arrangement area, the arrangement width setting means is preferably capable of setting the arrangement width for each of the lines of the character string images.

According to the configuration described above, when there are multiple lines of the character string images in the arrangement area of the print image, the arrangement width can be set for each line thereof. Thus, it is possible to easily and quickly perform creation, editing and printing of a print image, which is more suitable for the width direction printing, as well as label production.

Preferably, the arrangement width setting means comprises abstract size designation means capable of designating the arrangement width of each line of the character string images by using an abstract name indicating a size.

According to the configuration described above, the width of each line of the character string images can be designated or specified by using the abstract name indicating the size (an abstract size which is relatively and abstractly indicated). Thus, a user can easily designate the width according to an image and the like which he/she imagines without fine specifications such as the number of dots and an actual size.

Preferably, the arrangement width setting means comprises arrangement width menu selection means for selecting the arrangement width from a standard menu.

According to the configuration described above, the arrangement width can be set easily and quickly just by selecting the arrangement width from the menu.

Moreover, the first tape printing apparatus preferably further comprises file registration means for registering data for creating the print image as files. Preferably, the file registration means comprises accompanying information registration means for registering the set label width as accompanying information of the files.

According to the configuration described above, the data for creating the print image can be registered as the files and the set label width can be registered as the accompanying information of the files. Thus, for example, even immediately after other operations are performed such as creation of files having label widths which are designated differently, it is possible to easily and quickly create and print a desired print image and also produce a label having a desired label width just by reading the registered files without requiring resetting of the label width and the like.

Preferably, the first tape printing apparatus further comprises print width setting means for setting a size in the longitudinal direction of the arrangement area of the print image as a print width corresponding to the label width when the width direction printing is selected. The print means is capable of printing a single print image so as to exceed the label width, and the print width setting means is capable of setting a size above the label width as the print width.

According to the configuration described above, the size in the longitudinal direction of the arrangement area of the print image is set as the print width corresponding to the label width. Thus, if the print width can be arbitrarily set, it is possible to adjust and freely set various combinations of the label width and the print width in performing the label production by the width direction printing. Furthermore, in this case, the print image can be printed so as to exceed the label width and the size above the label width can be set as the print width. Thus, it is possible to produce various and diverse labels such as an irregular label, for example, which can be created by cutting the character string images in the print image in the middle thereof as the label width.

A second tape printing apparatus according to this invention is capable of producing a label in such a manner that: any one of longitudinal direction printing in which an arranging direction of character strings coincides with a longitudinal direction of a tape, and width direction printing, in which the arranging direction coincides with a width direction of the tape is selected; images of the character strings are arranged in an arrangement area of a print image and printed on the tape; and the tape is cut in the width direction. The apparatus comprises: label width setting means for setting a label width as a size of a label in the longitudinal direction when the width direction printing is selected; print width setting means for setting a size in the longitudinal direction of the arrangement area of the print image as a print width corresponding to the label width when the width direction printing is selected; arrangement width setting means for setting a size in the longitudinal direction of the character string images within the print width as an arrangement width corresponding to the print width; print image creation means for creating the print image by arranging the character string images in the arrangement area according to the arrangement width; print means for printing the print image in accordance with the print width; and cut means for cutting the tape having the print image printed thereon in accordance with the label width.

Moreover, a second label producing method according to this invention is for producing a label in such a manner that: any one of longitudinal direction printing in which an arranging direction of character strings coincides with a longitudinal direction of a tape, and width direction printing in which the arranging direction coincides with a width direction of the tape, is selected; images of the character strings are arranged in an arrangement area of a print image; and the print image is printed on the tape and the tape is cut in the width direction. The method comprises: a label width setting step of setting a label width as a size of a label in the longitudinal direction when the width direction printing is selected; a print width setting step of setting a size in the longitudinal direction of the arrangement area of the print image as a print width corresponding to the label width when the width direction printing is selected; an arrangement width setting step of setting a size in the longitudinal direction of the character string images within the print width as an arrangement width corresponding to the print width; a print image creation step of creating the print image by arranging the character string images in the arrangement area according to the arrangement width; a print step of printing the print image in accordance with the print width; and a cut step of cutting the tape having the print image printed thereon in accordance with the label width.

In the tape printing apparatus and the label producing method described above, the longitudinal direction printing and the width direction printing can be selectively performed. In the width direction printing, the label width is set as the size in the longitudinal direction of the tape to serve as a label and the size in the tape longitudinal direction of the arrangement area of the print image is set as the print width corresponding to the label width. Thus, if the print width can be arbitrarily set, it is possible to freely adjust and set various combinations of the label width and the print width in performing the label production by the width direction printing. Moreover, the width of the character string images within the print width (the size in the tape longitudinal direction) is set as the arrangement width and the print image is created by arranging the character string images according to the arrangement width. Thus, the creation of the print image and the label production can be performed more easily and quickly than a conventional case in which functions for the longitudinal direction printing are utilized and the print image is diverted (rotated by 90 degrees or the like) to create the print image.

Preferably, the print width setting means comprises automatic print width setting means for automatically setting a size, which is the same as the label width, as the print width.

According to the configuration described above, the size, which is the same as the label width, can be automatically set as the print width. Thus, it is possible to easily determine the print width by using the automatic setting and to easily and quickly perform the creation of the print image and the label production.

Preferably, the print means is capable of printing a single print image so as to exceed the label width and the print width setting means is capable of setting the size above the label width as the print width.

According to the configuration described above, the size above the label width can be set as the print width. Thus, the print width can be more freely set and more flexible combinations of the label width and the print width can be set.

Preferably, the second tape printing apparatus further comprises reference position setting means for determining, as reference positions in the longitudinal direction, a reference position within the print width and determining a reference position within the label width. The print means print the print image so as to allow the reference position of the print width and the reference position of the label width to coincide with each other.

According to the configuration described above, the print image is printed so as to allow the reference position of the print width and the reference position of the label width, which are determined as the reference positions in the tape longitudinal direction, to coincide with each other. Thus, by accurately providing the respective reference positions, printing with desired arrangement can be accurately performed. It is preferable that the reference position of the print width and the reference position of the label width be determined on the same basis (for example, the both have their reference positions at their front ends). However, the reference positions may be provided on another basis such as that, for example, one thereof has the reference position at its front end and the other thereof has the reference position at its rear end.

Preferably, the reference position setting means comprises reference position selection means for selecting one end of the print width and the label width or respective centers thereof as the reference positions.

According to the configuration described above, one end of the print width and the label width or the respective centers thereof can be selected as the reference positions. Thus, the reference positions can be easily and accurately set just by the selection. Consequently, the printing with the desired arrangement can be easily and accurately performed.

Moreover, in the second tape printing apparatus described above, preferably, a label corresponding to a single print image is realized as a series of multiple divided labels, the label width setting means includes divided label setting means for setting the number of divided labels in realizing the label as the divided labels, and each of divided label widths and the cut means cut the tape in accordance with each of the divided label widths.

According to the configuration described above, the label corresponding to the print image is realized as a series of multiple divided labels. In this case, a plurality of divided labels can be produced as a label in such a manner that the number of the divided labels is designated, each label width of each of the divided labels is set and the tape is cut in accordance with each label width. Thus, more flexible and various combinations of the label width and the print width can be set. Moreover, a variety of more diverse labels can be produced.

Preferably, the label width setting means includes label width numeric input means for numerically inputting the label width.

According to the configuration described above, a desired (arbitrary) label width can be accurately set by the numeric input and fine adjustment thereof can be performed. Especially, in the case of realizing the label as the divided labels described above and the like, a desired fine label width can be accurately set for each of the divided label widths. Accordingly, more advantages are offered.

A third tape printing apparatus according to this invention is capable of producing a label in such a manner that: any one of longitudinal direction printing in which an arranging direction of character strings coincides with a longitudinal direction of a tape, and width direction printing in which the arranging direction coincides with a width direction of the tape is selected; a print image having arranged images of the character strings is printed on the tape; and the tape is cut in the width direction. The tape printing apparatus comprises: label width setting means for setting a label width as a size of a label in the longitudinal direction when the width direction printing is selected; file registration means for allowing accompanying information of width direction printing data for creating a print image in the width direction printing to include information on the set label width as well as registering the width direction printing data and the accompanying information as files corresponding to the print image; file designation means for designating a file to be printed among the registered files; print means for creating and printing a corresponding print image based on the designated file to be printed; and cut means for subjecting the tape having the print image printed thereon to cut processing for producing the label based on the information on the label width in the file to be printed.

A third label producing method according to this invention is for producing a label in such a manner that: any one of longitudinal direction printing in which an arranging direction of character strings coincides with a longitudinal direction of a tape, and width direction printing in which the arranging direction coincides with a width direction of the tape is selected; a print image having arranged images of the character strings is printed on the tape; and the tape is cut in the width direction. The label producing method comprises: a label width setting step of setting a label width as a size of a label in the longitudinal direction when the width direction printing is selected; a file registration step of allowing accompanying information of width direction printing data for creating a print image in the width direction printing to include information on the set label width as well as registering the width direction printing data and the accompanying information as files corresponding to the print image; a file designation step of designating a file to be printed among the registered files; a print step of creating and printing a corresponding print image based on the designated file to be printed; and a cut step of subjecting the tape having the print image printed thereon to cut processing for producing the label based on the information on the label width in the file to be printed.

In the tape printing apparatus and the label producing method described above, the longitudinal direction printing and the width direction printing can be selectively performed. The width direction printing data for creating the print image in the width direction printing and the accompanying information are registered as the files corresponding to the print image. Thereafter, when the width direction printing is selected, the file to be printed is designated among the registered files. Accordingly, the corresponding print image is created and printed based on the designated file. Moreover, the size in the longitudinal direction of the tape to be the label is set as the label width corresponding to the print image and the tape having the print image printed thereon is cut by performing width direction cut of the tape in the width direction printing. In this case, first, files for the width direction printing are prepared without diverting files for the longitudinal direction printing. Thus, contents (information) suitable for the width direction printing can be registered. Moreover, in this case, the label width corresponding to the print image is set before registration of the file corresponding to the print image and is registered as the information on the label width included in the accompanying information. In addition, the cut processing in the width direction printing is performed based on the information on the label width in the file to be printed. Therefore, for example, even immediately after other operations are performed such as creation of files having label widths which are set differently, it is possible to easily and quickly perform label production based on a desired individual setting just by reading the registered files without requiring resetting related to the width direction printing (here, at least the label width).

Moreover, in the third tape printing apparatus described above, preferably, a label corresponding to a single print image is realized as a series of multiple divided labels. The label width setting means includes divided label setting means for setting the number of divided labels in realizing the label as the divided labels and each of divided label widths, and the accompanying information includes information on the number of divided labels and each divided label width as the information on the label width, and the cut means cuts the tape in accordance with each divided label width as the cut processing.

According to the configuration described above, the label corresponding to the print image can be realized as a series of multiple divided labels. In this case, if the number of the divided labels is designated and each label width of each divided label is set, these pieces of information are registered as the information on the label width in the accompanying information of the files. Thereafter, based on the information, the cut processing in the width direction printing is performed. Thus, once the number of the divided labels and each label width thereof are set and registered, more flexible and various labels can be easily and quickly produced by the width direction printing just by reading the registered files without requiring resetting.

The third tape printing apparatus preferably further comprises print width setting means for setting a size in the longitudinal direction for printing the print image as a print width corresponding to the label width. The accompanying information includes information on the set print width and the print means prints the print image based on the information on the print width included in the accompanying information of the file to be printed.

According to the configuration described above, the size in the longitudinal direction for printing the print image can be set as the print width corresponding to the label width. This print width is registered as the information on the print width included in the accompanying information of the file and the print image is printed based on the information. Thus, once the size in the longitudinal direction is set as the print width and the print width is registered, a print image with a desired print width can be printed by the width direction printing just by reading the registered files without requiring resetting. In addition, label production based on a desired individual setting can be easily and quickly performed.

When there are multiple lines of the character string images in the print image, preferably the print width setting means includes each line print width setting means for setting an each line print width, which is a print width of each line, for each of the lines. In addition, the accompanying information includes information on the each line print width for each line as the information on the print width and that the print means includes each line print means for printing the character string images of the print image for each line based on the information on the each line print width for each line.

According to the configuration described above, when there are multiple lines of the character string images in the print image, the each line print width that is the print width of each line can be set for each line and the each line print width for each line is registered as the information on the print width included in the accompanying information of the file. Thus, based on the information described above, in addition to the each line print width, a total print width, i.e., the print width corresponding to the label width can be obtained. As a matter of course, the total print width may also be registered while being added to a part of the same information on the print width. In these cases, based on the information on the each line print width for each line, the character string images of the print image are printed for each line. Thus, once the information on the each line print width is registered as the accompanying information, a desired print image, in which character string images are arranged with a desired each line print width, can be printed by the width direction printing just by reading the registered files without requiring resetting. In addition, desired label production can be easily and quickly performed.

The third tape printing apparatus according to this invention preferably further comprises reference position selection means for selecting one end of the print width and the label width or respective centers thereof as the reference positions. Preferably, the accompanying information includes information on the selected reference positions. When the print width and the label width have different sizes from each other, the print means performs printing so as to allow a reference position of the print width and a reference position of the label width to coincide with each other based on the accompanying information of the file to be printed.

According to the configuration described above, said one end of the print width and the label width or the respective centers thereof can be selected as the reference positions. Thus, the reference positions can be easily and accurately set by the selection alone. These reference positions are registered as the information on the reference positions included in the accompanying information of the file. When the print width and the label width have the different sizes from each other, printing is performed so as to allow the reference position of the print width and the reference position of the label width to coincide with each other based on the accompanying information. Accordingly, the respective reference positions are accurately provided and are subjected to selection and setting. Thus, once the reference positions are registered as the accompanying information, printing with desired arrangement can be accurately performed just by reading the registered files without requiring resetting. Preferably, the reference position of the print width and the reference position of the label width are provided on the same basis (for example, the both have their reference positions at their front ends). However, the reference positions may be provided on another basis such as that, for example, one thereof has the reference position at its front end and the other thereof has the reference position at its rear end.

Preferably, the third tape printing apparatus further comprises multiple printing setting means for setting the number of repetitions of printing of the print image corresponding to the file to be printed. The print means repeatedly executes printing of the print image for the set number of repetitions. In addition, the cut means performs the cut processing for separating respective labels from each other for each time of printing of the print image, the respective labels corresponding to respective print images which are printed.

According to the configuration described above, the number of repetitions of printing of the print image corresponding to the file to be printed (so-called the number of copies or the number of sets) can be set. The same print image is repeatedly printed for this number of repetitions. Thereafter, the cut processing for separating the respective labels corresponding to the respective printed print images from each other is performed for each time of printing of the print image. Thus, the same labels can be easily and quickly produced only for the necessary and desired number of copies (sets).

Preferably, when there exist multiple types of the registered files, the file designation means is capable of collectively designating a plurality of files thereamong as the files to be printed. In addition, when the plurality of files are collectively designated as the files to be printed, the print means continuously prints a plurality of print images corresponding to the plurality of designated files. The cut means performs the cut processing for separating respective labels from each other, the respective labels corresponding to the plurality of printed print images.

According to the configuration described above, when there exist the multiple types of the registered files, a plurality of files thereamong can be collectively designated as the files to be printed. In addition, when the plurality of files are collectively designated, a plurality of print images corresponding to the plurality of designated files are continuously printed. Moreover, the cut processing for separating the respective labels from each other is performed and the respective labels corresponding to the plurality of printed print images. Thus, only by collectively designating the corresponding files, continuous (collective) production of multiple types of desired labels can be easily and quickly performed.

Preferably, the tape includes a base material tape which has a printing face on its front face and an adhesive face on its rear face, and a release tape which covers the adhesive face. The cut means comprises: half-cutting means for half-cutting only the base material tape in the width direction; and full-cutting means for full-cutting both of the base material tape and the release tape in the width direction. In addition, when there are a plurality of labels to be continuously produced, the cut means performs, as the cut processing, the full-cutting only for a rear end of the last label and the half-cutting for other positions.

According to the configuration described above, it is possible to perform the half-cutting for cutting only the base material tape in the width direction and the full-cutting for cutting both of the base material tape and the release tape. When there are a plurality of labels to be continuously produced, as the cut processing, the full-cutting is performed only for the rear end of the last label and the half-cutting is performed for the other positions (between the respective labels and the like). Thus, in the case of collectively managing the produced labels after all the cutting is finished, the labels can be managed as one piece of tape up to the position in which the full-cutting is performed. Moreover, since the respective labels are half-cut from each other, the user can attach the label when he/she wishes to attach by peeling off only the label he/she wishes to attach. Accordingly, the labels become a label group which is easily managed.

Preferably, the third tape printing apparatus further comprises: longitudinal direction printing data editing means for editing longitudinal direction printing data in order to create a print image in the longitudinal direction printing; and data conversion means for designating any one of the registered files and converting the width direction printing data of the designated file into the longitudinal direction printing data.

According to the configuration described above, the longitudinal direction printing data can be edited in order to create the print image in the longitudinal direction printing. In addition, any one of the files which are registered (for the width direction printing) can be designated to convert the width direction printing data of the designated file into the longitudinal direction printing data. Thus, the data registered for the width direction printing can be diverted to the longitudinal direction printing. Consequently, high convenience is achieved and, as a whole, operability and working efficiency are improved.

A fourth tape printing apparatus according to this invention selects any one of longitudinal direction printing in which an arranging direction of character strings coincides with a longitudinal direction of a tape, and width direction printing in which the arranging direction coincides with a width direction of the tape; and prints a print image on the tape, the print image having arranged images of the character strings. The tape printing apparatus comprises: longitudinal direction printing data editing means for editing character strings as longitudinal direction printing data when the longitudinal direction printing is selected; width direction printing data editing means for editing character strings as width direction printing data when the width direction printing is selected; file registration means for registering the edited width direction printing data as files corresponding to the print image; data conversion instruction means for instructing data conversion in which the width direction printing data is converted into the longitudinal direction printing data; and data conversion means for designating any one of the registered files when the data conversion is instructed and performing the data conversion for the width direction printing data of the designated file to obtain longitudinal direction printing data for the editing.

A data processing method according to this invention is for a tape printing apparatus which selects any one of longitudinal direction printing, in which an arranging direction of character strings coincides with a longitudinal direction of a tape, and width direction printing in which the arranging direction coincides with a width direction of the tape, and prints a print image on the tape, the print image having arranged images of the character strings. The data processing method comprises: a file registration step of registering character strings after being edited as width direction printing data as files corresponding to the print image for the width direction printing; a data conversion instruction step of instructing data conversion for converting the width direction printing data into longitudinal direction printing data which can be edited for the longitudinal direction printing; and a data conversion step of designating any one of the registered files when the data conversion is instructed and performing the data conversion for the width direction printing data of the designated file to obtain longitudinal direction printing data for editing.

In the tape printing apparatus and the data processing method described above, the longitudinal direction printing and the width direction printing can be selectively performed. After data of character strings for the width direction printing is edited as the width direction printing data, the data is registered as the files corresponding to the print image for the width direction printing. Accordingly, when the data conversion is instructed, any one of the registered files is designated and the data conversion is performed for the width direction printing data of the designated file to obtain the longitudinal direction printing data for editing. Thus, the data of the files which are prepared and registered for the width direction printing can be diverted to the longitudinal direction printing. Consequently, high convenience is achieved and, as a whole, operability and working efficiency in print image creation, label production and the like can be improved.

A printing system according to this invention comprises: a supply unit which selects any one of longitudinal direction printing, in which an arranging direction of character strings coincides with a longitudinal direction of a tape, and width direction printing, in which the arranging direction coincides with a width direction of the tape, prepares communication data which expresses a print image having arranged images of the character strings and supplies the communication data through an interface capable of transmission; and a tape printing apparatus which receives the communication data through the interface, prints the print image on the tape based on the communication data and produces a label by cutting the tape in the width direction of the tape.

Moreover, a label producing method for a printing system according to this invention comprises the steps of: in a supply unit of a printing system including the supply unit and a tape printing apparatus, selecting any one of longitudinal direction printing, in which an arranging direction of character strings coincides with a longitudinal direction of a tape, and width direction printing, in which the arranging direction coincides with a width direction of the tape, preparing communication data which expresses a print image having arranged images of the character strings and supplying the communication data through an interface capable of transmission; and, in the tape printing apparatus, printing the print image on the tape based on the received communication data and producing a label by cutting the tape in the width direction of the tape.

In the printing system and the label producing method described above, the supply unit selects any one of the longitudinal direction printing and the width direction printing and the tape printing apparatus prints the print image on the tape based on the communication data supplied to the tape printing apparatus through the interface from the supply unit and produces the label by cutting the tape in the width direction of the tape. Thus, despite the fact that the printing system is a separate type, it is possible to perform printing of the print image by the width direction printing and label production.

Preferably, the supply unit comprises: file registration means for registering width direction print image creation data for creating the print image in the width direction printing as files corresponding to the print image; and file designation means for designating a file to be printed among the registered files. The print image data that is image data of the print image is created based on the width direction print image creation data of the designated file to be printed. The tape printing apparatus comprises print means for printing the print image based on the print image data.

According to the configuration described above, print image creation data such as text data for character image expansion, for example, for the width direction printing and other accompanying information (for example, element image data and the like which are prepared by a dot map and the like) is registered as the files corresponding to the print image. Accordingly, when the width direction printing is selected, the file to be printed is designated among the registered files and the corresponding print image can be created and printed based on the designated file. In this case, files for the width direction printing are prepared without diverting files for the longitudinal direction printing. Thus, contents (information) suitable for the width direction printing can be registered. Thus, creation and printing of the print image suitable for the width direction printing and the label production can be performed more easily and quickly than a conventional case in which functions for the longitudinal direction printing are utilized and the print image is diverted (rotated by 90 degrees or the like) to create the print image.

Preferably, the supply unit comprises source print image creation means for creating the print image data and the interface can transmit the communication data while including the print image data in the communication data.

According to the configuration described above, the supply unit can create the print image data based on the print image creation data of the designated file to be printed and can transmit the communication data by including the created print image data therein. Thus, the tape printing apparatus can print the print image based on the received print image data and can easily and quickly perform creation and printing of the print image suitable for the width direction printing and the label production based on the designated file to be printed.

In the printing system comprising the file registration means described above, preferably, the interface is capable of transmitting the communication data by including therein the width direction print image creation data of the designated file to be printed. The tape printing apparatus further comprises source print image creation means for creating the print image data based on the received width direction print image creation data.

According to the configuration described above, the print image creation data of the designated file to be printed can be transmitted while being included in the communication data and the tape printing apparatus can create the print image data based on the received print image creation data. Thus, the print image can be printed based on the created print image data. In addition, based on the designated file to be printed, it is possible to easily and quickly perform creation and printing of the print image suitable for the width direction printing and label production.

In the printing system including the file registration means described above, preferably, the supply unit further comprises label width setting means for setting a label width as a size in the longitudinal direction of the label when the width direction printing is selected. The file registration means includes accompanying information registration means for registering information on the set label width by including the information in accompanying information of the file. Cut instruction data for instructing cut processing of cutting the tape having the print image printed thereon in accordance with the label width is generated based on the information on the label width included in the accompanying information of the file. The tape printing apparatus further comprises cut means for performing the cut processing based on the cut instruction data.

According to the configuration described above, when the width direction printing is selected, the label width can be set as the size in the tape longitudinal direction of the label and can be registered while being included in the accompanying information of the file. Thus, for example, even immediately after other operations are performed such as creation of files having label widths which are designated differently, it is possible to easily and quickly create and print a desired print image and to produce a label having a desired label width just by reading the registered files without requiring resetting of the label width.

In the printing system described above, the supply unit preferably comprises source cut instruction generation means for generating the cut instruction data and the interface can transmit the communication data by including the cut instruction data therein.

According to the configuration described above, the supply unit can generate the cut instruction data based on the information on the label width included in the accompanying information of the file and can transmit the communication data by including the generated cut instruction data therein. Thus, the tape printing apparatus can perform the cut processing of the tape based on the received cut instruction data and can easily and quickly perform label production by the width direction printing based on the designated file to be printed.

In the printing system which registers the information on the label width described above by including the information in the accompanying information, preferably, the interface is capable of transmitting the communication data by including therein the information on the label width included in the accompanying information of the designated file to be printed. The tape printing apparatus further comprises source cut instruction generation means for generating the cut instruction data.

According to the configuration described above, the information on the label width included in the accompanying information of the designated file to be printed can be transmitted while being included in the communication data. Moreover, the tape printing apparatus can generate the cut instruction data based on the received information on the label width. Thus, the cut processing of the tape can be performed based on the generated cut instruction data and the label production by the width direction printing can be easily and quickly performed based on the designated file to be printed.

In the printing system comprising the file registration means described above, the supply unit preferably further comprises mounting means capable of mounting a storage medium storing files which can be registered in the file registration means.

According to the configuration described above, the supply unit can mount the storage medium storing the files which can be registered in the file registration means. Accordingly, only by mounting various storage media, various new files can be stored (prepared by registration). Thus, despite the fact that the printing system is the separate type, it is possible to more easily and quickly perform creation and printing of the print image suitable for the width direction printing and the label production.

Preferably, the supply unit comprises upper communication means which is connected with other devices through a predetermined network and is capable of receiving files which can be registered in the file registration means from the other devices.

According to the configuration described above, the supply unit is connected with the other devices through the predetermined network and can receive the files which can be registered in the file registration means from the other devices. Accordingly, only by receiving files from various devices, various new files can be stored (prepared by registration). Thus, despite the fact that the printing system is the separate type, it is possible to more easily and quickly perform creation and printing of the print image suitable for the width direction printing and the label production.

Preferably, the supply unit comprises: the longitudinal direction printing data editing means for editing longitudinal direction print image creation data in order to create a print image in the longitudinal direction printing; and data conversion means for designating any one of the registered files and converting the width direction print image creation data of the designated file into the longitudinal direction print image creation data.

According to the configuration described above, the supply unit can edit the data for longitudinal direction printing (for print image creation) in order to create the print image in the longitudinal direction printing. Any one of the files which are registered (for the width direction printing) is designated to convert the data for width direction printing (print image creation) of the designated file into the data for longitudinal direction printing. Thus, the data registered for the width direction printing can be diverted to the longitudinal direction printing. Consequently, high convenience is achieved and, as a whole, operability and working efficiency are improved.

A program according to this invention causes to function the above-described respective means of the tape printing apparatus and the respective means of the printing system and is capable of executing the above-described label producing method and data processing method.

The program described above is processed by a printing system capable of program processing. Thus, despite the fact that the printing system is a separate type, it is possible to easily and quickly perform creation and printing of a print image suitable for width direction printing and label production.

Moreover, a storage medium according to this invention stores each of the above-described programs so as to be readable by the above-described tape printing apparatus and the printing system which are capable of program processing.

In the printing system capable of program processing, the programs stored in the storage medium described above are read and executed. Thus, despite the fact that the printing system is a separate type, it is possible to easily and quickly perform creation and printing of a print image suitable for width direction printing and label production.

BRIEF DESCRIPTION OF THE DRAWINGS

The above advantages and other objects as well as the attendant features of this invention will become readily apparent by reference to the following detailed description when considered in conjunction with the accompanying drawings wherein:

FIG. 21 is an explanatory view similar to FIG. 16, which follows FIG. 20 and mainly shows one example of a cursor operation, an error annunciation and the like;

FIG. 43 is an explanatory view similar to FIG. 33, which follows FIG. 33 and mainly shows one example of an error annunciation and the like;

DETAILED DESCRIPTION OF THE PREFERRED EMBODIMENTS

With reference to the accompanying drawings, a detailed description will be given below of a tape printing apparatus (a tape printer) according to one embodiment of this invention.

Figure 1A:
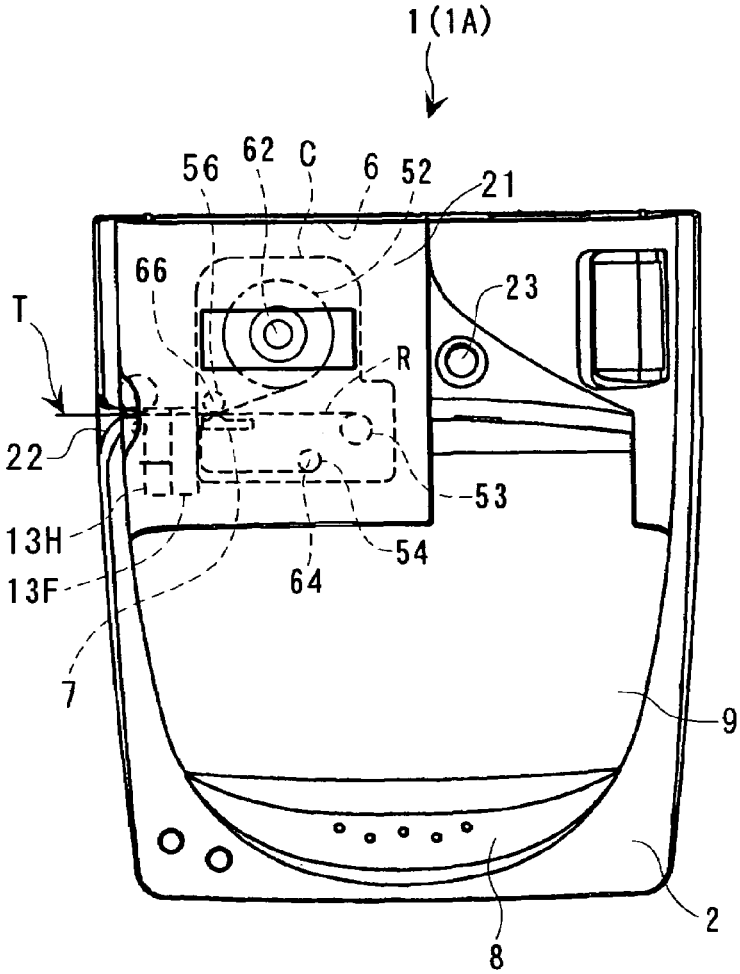
FIGS. 1A and 1B are external plan views of a tape printing apparatus according to one embodiment of this invention.
Figure 1B:
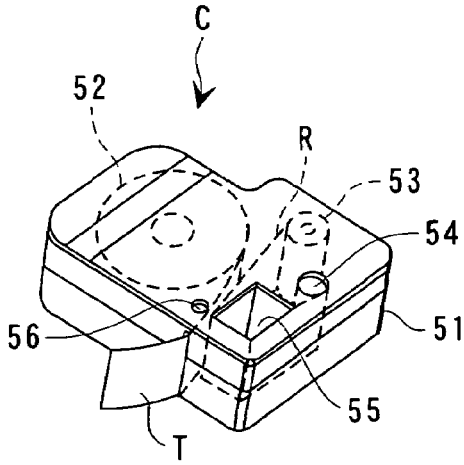
Figure 2:
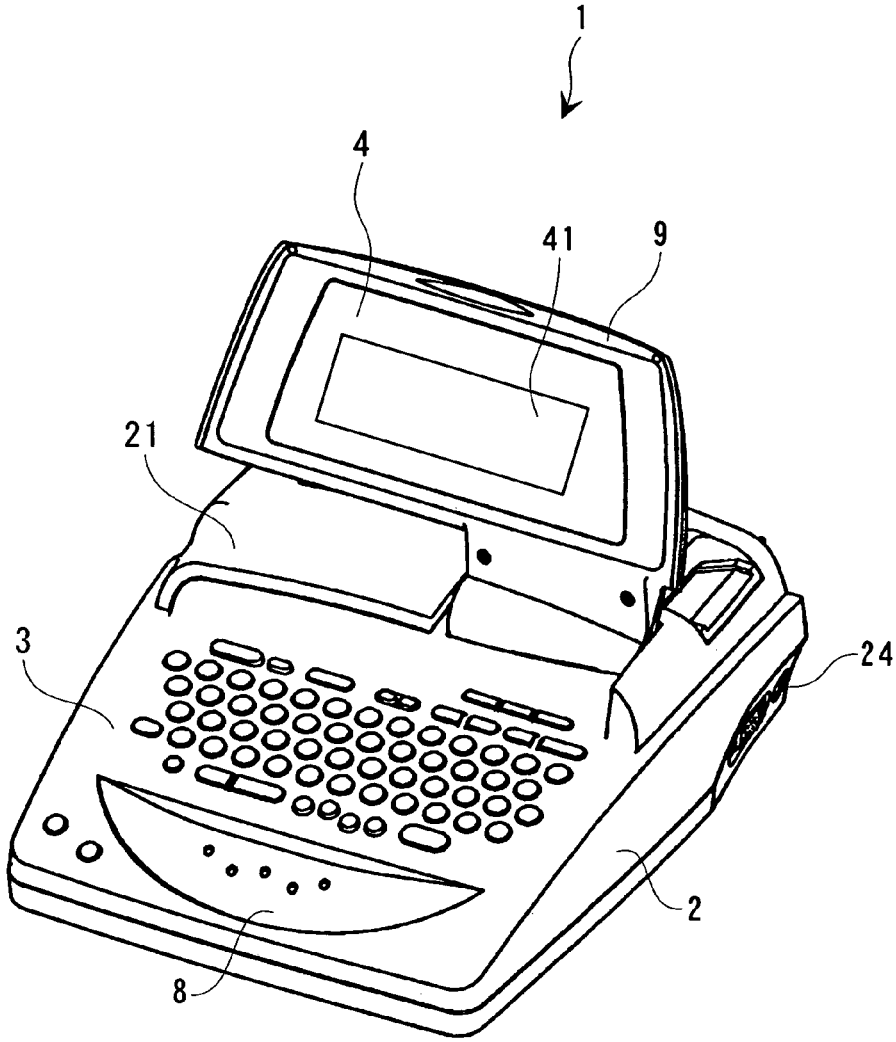
FIG. 2 is an external perspective view of the tape printing apparatus, showing a state in which a cover is lifted.

As shown in FIG. 1A and FIG. 2, this tape printing apparatus 1 has its external shape formed by a printer case (printer main body) 2. In an upper rear portion thereof, an opening and closing cover 21 is attached at the left side (as seen in the figure) so as to be freely opened and closed. On the right side of the opening and closing cover 21, an opening and closing button 23 for opening and closing the cover 21 is provided in a concave portion. Moreover, in the center of a front portion, a crescent-shaped part 8 including an exposed lamp group is formed so as to swell out. Behind the crescent-shaped part 8, a keyboard 3 including various keys is provided while taking a wide space. Moreover, above the keyboard 3, a large-size cover 9 which covers the keyboard 3 so as to be freely opened and closed is attached to an intermediate portion of the tape printing apparatus. In an inner surface of the cover 9, a display 4 is built.

The cover 9 protects the keyboard 3 by covering the keyboard 3 in its closed state and opens up the keyboard 3 to the front in its opened state. Specifically, in the opened state, the cover 9 is lifted upward and obliquely backward around a hinge at a rear right portion. At the same time, in the opened state, the cover 9 disposes the display 4 at the front to enable an input operation by using the keyboard 3. The display 4 has a rectangular display screen 41 inside its trapezoidal shape. On this display screen 41, input results and the like from the keyboard 3 are displayed.

Figure 3:
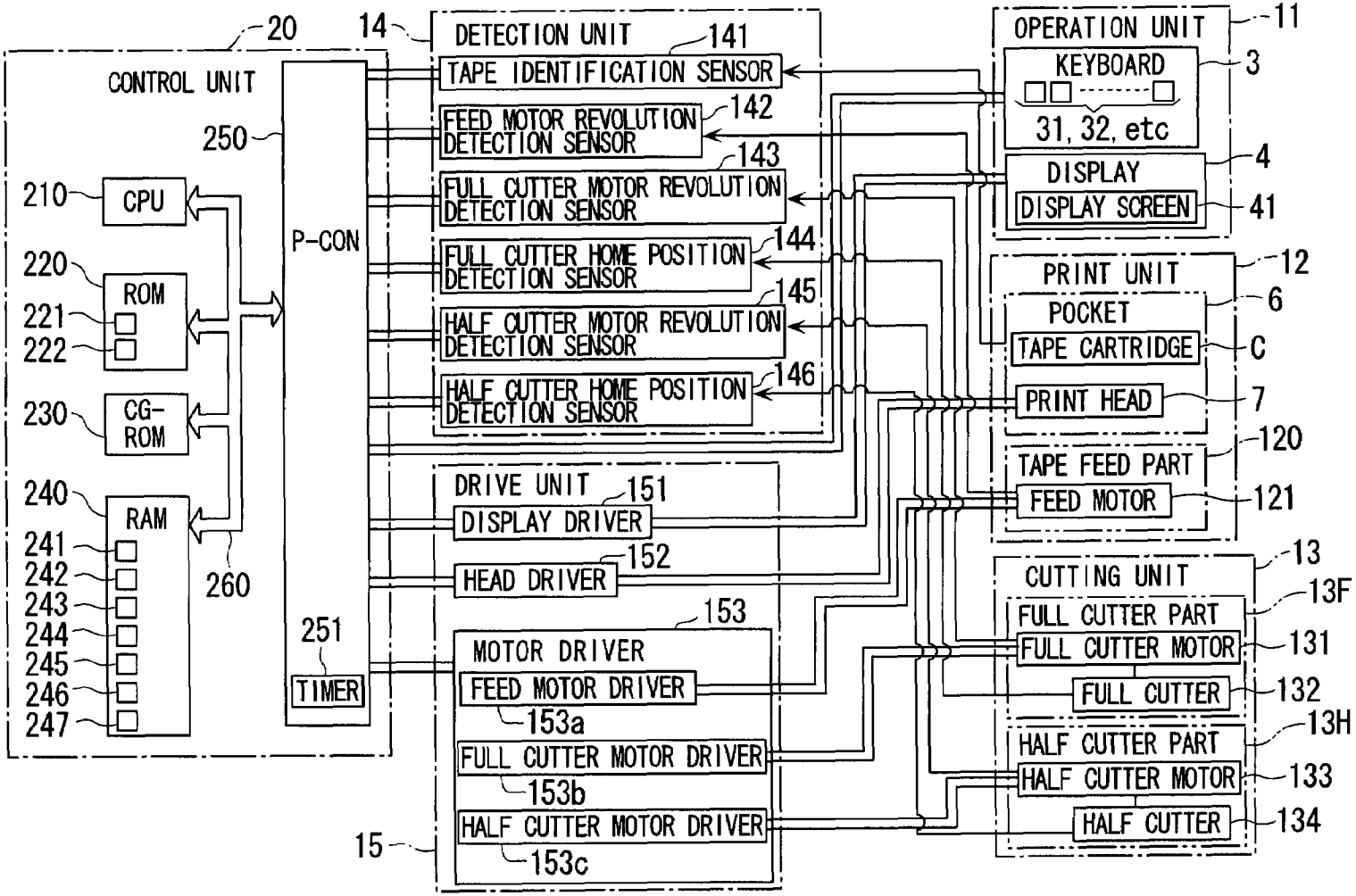
FIG. 3 is a block diagram of a control system of the tape printing apparatus.

Moreover, as shown in FIG. 3, as a basic configuration, the tape printing apparatus 1 is made up of: an operation unit 11 which has the keyboard 3 and the display 4 and serves as an interface with a user; a print unit 12 which has a print head (thermal head) 7 and a tape feed part 120 and prints on a print tape (hereinafter simply referred to as a "tape") T of a tape cartridge C mounted in a pocket (a cartridge mounting part and a tape mounting part) 6; a cutting unit 13 which performs various cuts of the tape T after being printed; a detection unit 14 which has various sensors for performing various detections; a drive unit 15 which has various drivers for driving circuits of respective parts; and a control unit 20 which controls the respective parts in the tape printing apparatus 1.

Accordingly, in the printer case 2, a circuit board (not illustrated) is housed besides the print unit 12, the cutting unit 13, the detection unit 14 and the like. On this circuit board, respective circuits of the drive unit 15 and the control unit 20 and the like are mounted besides a power supply unit. The respective circuits are connected to an AC adaptor connection port 24 or a battery (not illustrated) such as a NiCd battery that is detachable from the outside.

Figure 4A:
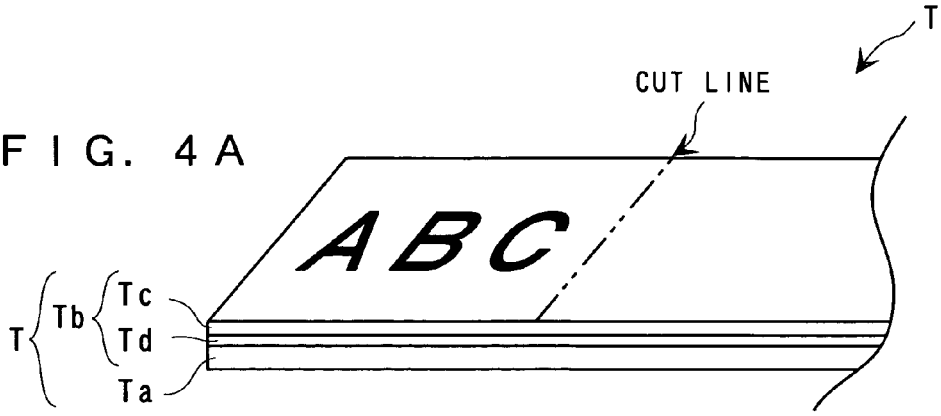
FIGS. 4A to 4D are explanatory views showing one example of a print result and a cutting result.
Figure 4B:
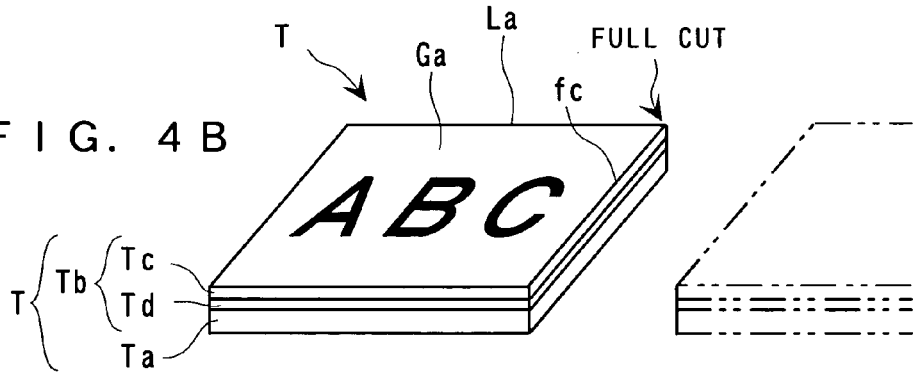
Figure 4C:
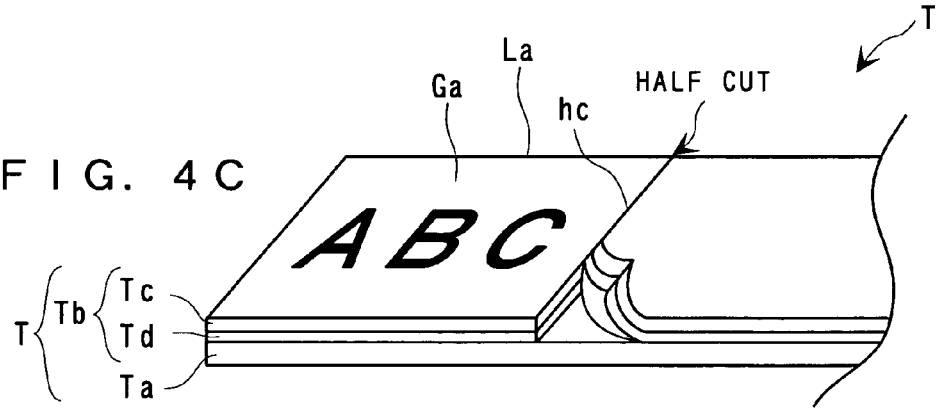
Figure 4D:
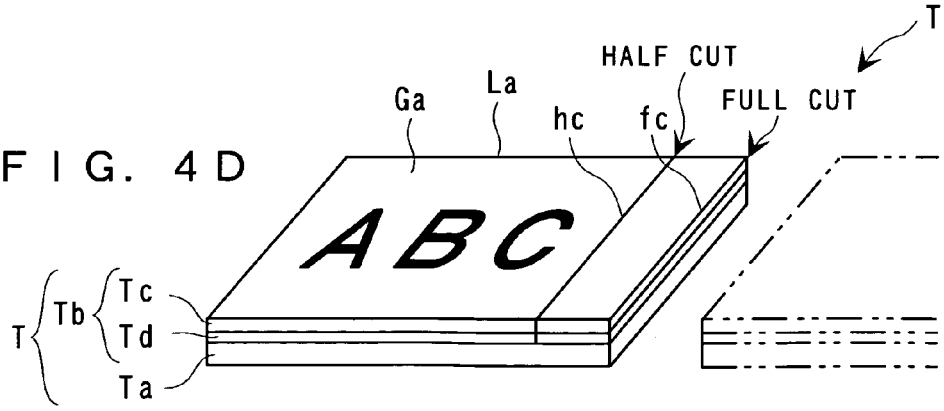

Moreover, as shown in FIGS. 4A to 4C, the tape T is formed of a release tape Ta and a base material tape Tb which are laminated on each other. The base material tape Tb is made up of: an image reception layer Tc at a front face (face to be printed) side which serves as a printing face; and an adhesive layer Td which is provided at its rear face (adhesive face) side. The printed tape T (label element (print image) Ga or a label area La) is used by being attached to an object of attachment with the adhesive layer Td interposed therebetween, the adhesive layer Td being exposed by separating the release tape Ta from the base material tape Tb.

As shown in FIGS. 1A and 1B, FIG. 2 and FIG. 3, in the print unit 12, the pocket 6 is provided inside the opening and closing cover 21. The tape cartridge C is attached to and detached from the pocket 6 in a state in which the opening and closing cover 21 is left open. Moreover, in a left side portion of the printer case 2, a tape discharge opening 22 is formed, which connects the pocket 6 with the outside of the printer and sends out a printed portion of the tape T.

The tape cartridge C has its external shape formed by a cartridge case 51. In the cartridge case 51, the tape T having a fixed width (about 4.5 mm to 48 mm) and an ink ribbon R are housed, and a through hole 55, into which the print head 7 is inserted, is formed. The tape T is rolled up (taken up) by a tape reel 52 so as to be freely let out while allowing the release tape Ta to face inward. The ink ribbon R is rolled up by a ribbon letting-out (ribbon feed) reel 53 and a ribbon take up reel 54. As to the tape width of the tape T housed in the tape cartridge C, various types-thereof are prepared.

Moreover, in a portion in which the tape T and the ink ribbon R overlap with each other, a platen roller (platen) 56 is housed so as to correspond to the print head 7. In a state in which the tape cartridge C is mounted, the print head 7 contacts a back of the ink ribbon R exposed from the through hole 55 and is heated and driven to print desired characters and the like on a surface of the tape T.

Moreover, on a back of the tape cartridge C, a plurality of small detection holes (not illustrated) are provided so that types of the tape T, which are different from each other in width and the like, can be identified. In the pocket 6, a tape identification sensor 141, such as microswitches, for detecting the presence of the respective detection holes is provided. Thus, it is possible to detect the presence of the tape T (to be precise, whether or not the tape cartridge C is mounted) and the type of the tape T (to be precise, the type of the tape cartridge C). The types described above may be indicated by attaching a detection label of a bit pattern and the like, instead of using the plurality of detection holes, and may be detected by photodetection or the like.

Moreover, there are vertically provided in the pocket 6: a platen drive shaft 66 which rotates the platen 56 by being engaged therewith by using a feed motor 121 made of a DC motor as a driving source; a rolling drive shaft 64 which rotates the ribbon rolling reel 54 similarly by being engaged therewith; and a positioning pin 62.

The tape feed part 120 is disposed in a space extending from the side of the pocket 6 to the lower side thereof and rotates the platen drive shaft 66 and the rolling drive shaft 64 by using the feed motor 121 disposed at the side of the pocket 6 as a source of power (drive). The tape feed part 120 is made up of: the feed motor 121; a speed reducing gear train (not illustrated) which transmits power of the platen drive shaft 66, the rolling drive shaft 64 and the feed motor 121 to the respective drive shafts; and an encoder (not illustrated) for detecting the number of revolutions of the feed motor 121. This encoder is fixed coaxially to a tip of a worm fixed to a main shaft of the feed motor 121. In the encoder, detection openings are formed in a plurality of spots in a circumferential direction of a disk shape.

A feed motor revolution detection sensor 142 of the detection unit 14 includes a photosensor (not illustrated) in which light emitting elements and light receiving elements are arranged while facing each other so as to front the detection openings of the encoder described above. Light of the light emitting elements passes through the rotating detection openings and is received by the light receiving elements. Thereafter, blink of the received light is subjected to photoelectric conversion and outputted to the control unit 20 as pulse signals. Accordingly, the number of revolutions is detected based on the number of pulses.

Here, when the user uses the tape printing apparatus 1, first, the user opens the opening and closing cover 21 with the opening and closing button 23. When the tape cartridge C is mounted in the pocket 6, the platen drive shaft 66 and the rolling drive shaft 64 are engaged with the platen 56 and the ribbon rolling reel 54, respectively. In addition, the tape T and the ink ribbon R are inserted between the platen 56 and the print head 7. Thereafter, when the opening and closing cover 21 is closed, the print head 7 having rows of heater elements in a tape width direction is rotated to be pressed against the platen 56 so as to sandwich the tape T and the ink ribbon R therebetween. Accordingly, the tape printing apparatus becomes a print standby state.

In this state, the cover 9 is opened to make the keyboard 3 accessible and the keyboard 3 is operated with reference to the display 4 positioned to face the front. Thereafter, print information of characters such as desired letters is inputted and edited and print execution is instructed. Accordingly, print processing is started and the tape T and the ink ribbon R which are let out by the drive of the feed motor 121 are conveyed while overlapping with each other at the portion of the print head 7. In synchronization therewith, the print head 7 is heated and driven to perform printing by thermally transferring ink of the ink ribbon R onto the tape T.

The ink ribbon R after printing is rolled up by the ribbon rolling reel 54 and the tape T after printing is sent toward the tape discharge opening 22 along a feed path. When the printing is finished, the printed tape T is sent for a predetermined length and stopped. Thereafter, in accordance with various settings to be described later, the cutting unit 13 performs various cuts (see FIGS. 4A to 4D).

Next, between the pocket 6 and the tape discharge opening 22, the cutting unit 13 includes: a full cutter part (full-cutting means) 13F, which faces the feed path, at its upstream side; and a half cutter part (half-cutting means) 13H at its downstream side. The full cutter part 13F cuts (full-cuts) both of the base material tape Tb and the release tape Ta of the tape T. For example, the full cutter part 13F is for separating the label area La that is the printed portion from the tape T (see full-cutting (full-cut portion) fc of FIG. 4B). On the other hand, the half cutter part 13H cuts (half-cuts) only the base material tape Tb to be attached as a label at last. The half cutter part 13H is for leaving the tape T in a state in which the printed portion is connected to the tape T by means of the release tape Ta (see half-cutting (half-cut portion) hc of FIG. 4C).

The full cutter part 13F includes: a full cutter 132 made of, for example, a cutter of a scissors type, a slide cutter or the like; and a cutter operating mechanism (not illustrated) which operates the full cutter 132 by using a full cutter motor 131 made of a DC motor as a driving source. Moreover, the half cutter part 13H includes: a half cutter 134 which has a cutter blade formed of an oblique blade; and a cutter operating mechanism (not illustrated) which operates the half cutter 134 similarly by using a half cutter motor 133 made of a DC motor as a driving source. In this case, the half cutter 134 is formed to execute circulation motion by the cutter operating mechanism. Accordingly, movement from the lower side to the upper side, which is one process of the circulation motion, becomes a cutting action of the half cutter 134 to half-cuts the tape T.

In the full cutter motor 131 and the half cutter motor 133, encoders (not illustrated) which are similar to that of the feed motor 121 described above are provided, respectively. Similar to the feed motor revolution detection sensor 142 described above, a full cutter motor revolution detection sensor 143 and a half cutter motor revolution detection sensor 145 of the detection unit 14 include the respective encoders and photosensors in which light emitting elements and light receiving elements are arranged while facing each other so as to front detection openings of the encoders described above. Blink of light received by the light receiving elements after passing through the rotating detection openings is subjected to photoelectric conversion and outputted to the control unit 20 as pulse signals. Accordingly, the number of revolutions is detected based on the number of pulses. Moreover, a full cutter home position detection sensor 144 and a half cutter home position detection sensor 146 of the detection unit 14 detect that the respective cutter operating mechanisms of the full cutter part 13F and the half cutter part 13H are located at home positions thereof.

The detection unit 14 includes the tape identification sensor 141, the feed motor revolution detection sensor 142, the full cutter motor revolution detection sensor 143, the full cutter home position detection sensor 144, the half cutter motor revolution detection sensor 145 and the half cutter home position detection sensor 146, all of which are described above. In accordance with an actual situation, the detection unit 14 can also have a constitution in which the above-described sensors are omitted.

Next, the drive unit 15 includes a display driver 151, a head driver 152 and a motor driver 153. The display driver 151 drives the display 4 of the operation unit 11 based on a control signal outputted from the control unit 20 according to an instruction thereof. Similarly, the head driver 152 drives the print head 7 of the print unit 12 according to an instruction of the control unit 20. Moreover, the motor driver 153 includes: a feed motor driver 153*a* for driving the feed motor 121 of the print unit 12; a full cutter motor driver 153*b* for driving the full cutter motor 131 of the cutting unit 13; and a half cutter motor driver 153*c* for driving the half cutter motor 133 of the cutting unit 13. Similarly, the motor driver 153 drives the respective motors according to an instruction of the control unit 20.

Next, the operation unit 11 includes the keyboard 3 and the display 4. The display 4 has the display screen 41 capable of displaying display images based on display image data. The display 4 is used when the user inputs data from the keyboard 3 to create or edit print image data such as character string image data, when the user views results and the like of the created or edited data, when the user inputs various command or selection instructions and the like from the keyboard 3, and the like.

In the keyboard 3, a function key group 32 for designating various operation modes and the like is arranged, other than a character key group 31 including an alphabet key group, a numeric key group, a kana key group such as hiragana and katakana, an external character key group for calling up and selecting external characters, and the like. Various instructions and data are inputted to the control unit 20 from the keyboard 3. In the function key group 32, included are: a power key; a print key for providing instructions related to print processing; a selection key for data determination or line feed in text input and for instructing selection in a selection screen; four cursor keys for moving a cursor from side to side and up and down, respectively, or moving a display range of the display screen 41; and the like. The functions described above may be inputted by providing keys separately for each key input or may be inputted by combining the keys with a shift key or the like and using fewer keys.

Next, the control unit 20 includes a CPU 210, a ROM 220, a character generator ROM (CG-ROM) 230, a RAM 240 and a peripheral control circuit (P-CON) 250, which are connected to each other through an internal bus 260.

Besides a control program region 221 for storing control programs processed by the CPU 210, the ROM 220 has a control data region 222 for storing control data including a color conversion table, a character modification table and the like. The CG-ROM 230 stores font data of characters and the like (including numbers, symbols, figures and the like) which are prepared in the tape printing apparatus 1. Upon receipt of code data which specifies characters and the like, the CG-ROM 230 outputs font data corresponding thereto.

The RAM 240 is backed up when the power is off and includes regions such as: various flag and register groups 241; a text data region 242; a display image data region 243; a print image data region 244; a drawing registration image data region 245; an external character registration image data region 246; and various buffer regions 247 such as a character development buffer and a print buffer. The RAM 240 is used as a work space for control processing.

In the tape printing apparatus 1, in a state in which text data is inputted or edited by using keys from the keyboard 3 (text editing state), the inputted text data is stored in the text data region 242 of the RAM 240. At the same time, the stored text data is subjected to image development and stored in the display image data region 243 as image data for display (display image data). The display image data is outputted and displayed on the display screen 41 of the display 4 as needed (this state of the display screen 41 when the text data is inputted or edited will be hereinafter referred to as a "text editing screen"). Moreover, in a display state of this text editing screen or other screens, results of editing performed in accordance with various settings are stored in the print image data region 244 as image data for printing (print image data).

In the P-CON 250, logic circuits for supplementing functions of the CPU 210 and handling interface signals with peripheral circuits are built, which are configured by using a gate array, a custom LSI and the like. For example, a timer 251 which performs various clocking and the like are also built in the P-CON 250 as its functions. Thus, the P-CON 250 is connected to the various sensors of the detection unit 14 and the keyboard 3 and fetches the above-described various detection signals from the detection unit 14, various instructions and input data from the keyboard 3, and the like, directly or after being processed, into the internal bus 260. At the same time, in conjunction with the CPU 210, the P-CON 250 outputs data and control signals, which are outputted to the internal bus 260 from the CPU 210 and the like, directly or after being processed, to the drive unit 15.

Accordingly, with the configuration described above, the CPU 210 inputs various detection signals, various instruction signals, various data and the like through the P-CON 250 according to the control program in the ROM 220. Thereafter, the CPU 210 processes the font data from the CG-ROM 230, various data in the RAM 240 and the like and outputs a control signal to the drive unit 15 through the P-CON 250. Thus, the CPU 210 controls the print head 7 to print on the tape T under predetermined print conditions. At the same time, the CPU 210 controls the entire tape printing apparatus 1 such as positional control of the printing, various cutting (cut) control of the tape T and display control of the display screen 41.

Figure 5:
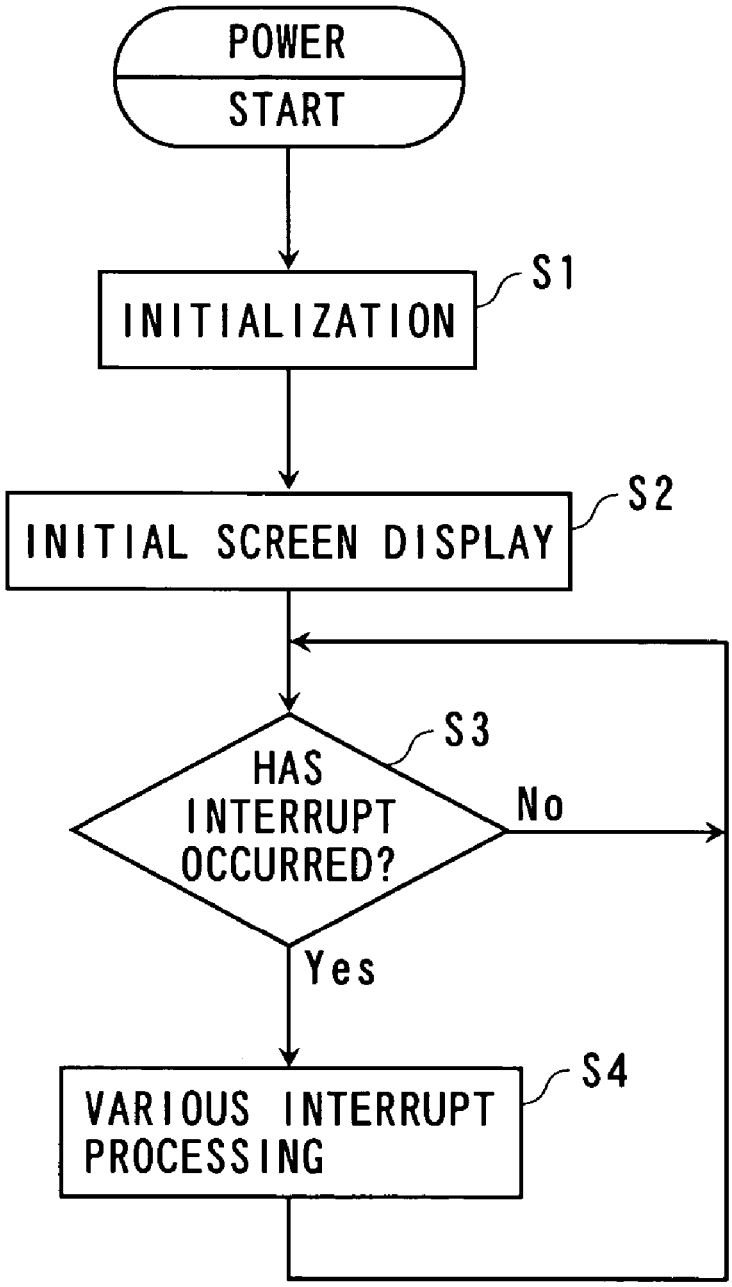
FIG. 5 is a flowchart schematically showing processing of entire control of the tape printing apparatus.

Next, with reference to FIG. 5, a description will be given of a processing flow of the entire control of the tape printing apparatus 1. When the processing is started by pressing the power key (turning on power), as shown in FIG. 5, first, initialization such as restoration of respective saved control flags is performed in order to return to a previous state in which the power was turned off (Si). Next, a previous display screen is displayed as an initial screen (S2).

The processing following the above steps in FIG. 5, i.e., determination branching whether or not key input is performed (S3) and various interrupt processing (S4) are conceptual processing. In reality, in the tape printing apparatus 1, after finishing the display of the initial screen (S2), interruption by key input and the like is permitted and the current state is maintained as it is until some kind of interruption occurs (S3: No). When some kind of interruption occurs (S3: Yes), the processing moves to respective interrupt processing (S4). After finishing the interrupt processing, the state is maintained again (S3: No).

As described above, in the tape printing apparatus 1, the processing is mainly performed by the interrupt processing. Thus, if the tape printing apparatus 1 is ready for print image creation and the like, the user provides a print instruction at an arbitrary point in time. Accordingly, print instruction interrupt occurs and print processing is started. Thus, a print image can be printed based on print image data. Specifically, the operating procedure up to printing can be selected arbitrarily by the user.

Figure 6A:
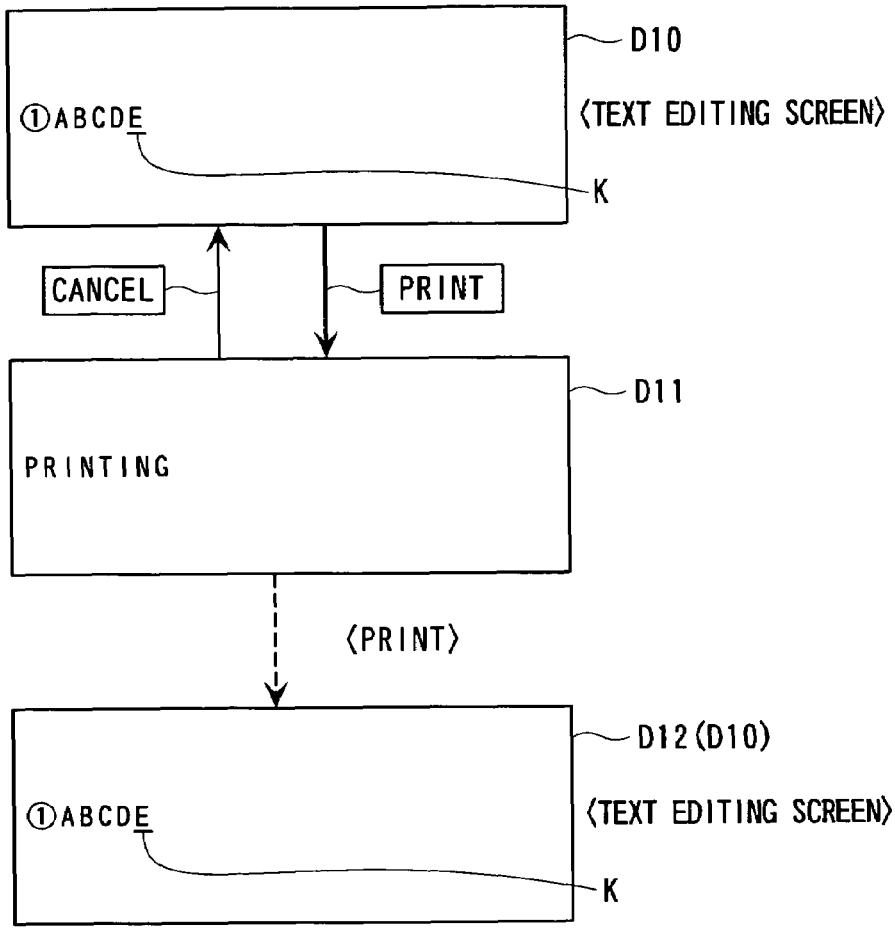
FIG. 6A is an explanatory view of a display screen and a typical operation on the display screen, showing one example in printing
Figure 6B:
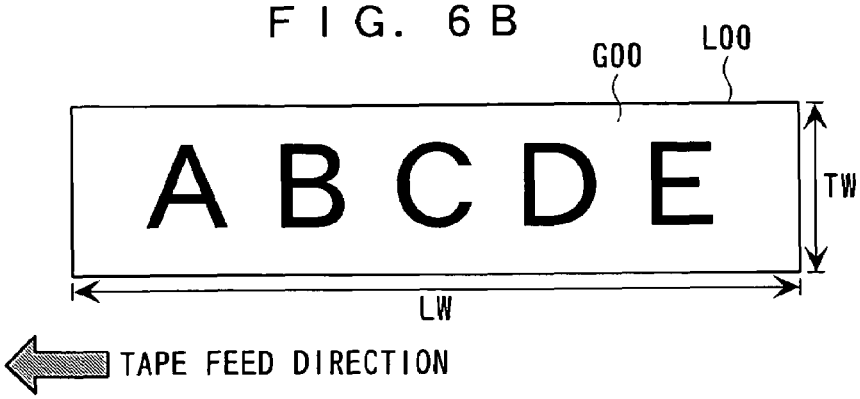
FIG. 6B is an explanatory view showing one example of a print result by the printing.

For example, as shown in FIG. 6A, in a state of displaying a text editing screen (screen D10) after inputting a character string "ABCDE" of a first line up to a cursor K (states of the display screen 41 will be hereinafter referred to as screens D11, D12, . . . and the like and will be described and shown only by these reference numerals), when the user presses the print key, a message of "printing" is displayed (D11). At the same time, a character string image of the character string "ABCDE" is printed as a print image G00 and the tape is cut according to a setting to produce a label L00 (see FIG. 6B). After the printing is finished, the display is returned to the original text editing screen (D12: the same as D10). In the tape printing apparatus 1, the user can use a cancel key to cancel various instructions by key input. For example, by pressing the cancel key from the above-described state (D11), the display can be returned to the state of displaying the original text editing screen (D10).

The tape printing apparatus 1 can perform not only "longitudinal direction printing" in which printing is performed so as to allow an arranging direction of the character string in the print image to coincide with a tape feed direction (longitudinal direction) as described above (see FIG. 6B) but also "width direction printing" in which printing is performed so as to allow the arranging direction of the character string to coincide with a tape width direction. Furthermore, the tape printing apparatus 1 is configured to be able to easily and quickly perform creation, editing, and printing of a print image suitable for the "width direction printing" and label production. As a first embodiment, a description will be given below by taking, as an example, a case of "free width printing" which is a type of the width direction printing and capable of freely (arbitrarily) setting a width of a label to be produced (label width).

Figure 7:
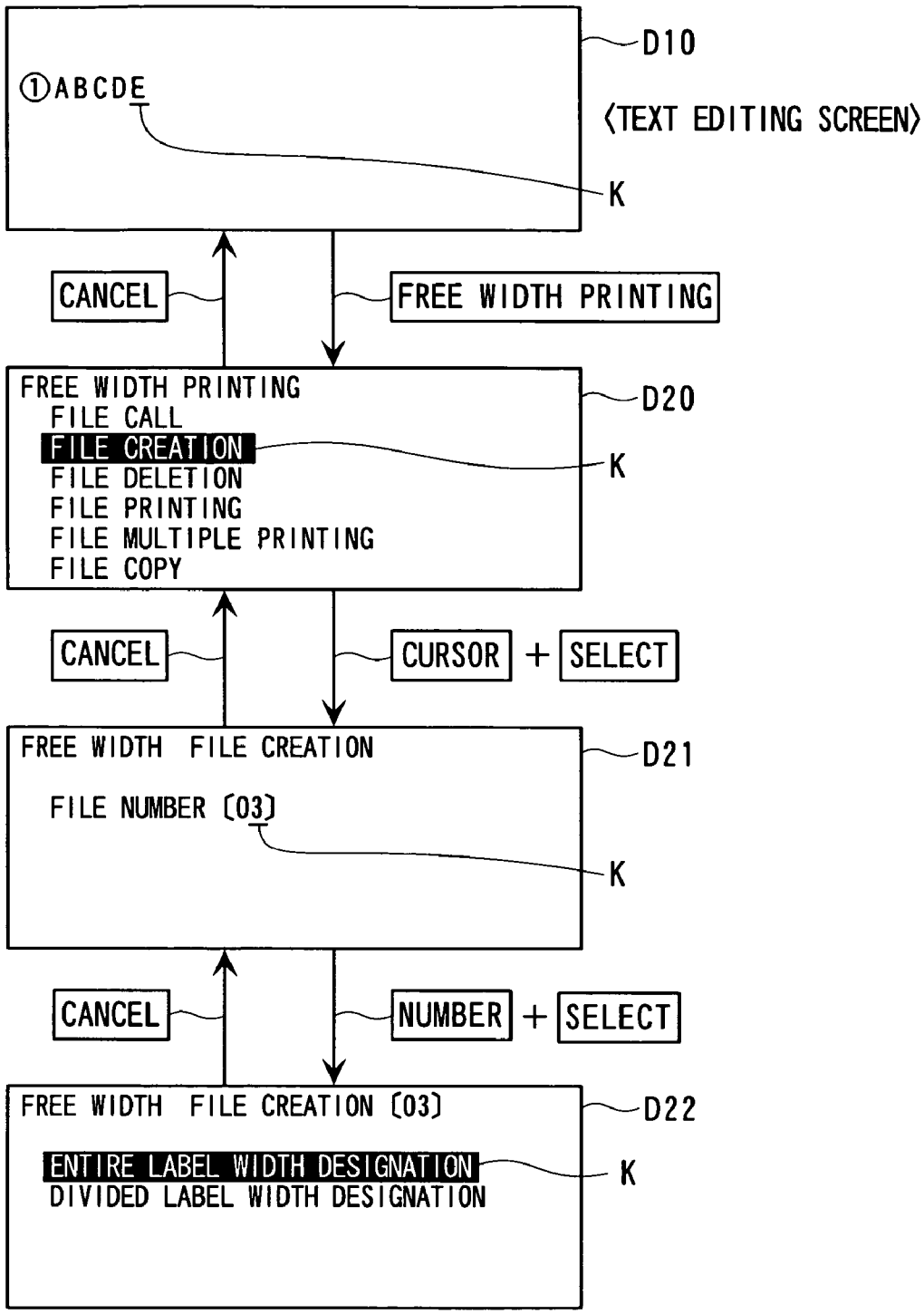
FIG. 7 is an explanatory view showing, as a first embodiment, one example of a typical operation in case where "file creation" is performed among functions of "free width printing" that is a type of width direction printing.

As shown in FIG. 7, in the tape printing apparatus 1 of this embodiment, for example, when the user presses (operates) a free width print key included in the function key group 32 from the state of the text editing screen described above (D10), options of a selection screen in the first hierarchy of the "free width printing" are displayed (D20). It is also possible that, instead of pressing the free width print key, a menu screen of "special printing" is displayed and the display is shifted (screen transition) to the selection screen described above by selecting (designating) the "free width printing" in the menu screen.

This selection screen (D20) is a menu screen of various functions related to the "free width printing" (hereinafter referred to as a "function selection screen"). Here, the options thereof include "file call", "file creation", "file deletion", "file printing", "file multiple printing", "file copy", "text conversion" and the like. One of the options, which is designated or specified by the cursor K and highlighted (displayed by the negative), is displayed in a state of being a selection candidate (hereinafter referred to as "selection display").

Here, in terms of specifications, immediately after the screen transition, a previously selected option (i.e., an option of the most recent access and is a default option when there is no corresponding option) is subjected to the selection display (D20). The example of FIG. 7 shows a state in which "file creation" is subjected to the selection display. The user can subject another option to selection display by operating the cursor from the above-described state (D20). Moreover, here, "file" means a set of text data which serves as a source of a character string image of a print image. Management of the print image in the "free width printing" is performed based on this "file" as a unit.

Here, if the user subjects "file call" to the selection display, for example, by a cursor operation and, thereafter, presses the selection key (this operation "selection display"+ "pressing of selection key" will be hereinafter referred to as a "selection operation"), desired (arbitrary) one of "files" which are registered can be selected and called up. If the user subjects "file deletion" to the selection operation, desired (arbitrary) one of the registered "files" can be selected and deleted. Alternatively, if the user subjects "file copy" to the selection operation, any one of the registered "files" can be selected and registered as another new "file."

Among the other options, "file printing", "file multiple printing" and "text conversion" will be described later. Here, first, "file creation" which serves as the basis will be described below.

In a state in which the selection screen is displayed as described above (D20), "file printing" is selected by various cursor operations and a selection key operation (selection operation). Next, an input screen is displayed (D21), which encourages or urges input of the number of a "file" to be newly registered. Here, in terms of specifications, immediately after the screen transition, a minimum value of a free number ("03" in the illustrated example) is displayed as default (D21). From this state (D21), the user can select another file number (for example, "04", "22" or the like) by pressing the selection key after inputting another number ("04", "22" or the like) by operating a numeric key included in the character key group 31. However, when a number which is already registered is inputted, the number becomes invalid (the number may be overwritten here or warning or the like may be displayed to the effect that the number is invalid or overwritten).

Figure 8:
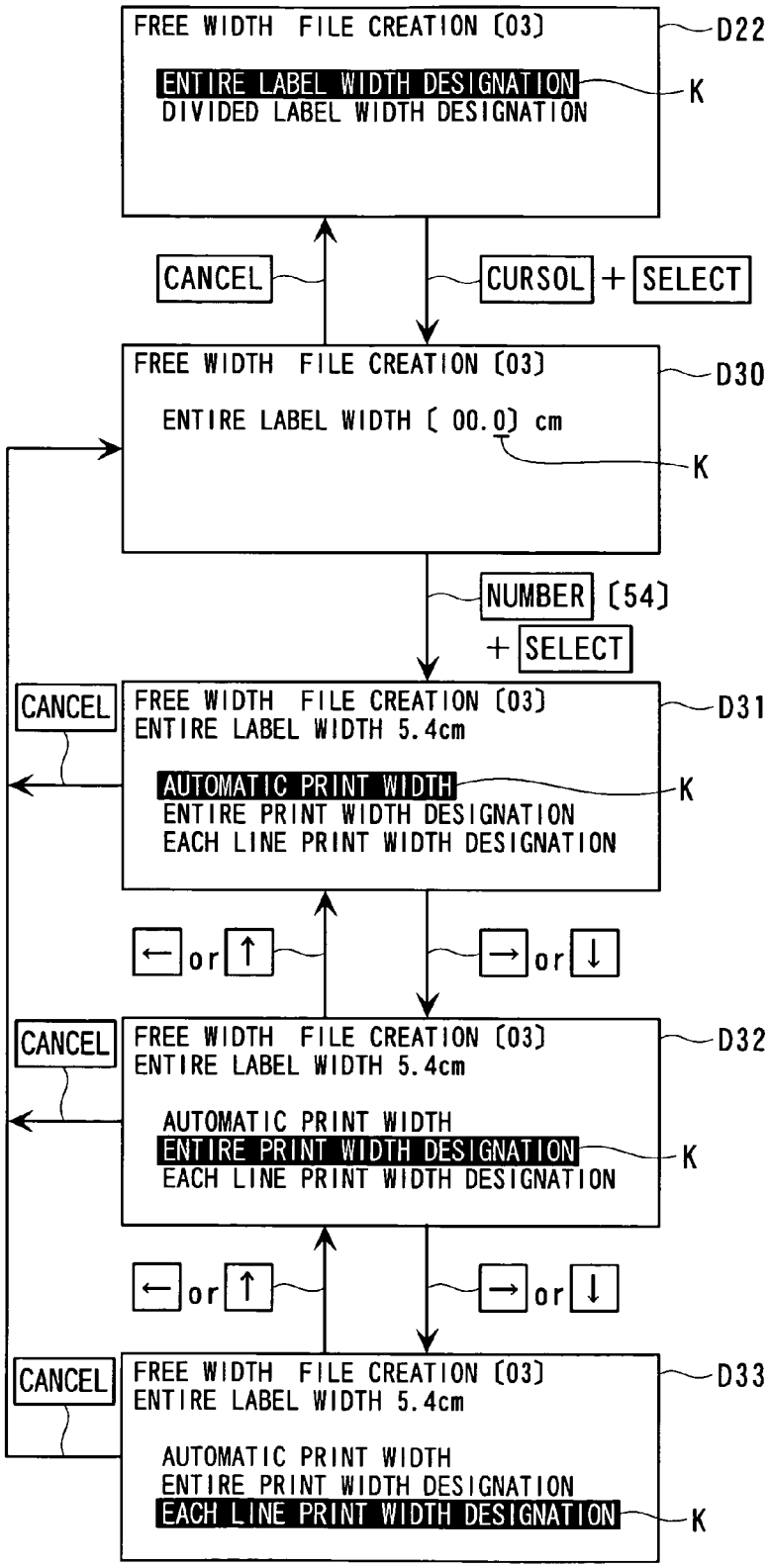
FIG. 8 is an explanatory view similar to FIG. 7, showing one example in case where "file creation" of "free width printing" is performed by "entire label width designation" subsequently to FIG. 7.
Figure 24:
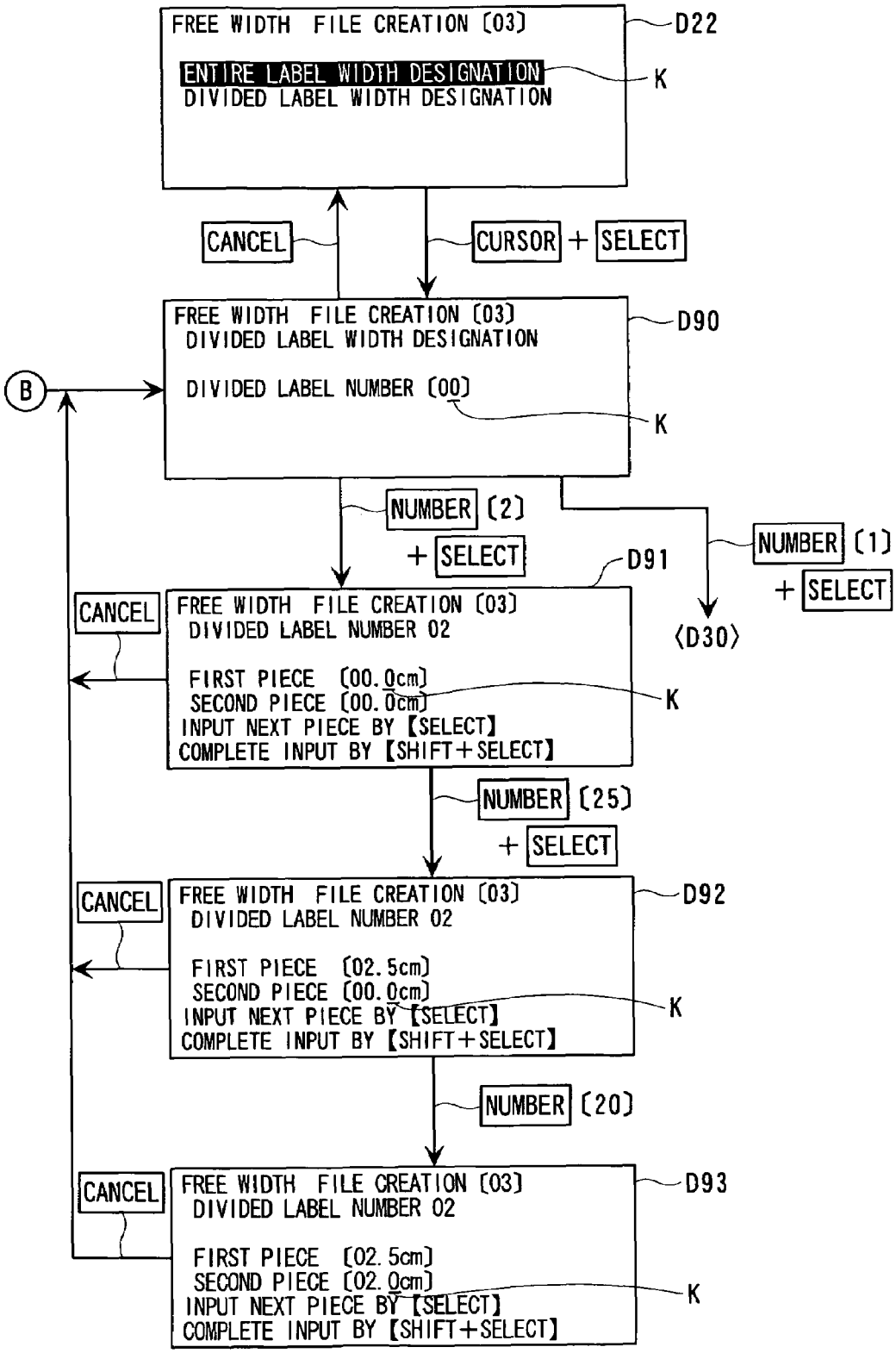
FIG. 24 is an explanatory view similar to FIG. 7, showing, as a fourth embodiment, the case where "file creation" of "free width printing" is performed by "divided label width designation" subsequently to FIG. 7.

Here, if the election of the file number "03" is supposed to have been determined (the selection key is pressed) as it is, next, a selection screen in its lower hierarchy is displayed (D22: common in FIGS. 7, 8 and 24). This selection screen (D22) is a menu screen for selecting how to associate a file of the file number "03" to be created (hereinafter simply referred to as a file "03"), i.e., text data, with a label width of a label to be produced based thereon. Here, options thereof include "entire label width designation", "divided label width designation" and the like. The option "entire label width designation" is the option for designating a label width of one piece of label for the purpose of producing the one piece of label based on the file "03." The option "divided label width designation" is the option for designating label widths of labels which are divided into multiple pieces for the purpose of producing the divided labels.

Here, as shown in FIG. 8, if "entire label width designation" is subjected to the selection operation, next, an input screen which encourages input of "entire label width" is displayed as a screen in the lower hierarchy (D30). Here, immediately after the screen transition, an entire label width "00.0 cm" is displayed as default. From this state (D30), the user can designate the entire label width=5.4 cm (54 mm) by pressing the selection key after inputting, e.g., "54" (54 mm) by operating the numeric key.

Figure 9:
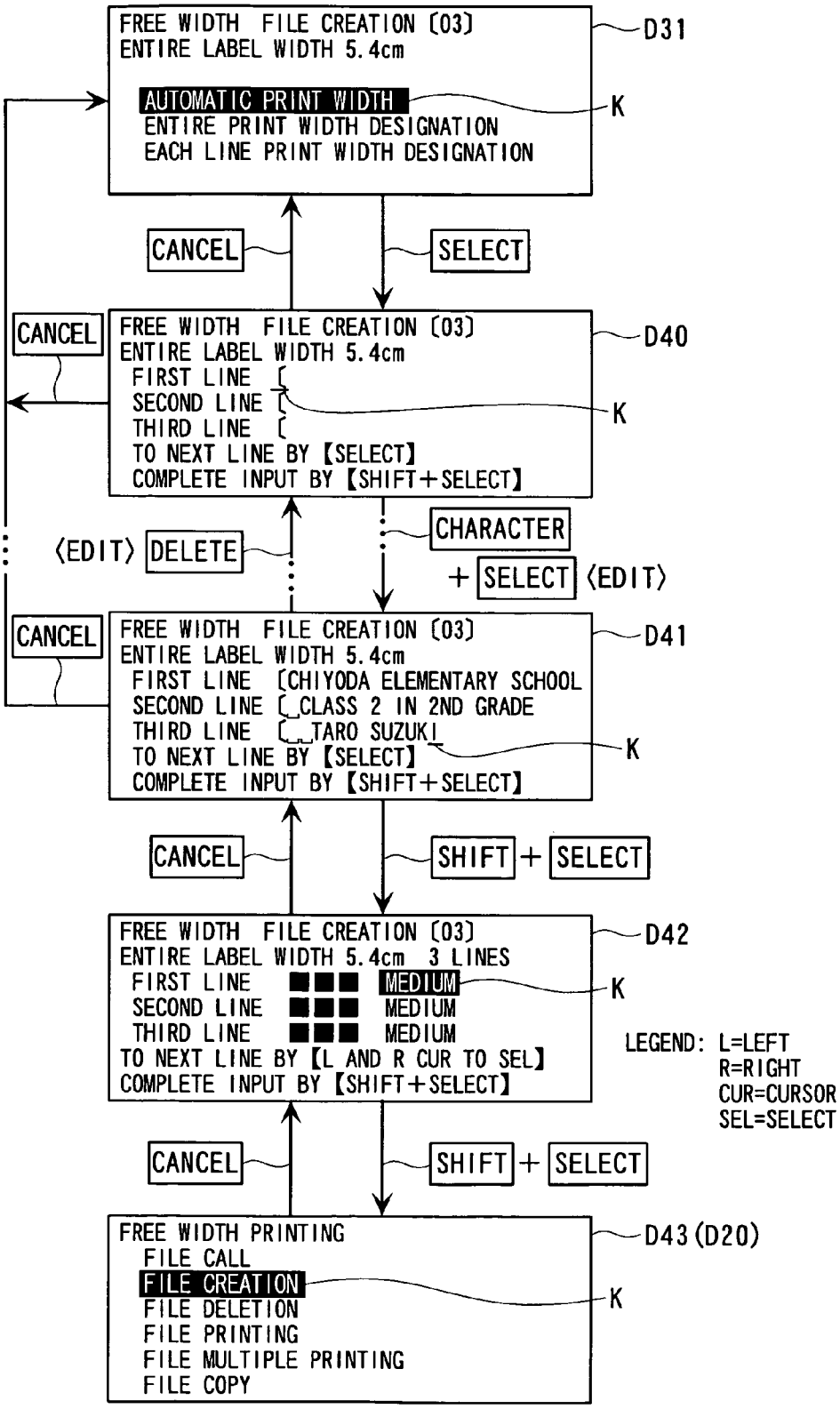
FIG. 9 is an explanatory view similar to FIG. 7, showing one example in case where "file creation" is performed by "automatic print width" of "entire label width designation" subsequently to FIG. 8.

When the entire label width is designated (inputted), next, a selection screen in a still lower hierarchy is displayed (D31: common to FIG. 9). This selection screen (D31) is a menu screen (selection screen for selecting a method of designating a print width) for selecting how to set the width in printing a print image (a length in a label width direction and a tape longitudinal direction: hereinafter referred to as a "print width") separately from a width of a label to be produced. Here, options thereof include "automatic print width", "entire print width designation", "each line print width designation" and the like (D31 to D33). Among these options, "automatic print width" is the option for allowing the print width to coincide with a designated label width, i.e., for establishing "entire label width=entire print width." The term "entire print width designation" is the option for designating a print width of the entire print image (entire print width) regardless of the designation of the entire label width. When multiple lines of character strings are included in a print image, "each line print width designation" is the option for individually designating a print width of each line ("each line" print width or "each-line" print width) regardless of the designation of the entire label width.

The option "entire print width" PW to be described below means, to be precise, not a print width of the entire print image but a print width of a development (arrangement) area of a character string image in the print image, the character string image being subjected to image development based on the text data of the file created and registered for "free width printing" (width direction printing). As described later, the print width of the entire print image includes a front end side print margin (front end side margin) PMs and a rear end side print margin (rear end side margin) PMe aside from the entire print width PW (see FIGS. 13A to 13C). If the front end side margin PMs=the rear end side margin PMe=0 mm, the entire label width LW becomes equal to the entire print width PW. Thus, in order to differentiate the entire print width from "each line print width" and the like, the entire print width PW is called "entire print width" for convenience' sake.

Moreover, portions (margins at the top, bottom, left and right and a background portion) other than the character string image described above (the character string image subjected to the image development based on the text data of the registered file) will be hereinafter assumed, for convenience' sake, to be literally margins (blank images). However, an image having a different ground pattern from that of the character string image described above or other images can be arranged in the margins (character images or character string images may be arranged as long as those images are different from the character string image described above). Moreover, accordingly, those images described above may be registered, in the form of element image data or the like by using a dot map, as print image creation data similar to text data in file registration to be described later or as information included in accompanying information.

Here, as shown in FIG. 9, assuming that "automatic print width" is subjected to the selection operation from the selection screen described above (D31: common in FIGS. 8 and 9), next, a screen of input or editing of text data of the file "03" (character string input in the width direction) is displayed (D40).

In this input screen (D40), so as to encourage input of character strings of "3 lines" that is the number of lines of possible character strings corresponding to the entire label width 5.4 cm, a head of the first line is designated by the cursor immediately after the screen transition. Thus, in a manner similar to normal text editing (see FIG. 6A and the like), for example, the first line "Chiyoda Elementary School", the second line "Class 2 in $2^{nd}$ grade" and the third line "Taro Suzuki" are inputted and edited (D41). Thereafter, determination is made by using shift key+selection key. Next, as a screen in a still lower hierarchy, a setting screen of a character size is displayed (D42).

It is to be noted that in some of the figures, following abbreviations are employed in case the available space is too limited to allow for fully spelling them out. Abbreviations employed are such as "CYD" for CHIYODA, "ELM" for ELEMENTARY, "SCH" for SCHOOL, "L" for LEFT, "R" for RIGHT, "CUR" for "URSOR, "SFT" for SHIFT, "SEL" for SELECT, "DET" for "DETERMINATION" and the like.

In this setting screen (D42), "3 lines" which is the number of inputted lines described above is clearly indicated. At the same time, it is made possible to designate or specify a relative and abstract character size (abstract size) for the label width. Immediately after the screen transition, an abstract size "medium" of default in the first line is designated by the cursor.

The respective lines in the setting screen described above have options of "extra large", "large", "medium", "small", "minimum" and the like. The character size is relatively defined, for example, in such a manner that the size is increased while being multiplied by "2 raised to the power of 0.5" (so-called $\sqrt{2}$), i.e., "minimum" multiplied by $\sqrt{2}$ is "small", "small" multiplied by $\sqrt{2}$ is "medium", "medium" multiplied by $\sqrt{2}$ is "large" and "large" multiplied by $\sqrt{2}$ is "extra large." Moreover, in this case, three lines of "large", "medium" and "extra large" and three lines of "small", "minimum" and "medium" have the same relationship of the relative character size between the respective lines. Meanwhile, an actual character size and a margin (margin size) based on an absolute size such as a dot number unit are determined and set so as to conform to an image of the user who designates the character size and the margin (image such as "large" or "small": nuances of words in the respective abstract sizes). The actual character size and the margin are determined, for example, in the following manner. Namely, the margin is reduced and the character size is increased as a whole in the three lines of "large", "medium" and "extra large." On the other hand, the margin is increased and the character size is reduced as a whole in the three lines of "small", "minimum" and "medium."

Here, for example, respective lines are selected to be three lines of "medium", "small" and "large" (an image in between the two examples described above). Thereafter, once determination is made by using shift key+selection key, the file creation of the file "03" is finished and the display returns to the function selection screen of "free width printing" (D43: the same as D20 of FIG. 7). In this case, at the point of returning to the function selection screen, the file "03" is registered. In registering the file "03", in addition to the text data of the first to third lines described above, various information accompanying the text data, for example, the character size (abstract size), the entire label width LW, the entire print width PW (the entire label width LW=the entire print width PW=54 mm in the example described above) and the like are registered as accompanying information.

Figure 10A:
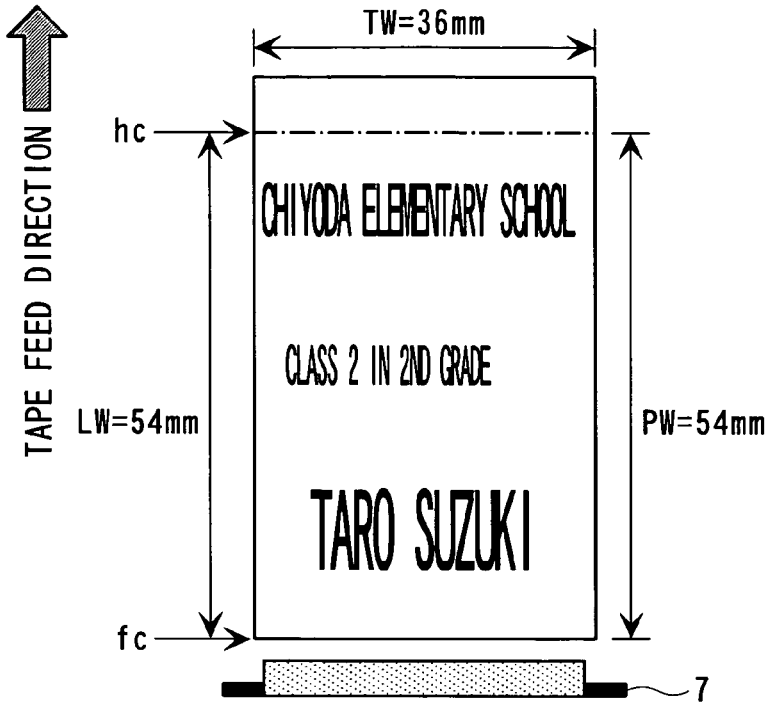
FIG. 10A is a view showing a print result obtained by "file printing" in case where "file creation" is performed by the method of FIG. 9
Figure 10B:
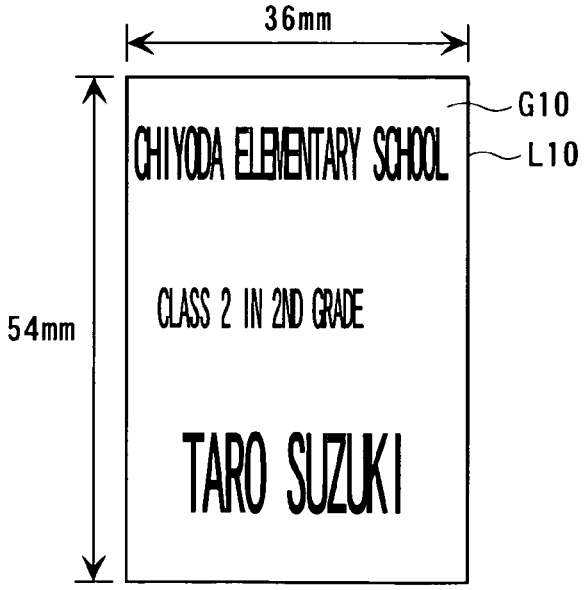
FIG. 10B is an explanatory view showing one example of a label production result based on the print result.

Accordingly, when printing of the file "03" is performed later on the tape T having a tape width TW=36 mm by "file printing" to be described later, as shown in FIG. 10A, a print image G10 with a print width PW=54 mm is printed by the print head 7. Thereafter, a half cut hc is performed at a front end of a label width LW=54 mm and a full cut fc is performed at a rear end thereof. Thus, a label L10 having a (horizontal) length of 36 mm×a (vertical) width of 54 mm is directly produced (see FIG. 10B).

As described above, the tape printing apparatus 1 can selectively perform the longitudinal direction printing and the width direction printing. In the width direction printing, the size in the longitudinal direction of the tape which forms the label is set as the label width LW, character strings for the width direction printing are inputted, a width of the character strings and a width of margins within the label width LW are set as an arrangement width, and the print image G10 and the like are created according to the arrangement width. Thus, the print image G10 and the like can be created more easily and quickly than a conventional case in which functions for the longitudinal direction printing are utilized and then the print image is diverted (rotated by 90 degrees or the like) to create the print image. Moreover, the print image can be edited directly (without being returned once for the longitudinal direction printing) and can be printed as it is (i.e., in a style as it is edited). In addition, the label L10 and the like can be produced by cutting the tape in accordance with the set label width LW. Consequently, it is possible to easily and quickly perform creation, editing and printing of a print image, which is suitable for the width direction printing, as well as label production.

Moreover, the text data for creating the print image can be registered as files and the set label width and print width can be registered as the accompanying information of the files. Thus, for example, even immediately after other operations are performed such as creation of files having label widths and print width which are designated differently, it is possible to easily and quickly create and print a desired print image and also to produce a label having desired label width and print width, just by reading the registered files without requiring resetting of the label width and the print width or the like.

Moreover, as in the example of the three lines described above, when the print image G10 or the like has multiple lines of character string images, a width for each line and a width for each margin (including a space between lines) can be easily and quickly set as the arrangement width. Further, the width for each line can be designated by using the abstract size, which is relative and abstract, such as "large" and "medium." Thus, the user can easily designate the width according to an image and the like which he/she imagines without fine designations such as the number of dots and the actual size. In addition, the designation of the width may be performed simply by selecting from the menu. Thus, the arrangement width can be set more easily and quickly.

Instead of the selection from the menu described above, the arrangement width (the width of each line and the width of the margin) may be inputted by using numeric values. In this case, a desired (arbitrary) set width can be accurately set by the numeric input and fine adjustment thereof can be performed. Especially, in the case of designating a divided label to be described later or the like, it is advantageous that the set width can be adjusted in accordance with a width of each divided label. Moreover, on the contrary, in the example described above, the entire label width is inputted by using numeric values. However, the entire label width may be similarly selected from the menu. In this case, the label width can be easily and quickly set just by selection from a menu of standard sizes including a size for a CD case, a size for an MD case, a size for a surface of each case, a size for a side of each case and the like.

Figure 11:
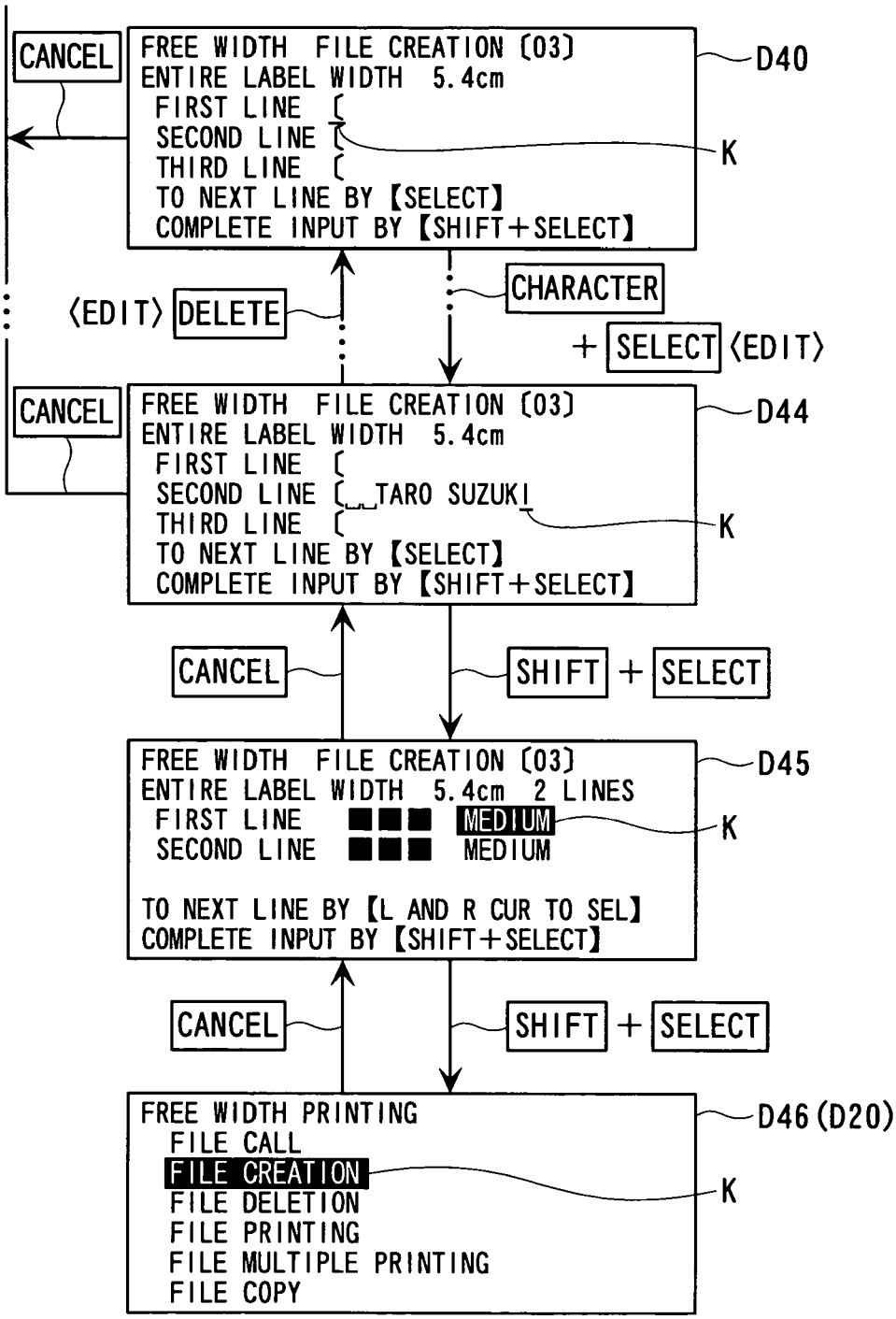
FIG. 11 is an explanatory view similar to FIG. 7, showing another example with different input contents of text data.

Moreover, in the example described above, the respective lines are assumed to be lines which include characters (images). However, blank lines which include no character (string) can be also set as the lines. For example, from the state of the input screen described above in FIG. 9 (D40: common in FIGS. 9 and 11), as shown in FIG. 11, no character is inputted in the first line and "Taro Suzuki" is inputted and edited in the second line (D44). Thereafter, determination is made by using shift key+selection key. Accordingly, up to the second line that is the last line in which characters exist is set to be valid and the first line is set to be the blank line (line with only space). Thus, in a setting screen of the character size (D45) in a lower hierarchy, the number of lines "2 lines" is clearly indicated and the abstract size for each of the first and second lines can be designated. For example, after the abstract sizes "medium" and "small" are selected for the respective lines, determination is made by using shift key+selection key. Accordingly, the file creation of the file "03" is finished and the display returns to the function selection screen of "free width printing" (D46: the same as D20 of FIG. 7).

In this case, the input characters also include a space. Thus, for example, if a space " " which is equivalent to one character or more is inputted in the third line and determination is made by using shift key+selection key, up to the third line that is the last line in which characters (including " ") exist is set to be valid. In this event, the first and third lines are set to be the blank lines with only the space. In addition, in the setting screen of the character size, the number of lines "3 lines" is clearly indicated and the abstract size can be designated for each of the first to third lines.

By the way, since the example described above is "automatic print width", "entire label width=entire print width" is established. However, in the tape printing apparatus 1, a size in a feed direction (longitudinal direction) of the tape T for printing the print image can be set as the entire print width PW which corresponds to the entire label width LW. Thus, various combinations of the entire label width LW and the entire print width PW in performing label production by the width direction printing can be freely (arbitrarily) adjusted and set. As a second embodiment, first, a description will be given below by taking, as an example, a case of "entire print width designation" for designating the entire print width PW regardless of designation of the entire label width LW.

Figure 12:
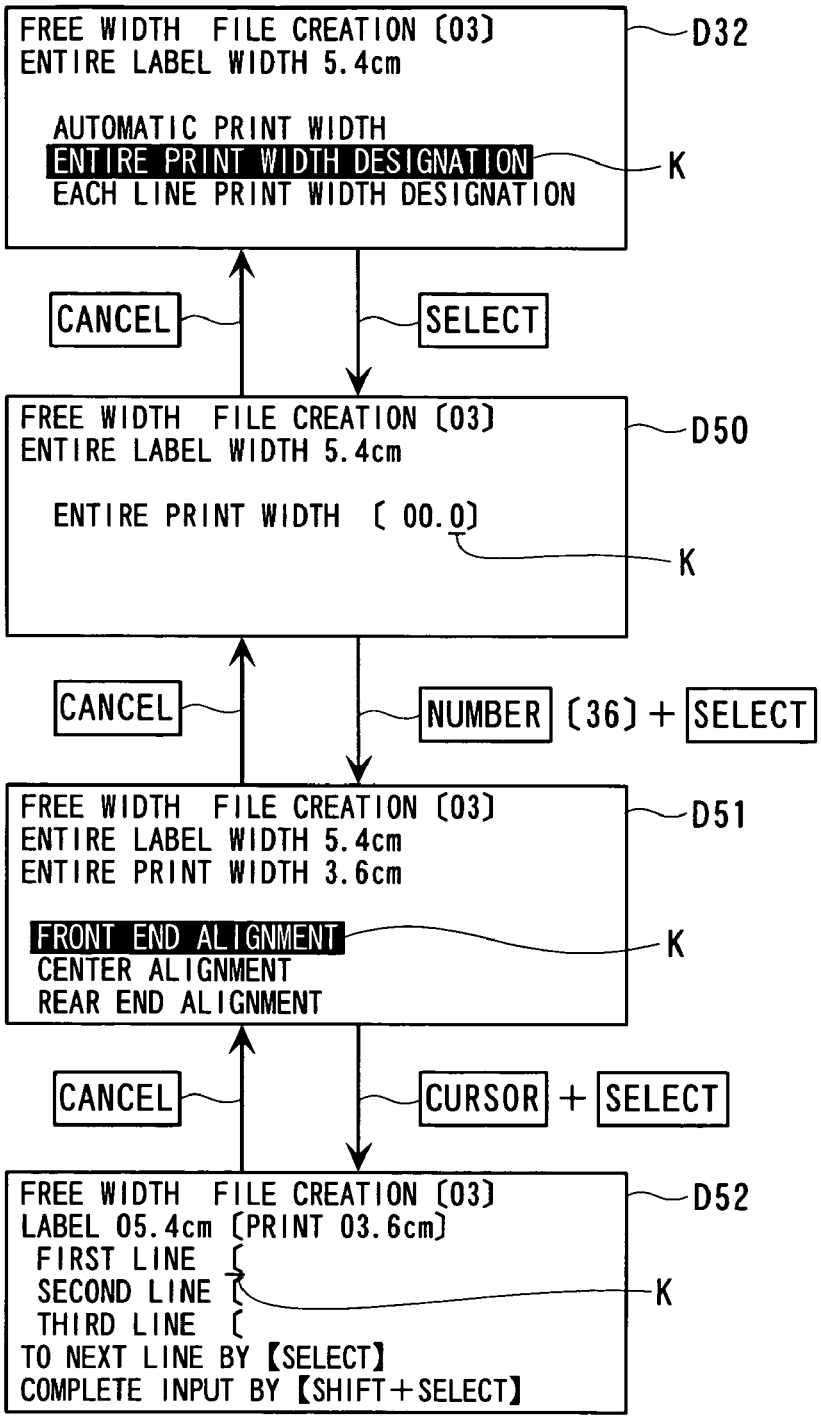
FIG. 12 is an explanatory view similar to FIG. 7, showing, as a second embodiment, one example in case where "file creation" is performed by "entire print width designation" of "entire label width designation" subsequently to FIG. 8.

In the tape printing apparatus 1 of this embodiment, in the selection screens (D31 to D33) after the entire label width designation described above in FIG. 8, it is assumed that "entire print width designation" is subjected to the selection operation as shown in FIG. 12 (D32: common in FIGS. 8 and 12). Next, as a screen in a lower hierarchy, an input screen which encourages input of "entire print width" is displayed (D50). Here, immediately after the screen transition, the entire print width "00.0 cm" is displayed as default. Thus, the user can designate the entire print width=3.6 cm (36 mm) by making determination with the selection key after inputting, for example, "36" (36 mm) by operating the numeric key.

When the entire print width is designated, next, a selection screen in a still lower hierarchy is displayed (D51). When the designated entire label width and entire print width have different sizes from each other (in this example, the entire label width LW=54 mm and the entire print width PW=36 mm), this selection screen (D51) is a menu screen (reference position selection screen) for selecting where to set respective reference positions of a portion to serve as a label (a portion to be cut as a label) and a print image to be printed on the tape, in other words, respective reference positions of the entire label width LW and the entire print width PW. Here, options thereof include "front end alignment", "center alignment", "rear end alignment" and the like. The option "front end alignment" is for setting respective front ends (in the tape longitudinal direction) of the entire label width and the entire print width as the reference positions. The option "center alignment" is for setting respective centers thereof as the reference positions. The option "rear end alignment" is for setting respective rear ends thereof as the reference positions.

Among the options described above, in terms of specifications, immediately after the screen transition, the previously selected option is displayed. Here, assuming that "front end alignment" of default is subjected to the selection operation, next, as a screen in a still lower hierarchy, an input screen of text data is displayed (D52).

This input screen (D52) is a screen similar to the input screen (D40) described above in FIG. 9 except that the input screen D52 displays not only the label width 5.4 cm but also the print width 3.6 cm in its upper side (title part). In the input screen D52, so as to encourage input of character strings of "3 lines" that is the number of possible lines, immediately after the screen transition, a head of the first line is designated by the cursor. Thus, thereafter (similar to D40 to D42 in FIG.9), the first line "Chiyoda Elementary School", the second line "Class 2 in $2^{nd}$ grade" and the third line "Taro Suzuki" are inputted and edited. Subsequently, after designating the abstract size for each line in a setting screen in a still lower hierarchy, the file creation of the file "03" is finished and the display returns to the function selection screen of "free width printing" (see D43 in FIG. 9 and D20 in FIG. 7).

Figure 13A:
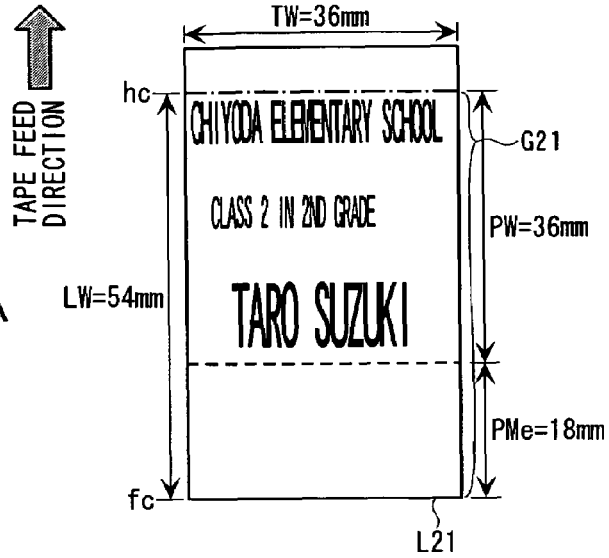
FIGS. 13A to 13C are explanatory views similar to FIGS. 10A and 10B, showing one example in the case of performing "file creation" by the method of FIG. 12.

In this case, accompanying information in file registration includes the reference position ("front end" in the example described above) which is selected in the reference position selection screen described above (D51 in FIG. 12). Thus, when printing of the file "03" is instructed by "file printing" to be described later, as shown in FIG. 13A, a print image G21 is created in the following manner. Specifically, since "front end alignment" is selected, the print image G21 is created so as to align the front end (reference position) of the entire print width PW=36 mm with the front end (reference position: position of the half cut hc) of the entire label width LW=54 mm and to have the rear end side margin PMe=18 mm. Thereafter, the print image G21 is printed on, for example, the tape T having the tape width TW=36 mm. Subsequently, the tape T is subjected to the half cut hc and the full cut fc at its rear end to directly produce a label L21 having a (horizontal) length of 36 mm×a (vertical) width of 54 mm.

Figure 13B:
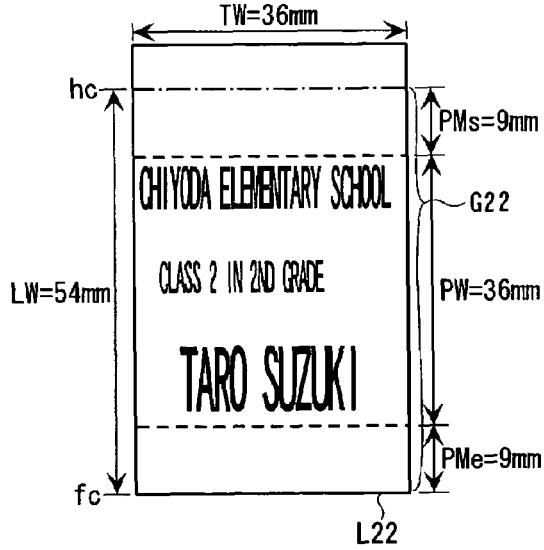

Moreover, in the reference position selection screen described above (D51 in FIG. 12), when "center alignment" is subjected to the selection operation and, thereafter, the file creation is similarly finished and printing of the file "03" is instructed by "file printing", as shown in FIG. 13B, a print image G22 is created in the following manner. Specifically, the print image G22 is created so as to align the center (reference position: intermediate position between the front end and the rear end) of the entire print width PW=36 mm with the center (reference position) of the entire label width LW=54 mm and to have the front end side margin PMs=9 mm and the rear end side margin PMe=9 mm. Thereafter, similarly, the print image G22 is printed on the tape and the tape is cut to produce a label L22 having a (horizontal) length of 36 mm×a (vertical) width of 54 mm.

Figure 13C:
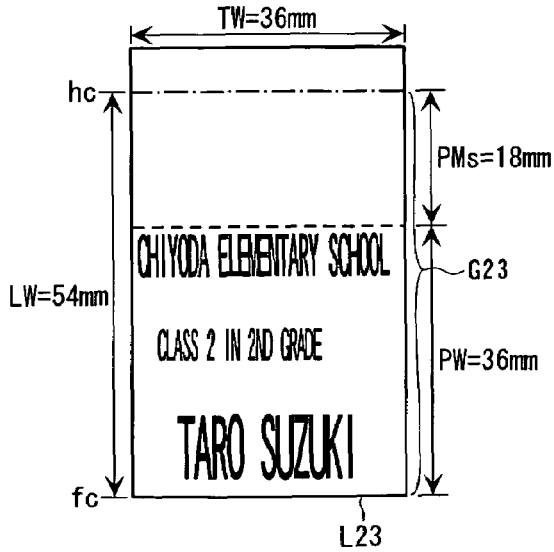

Moreover, similarly, when "rear end alignment" is subjected to the selection operation (in D51 of FIG. 12), the file creation is finished and printing is instructed, as shown in FIG. 13C, and a print image G23 is created in the following manner. Specifically, the print image G23 is created so as to align the rear end (reference position) of the entire print width PW=36 mm with the rear end (reference position: position of the full cut fc) of the entire label width LW=54 mm and to have the front end side margin PMs=18 mm. Thereafter, similarly, the print image G23 is printed on the tape and the tape is cut to produce a label L23 having a (horizontal) length of 36 mm×a (vertical) width of 54 mm.

Figure 14A:
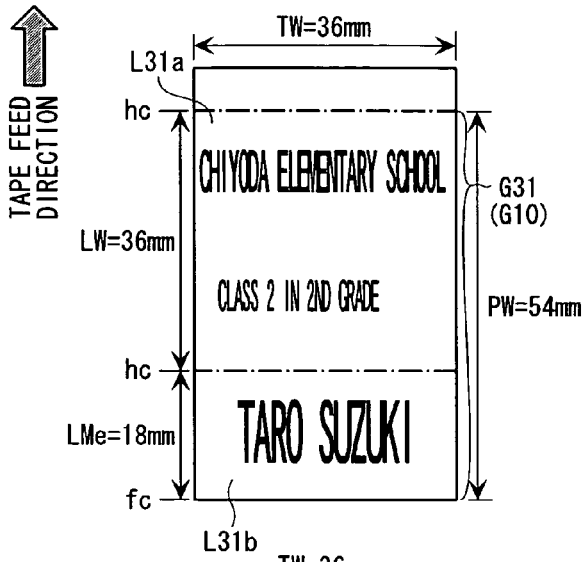
FIGS. 14A to 14C are explanatory views similar to FIGS. 13A to 13C, showing another example.

In the tape printing apparatus 1, the entire print width PW having a larger value than that of the designated entire label width LW can be designated. For example, in case "36" (36 mm) is designated in the above-described input screen (D30) of the entire label width in FIG. 8 and "54" (54 mm) is designated in the above-described input screen (D50) of the entire print width in FIG. 12, the relationship of LW<PW contrary to that of the example described above is established. When the entire label width LW=36 mm and the entire print width PW=54 mm, the reference position is similarly selected thereafter in the reference position selection screen (D51 in FIG. 12), and the file creation is finished. When printing is instructed, as shown in FIG. 14A, a print image G31 having the entire print width PW=54 mm (the same as the print image G10 described above in FIG. 10B: also the same as the print images G32 and G33 in FIGS. 14B and 14C) is created regardless of the reference position. Thereafter, the print image is printed so as to coincide with a front end thereof with the position of the half cut hc.

However, when "front end alignment" is subjected to selection operation in the reference position selection screen described above (D51 in FIG. 12), as shown in FIG. 14A, since "front end alignment" is selected, a label L31*a* having the entire label width LW=36 mm is produced by performing the half cut hc so as to align the front end of the entire label width LW=36 mm with the front end of the print image G31. At the same time, a label L31*b* having a rear end additional (rear surplus) label width LMe=18 mm is produced by performing the half cut hc and the full cut fc so as to allow a total label width to coincide with the entire print width PW=54 mm and to continue from a rear end of the label L31*a*.

Figure 14B:
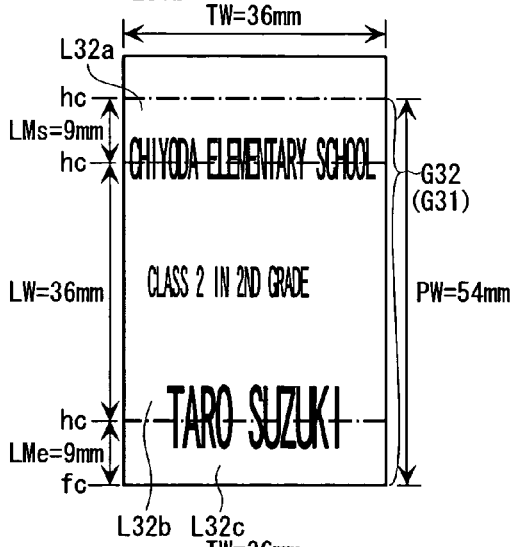

When "center alignment" is subjected to the selection operation (in D51 of FIG. 12), as shown in FIG. 14B, a label L32*a* having a front end additional (front surplus) label width LMs=9 mm is first produced by performing the half cut hc so as to align the center of the entire label width LW=36 mm with the center (intermediate position between the front end and the rear end) of the entire print width PW=54 mm. Thereafter, a label L32*b* having the entire label width LW=36 mm is produced by performing the half cut hc so as to continue from a rear end of the label L32*a*. Subsequently, a label L32*c* having the rear surplus label width LMe=9 mm is produced by performing the full cut fc so as to continue from a rear end of the label L32*b*.

Figure 14C:
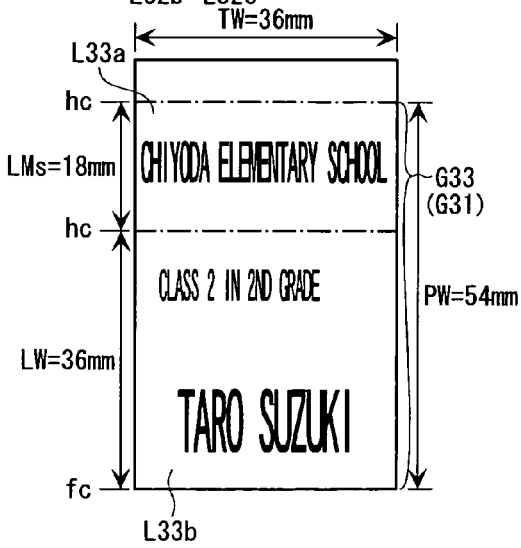

Similarly, when "rear end alignment" is subjected to the selection operation (in D51 of FIG. 12), as shown in FIG. 14C, a label L33*a* having a front end additional (front surplus) label width LMs=18 mm is first produced by performing the half cut hc so as to align the rear end of the entire label width LW=36 mm with the rear end of the entire print width PW=54 mm. Thereafter, a label L33*b* having the entire label width LW=36 mm is produced by performing the full cut fc so as to continue from a rear end of the label L33*a*.

As described above, in the tape printing apparatus 1, the size in the longitudinal direction of the tape to serve as a label can be set as the entire label width LW. In addition, when "automatic print width" is selected, the entire print width PW can be automatically set to be the same size as the entire label width LW. Thus, the entire print width can be easily determined by utilizing the automatic setting described above and the creation of the print image and the label production can be more easily and quickly performed. At the same time, when "entire print width designation" is selected, the print width PW corresponding to the entire label width LW can be arbitrarily set. Thus, it is possible to freely adjust and set various combinations of the entire label width LW and the entire print width PW in performing the label production by the width direction printing. Moreover, in this case, the size above the entire label width LW can be set as the entire print width PW (see FIGS. 14A to 14C). Thus, it is possible to set the print width more freely and to set more flexible combinations of the label width and the print width.

Moreover, when the sizes of the print width and the label width are different from each other, each of the one ends (the front end or the rear end) of the print width and the label width or the center (the intermediate position between the front end and the rear end) can be selected as the reference position. Thus, only by making a selection, the reference positions can be easily and accurately set. Further, printing is performed so as to allow the set reference positions of the print width and the label width to coincide with each other. Thus, printing with desired arrangement can be accurately performed. It is preferable that the reference position of the print width and the reference position of the label width be set on the same basis (for example, both have their reference positions at their front ends or the like) as in the example described above. However, the reference positions may be provided on another basis such as that, for example, one thereof has the reference position at its front end and the other thereof has the reference position at its rear end.

Figure 15A:
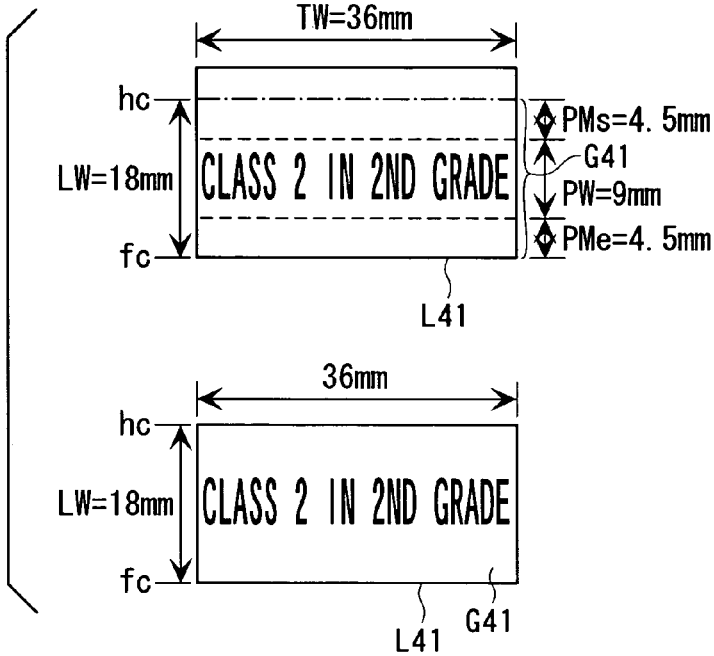
FIGS. 15A and 15B are explanatory views similar to FIGS. 13A to 13C, showing still another example.
Figure 15B:
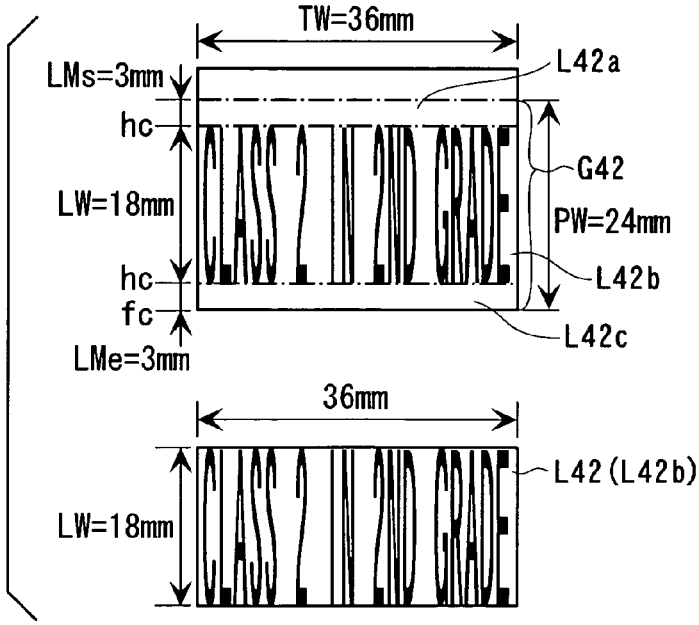

Moreover, in the example described above, the case of including three lines of character strings in the print image is taken as an example. For example, when a file including one line of a character string "Class 2 in $2^{nd}$ grade" is subjected to file printing, as shown in FIG. 15A, not only the arrangement width (character size) of the character string is reduced but also the entire print width PW which is smaller than the entire label width LW=18 mm (in the example of FIG. 15A, PW=9 mm and "center alignment") is designated. Accordingly, a print image G41 of the character string is created and printed. Thus, it is possible to produce a label L41 having a (horizontal) length of 36 mm×a (vertical) width of 18 mm in which a larger margin is arranged around a small character string "Class 2 in $2^{nd}$ grade." Moreover, as shown in FIG. 15B, the arrangement width is increased and the entire print width PW (=24 mm and "center alignment") which is larger than the entire label width LW=18 mm is designated. Accordingly, a print image G42 of the character string is created and printed. Thus, it is possible to produce a label L42 (which is equivalent to a label L42*b* in the middle of produced labels L42*a* to L42*c*) which has the same size (36 mm×18 mm) as that of the label L41. Specifically, the label L42 looks as if a kind of decoration were given thereto by deliberately omitting (removing) a part of upper and lower parts of the character string "Class 2 in $2^{nd}$ grade" or the like.

In the tape printing apparatus 1, in order to make it possible to perform more free and various combinations of the label width LW and the print width PW besides "automatic print width" described above ("entire label width=entire print width") and "entire print width designation" for designating the print width PW of the entire print image, when the print image includes multiple lines of character strings, "each line print width designation" can be selected. Specifically, "each line print width designation" can individually designate widths for arranging the respective lines (arrangement width of each line: print width for each line: each line print width) for each of the lines. Thus, as a third embodiment, a description will be given by taking "each line (each-line or line-by-line) print width designation" as an example.

Figure 16:
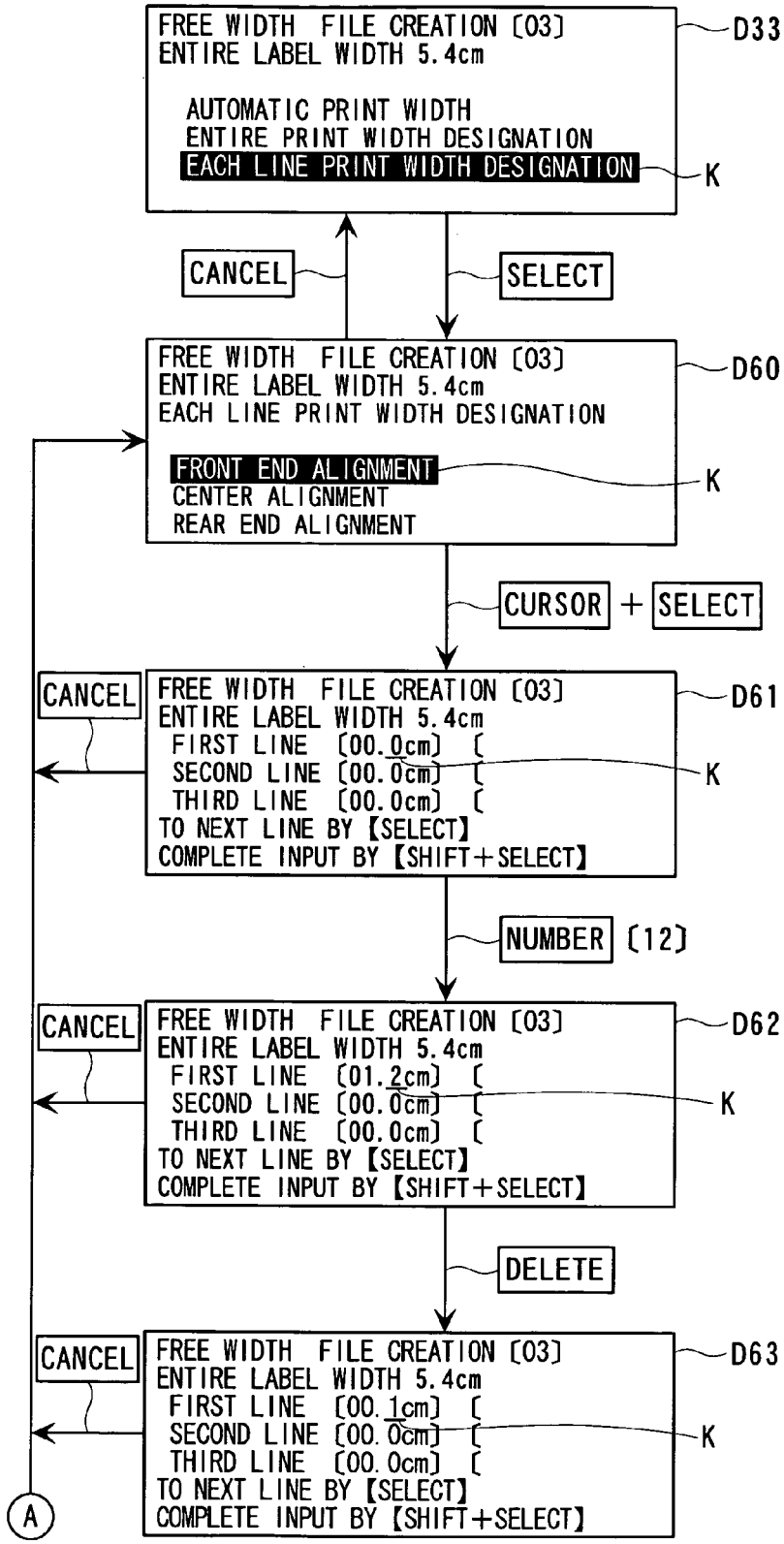
FIG. 16 is an explanatory view similar to FIG. 7, showing, as a third embodiment, one example in case where "file creation" is performed by "each line print width designation" of "entire label width designation" subsequently to FIG. 8.

In the tape printing apparatus 1 of this embodiment, as shown in FIG. 16, it is assumed that "each line print width designation" is subjected to the selection operation (D33: common in FIGS. 8 and 16) in the selection screens (D31 to D33) after the entire label width designation described above in FIG. 8. Next, a reference position selection screen similar to the screen (D51) described in FIG. 12 is displayed (D60) as a screen in a still lower hierarchy. Here, it is assumed that any one of the options "front end alignment", "center alignment" and "rear end alignment" for the reference positions described above is subjected to the selection operation. Next, a screen for inputting and editing a print width of each line (each line print width) and text data is displayed (D61).

Figure 17:
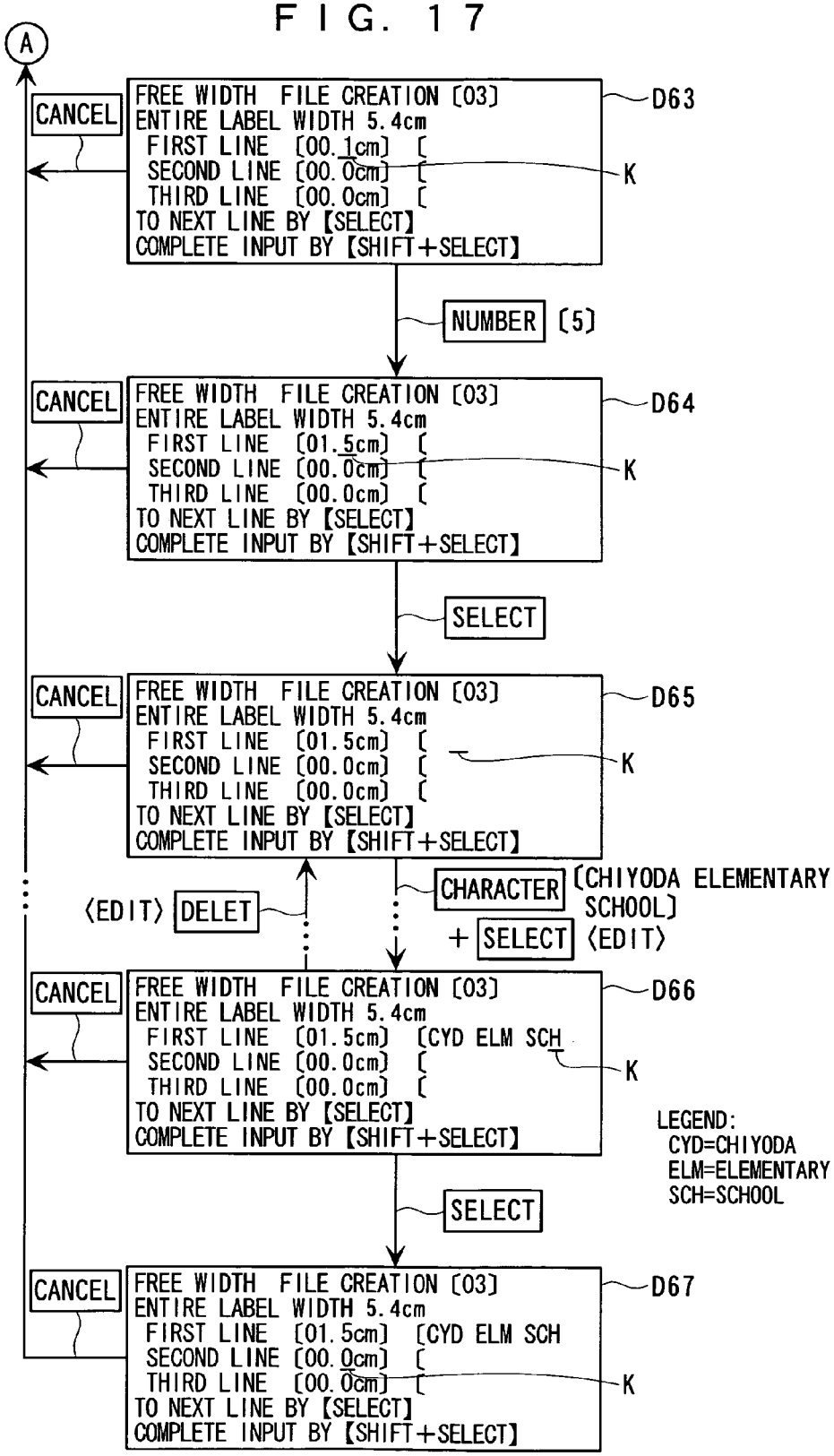
FIG. 17 is an explanatory view similar to FIG. 16, following FIG. 16.

In this input screen (D61), an each line print width for arranging character strings of "3 lines", that is the number of lines of possible character strings corresponding to the entire label width 5.4 cm, and corresponding text data are inputted and edited. Immediately after the screen transition, first, so as to encourage input of each line print width of the first line, an input position thereof is designated by the cursor (D61). Thus, by inputting the number "12" (12 mm), for example, by operating the numeric keys, the user can designate the each line print width (i.e., each-line print width)=1.2 cm (12 mm) for the first line (D62). Moreover, when the user notices an input error or the like and wishes to edit (correct) the error, for example, when the user wishes to change the each line print width of the first line from 1.2 cm (12 mm) to 1.5 cm (15 mm), the user deletes the last inputted "2" by pressing a deletion key (D63: common in FIGS. 16 and 17). Thereafter, as shown in FIG. 17, by inputting the number "5", the user can change the specification of the each line print width of the first line to 1.5 cm (15 mm) (D64).

After inputting the each line print width of the first line (D64), determination is made by pressing the selection key. Next, so as to encourage input of text data of the first line, an input position thereof is designated by the cursor (D65). Accordingly, in a manner similar to the input and editing from the input screen (D40) described above in FIG. 9, the first line "Chiyoda Elementary School" is inputted and edited. When determination thereof is made, so as to encourage input of each line print width of the second line, an input position thereof is designated by the cursor (D67: common in FIGS. 17 and 18).

Figure 18:
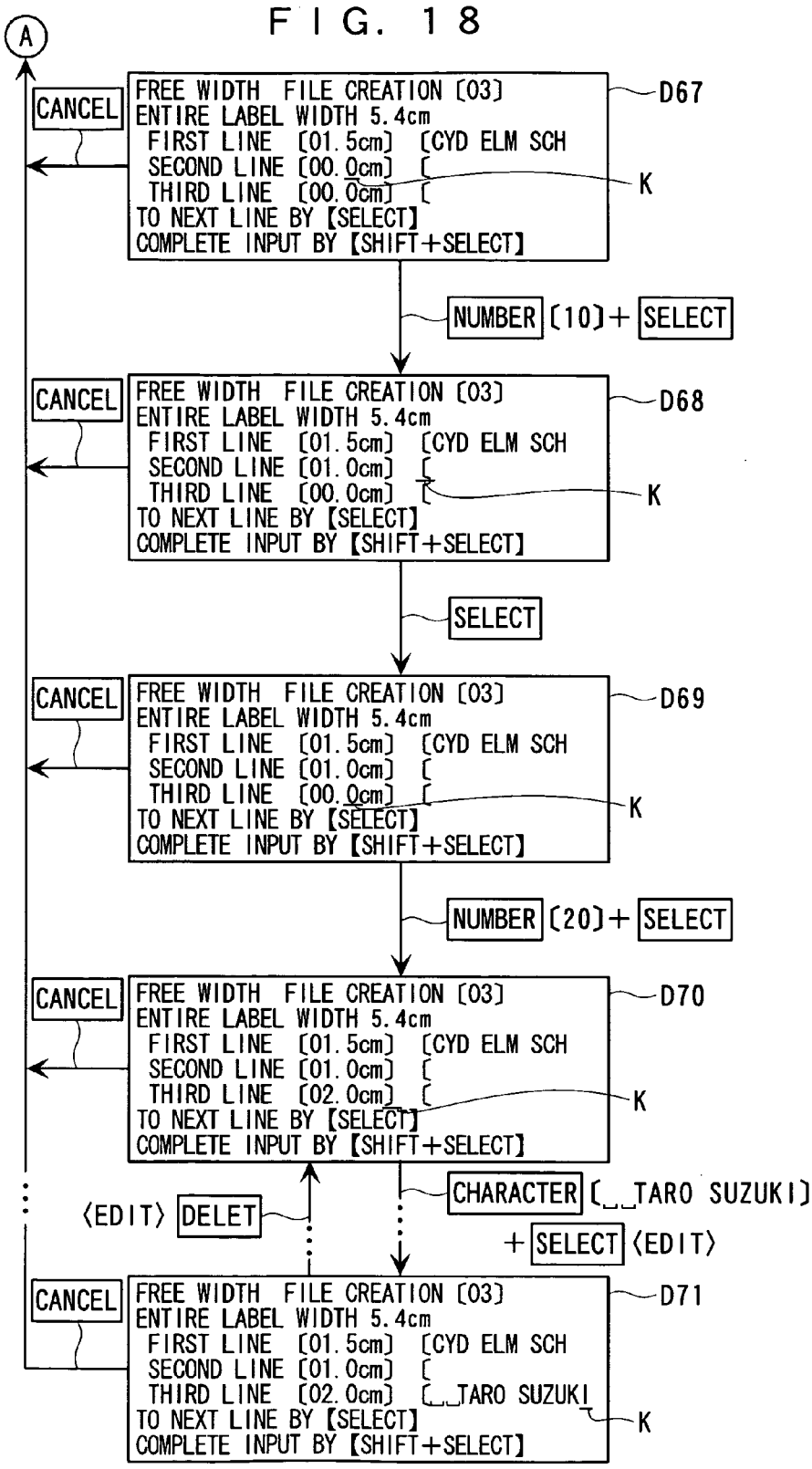
FIG. 18 is an explanatory view similar to FIG. 16, following FIG. 17.

Subsequently, as shown in FIG. 18, similar to the first line, the each line print width of the second line is inputted as, for example, the number "10" (10 mm) and determination thereof is made. Next, similarly, an input position of text data of the second line is designated by the cursor (D68). Here, for example, when determination is made without inputting anything, next, an input position of each line print width of the third line is designated by the cursor (D69). Here, similarly, the number "20" (20 mm), for example, is inputted and determination thereof is made. Next, similarly, an input position of text data of the third line is designated by the cursor (D68).

Here, for example, when "Taro Suzuki" is inputted and edited in the third line, the each line print widths of the first to third lines are determined. Accordingly, the display is in a state in which the first line "Chiyoda Elementary School" is inputted, the second line is set as a blank line and the third line "Taro Suzuki" is inputted (D71: common in FIGS. 18 and 19).

Figure 19:
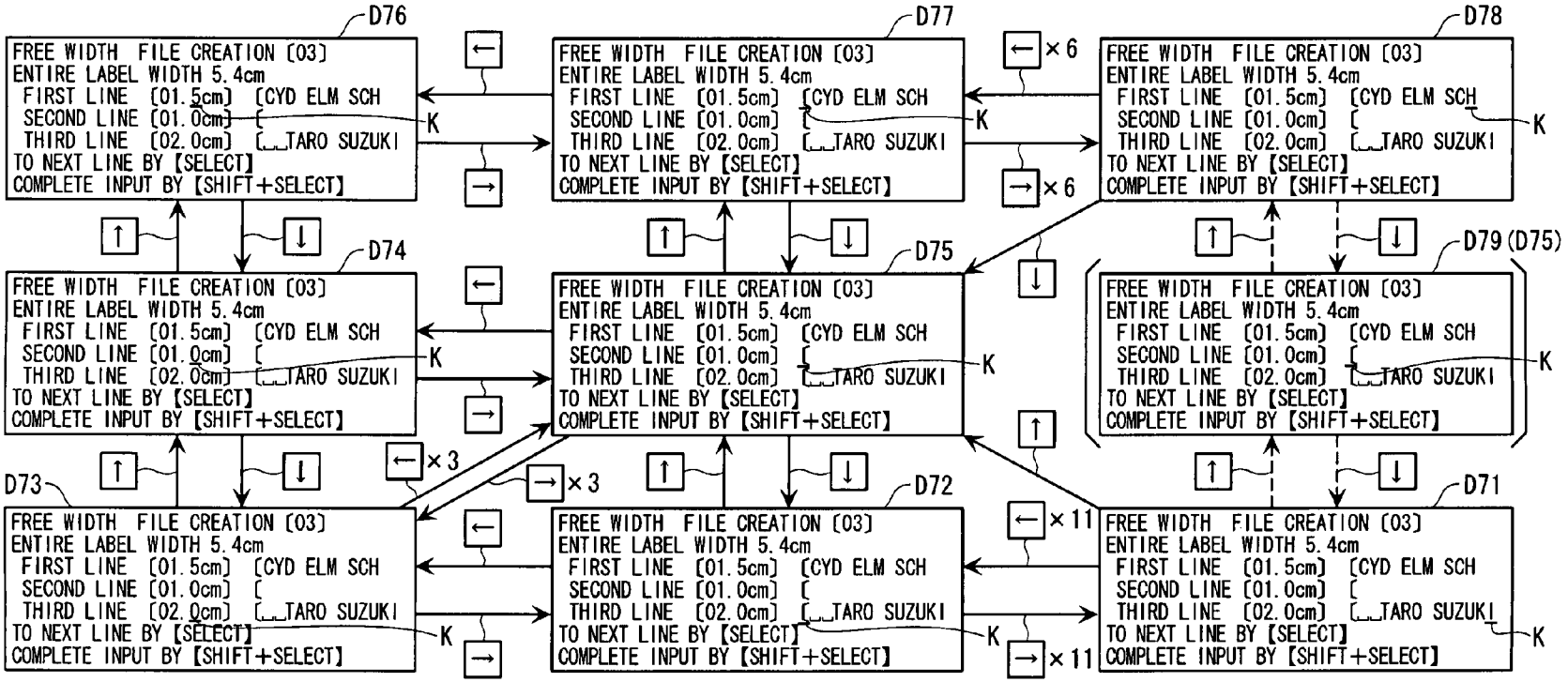
FIG. 19 is an explanatory view similar to FIG. 16, which follows FIG. 18 and mainly shows one example of a cursor operation.

In the state of displaying the screen for inputting and editing the each line print width and the text data, within a range of the lines having the each line print width already set and a range having character strings already inputted, for example, as shown in FIG. 19, the user can freely move the position designated by the cursor by the cursor operation.

From the state described above (D71), image transition (shift) can be performed in the following manner. Specifically, for example, 11 times of pressing of the left cursor moves the position designated by the cursor to the text head of the third line (D72), another pressing moves the position to the least significant digit of the each line print width of the third line (D73), twice more pressing moves the position to the most significant digit thereof and still another pressing moves the position to the end of the second line (D75). From the respective screens (D73, D72 and D71) of the third line, at each time of pressing of the up cursor, the screen can be shifted to the respective screens of the second line (D74, D75 and D75) and to the respective screens of the first line (D76, D77 and D77). By using the right cursor in a direction from the left side of the screen to the right side thereof and using the down cursor in a direction from the first line to the third line, cursor movement can be performed in a manner similar to the left and up cursors described above. In up and down movement from the ends of the texts (for example, D71 and D78), the screen transition may be performed between the ends as shown in FIG. 19 by using dotted line arrows (D71→D79→D78 and D78→D79→D71).

Figure 20:
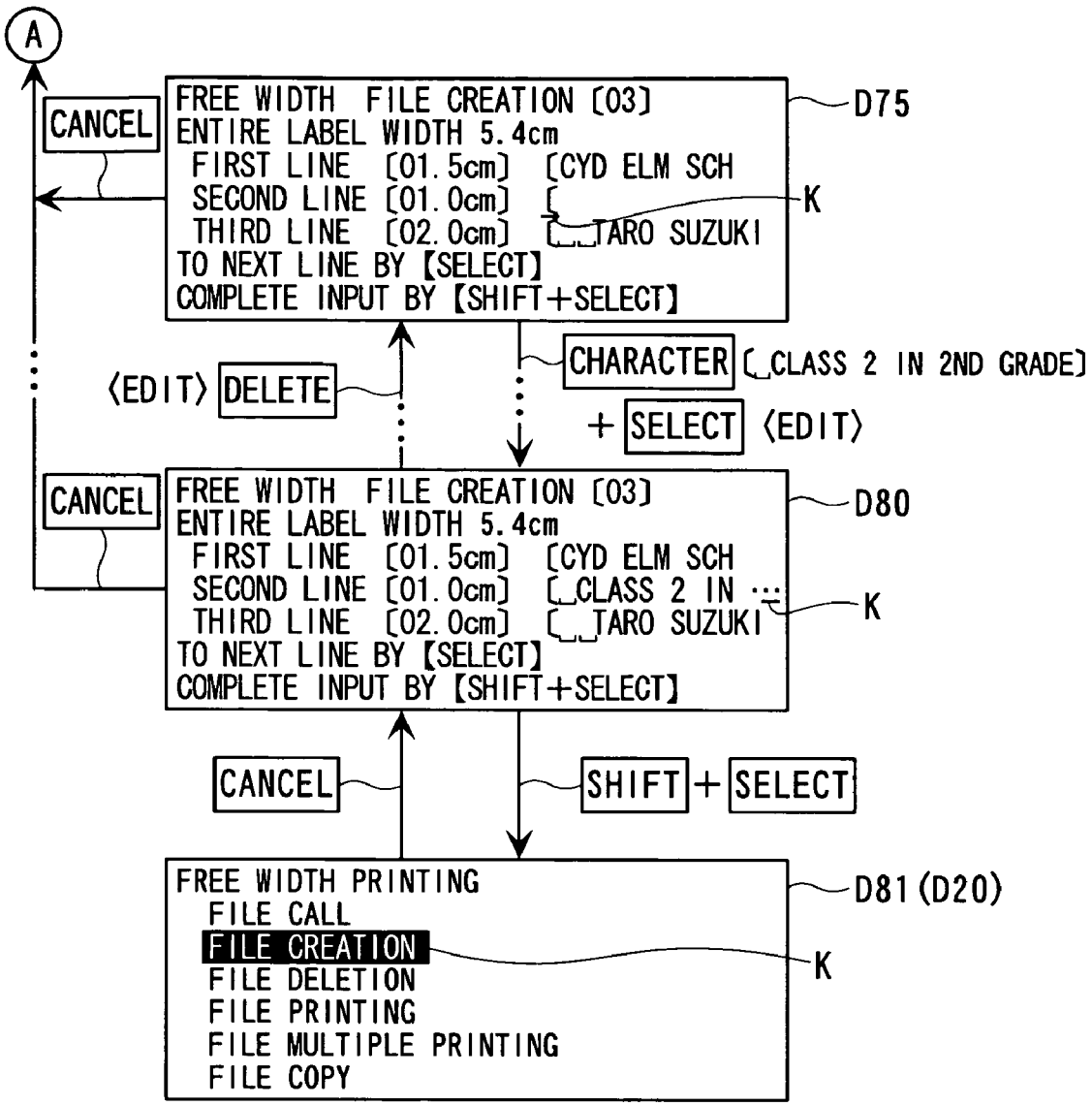
FIG. 20 is an explanatory view similar to FIG. 16, following FIG. 19.

Moreover, after freely moving the position designated by the cursor as described above, the user can perform editing (addition, deletion and change) for the position designated by the cursor. For example, as shown in FIG. 20, from the state in which the text head of the second line is designated by the cursor (D75: common in FIGS. 19 and 20), when the second line "Class 2 in $2^{nd}$ grade" is inputted and edited, for example, the each line print widths of the first to third lines are determined. Accordingly, the display is in a state in which the first line "Chiyoda Elementary School", the second line "Class 2 in $2^{nd}$ grade" and the third line "Taro Suzuki" are inputted, i.e., a state in which the same contents as those of the text described above in FIG. 9 and the like are inputted as to the text (D80: common in FIGS. 20 and 21). However, after finishing the input and editing, when determination is made by using shift key+selection key, the file creation of the file "03" is finished immediately unlike the example of FIG. 9 (because there is no need to designate the abstract size of each line). Thereafter, the display returns to the function selection screen of "free width printing" (D81: the same as D20 of FIG. 7).

Figure 21:
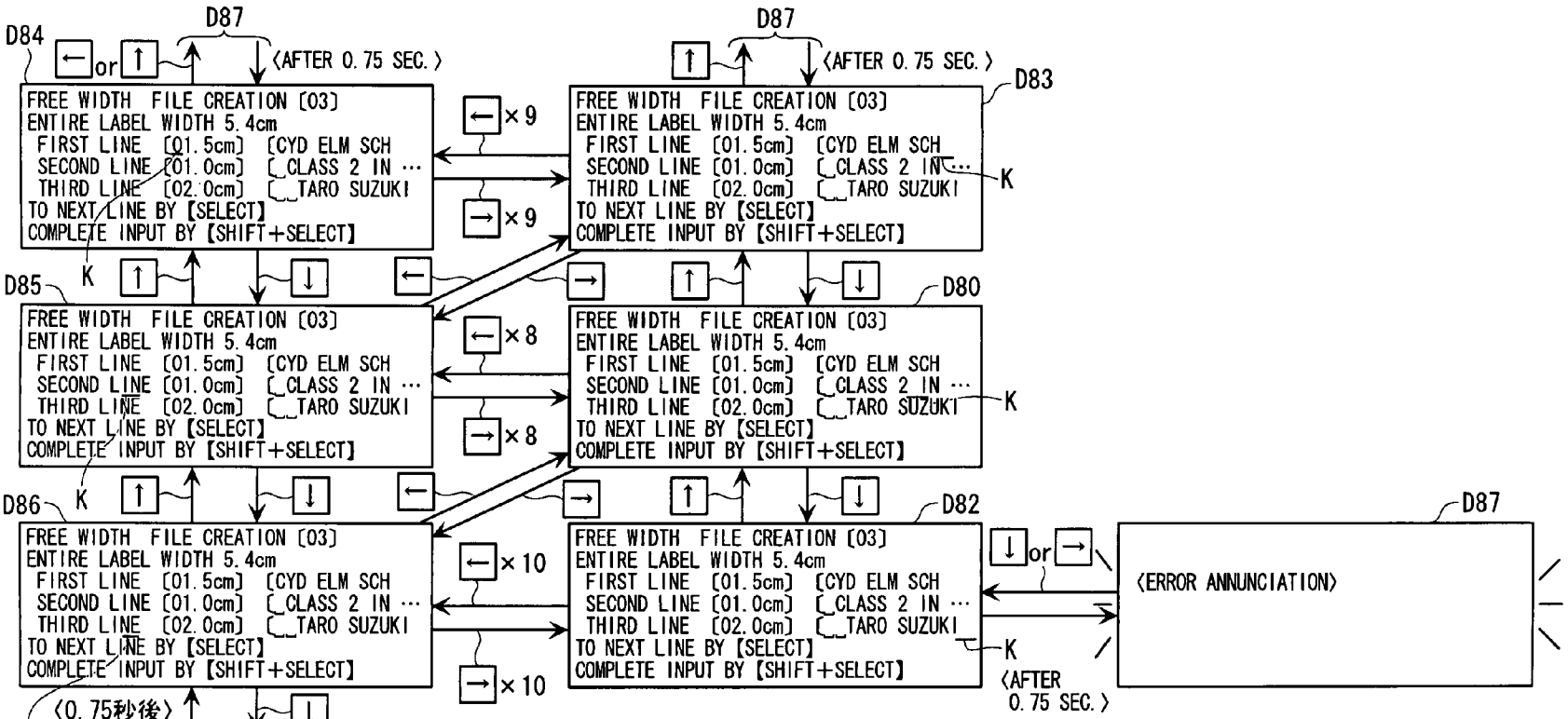

In the state of displaying the screen for inputting and editing described above (D80), the cursor movement by the cursor operation is possible in a manner similar to that described in FIG. 19. In addition, as shown in FIG. 21, it is possible to perform, for example, movement between the other lines (movement between lines) by using the up and down cursors and movement within the same line (partially, movement between lines) by using the left and right cursors (D83 to D86). However, the cursor can be moved only within the range of the lines having the each line print widths already set and the range having character strings already inputted. Thus, although a description is omitted in FIG. 19, for example, when the right (or down) cursor is operated from the state in which the end of all the lines (the end of the text of the third line) is designated by the cursor (D82), error (warning) annunciation and flashing display to the effect that the cursor is out of the ranges described above are performed (D87) and the screen returns to its original state (D82) after a predetermined period of time (for example, 0.75 second). Also for the cursor operation of instructing movement to the outside of the ranges from other states (for example, to the left or upward from D84, upward from D83 and downward from D86), similarly, the error annunciation and the like (D87) are performed. Then, the screen returns to its original state after the predetermined period of time. In FIGS. 19 and 21, the concrete figures (e.g., x9, x8, x10) are to be understood only as examples because they cannot correctly reflect the cursor movements due to abbreviations introduced therein (e.g., "ELM" for ELEMENTARY, "SCH" for SCHOOL) for want of a sufficient space.

In case where the file creation of the file "03" described above is finished and the display returns to the function selection screen (D81) of "free width printing" in FIG. 20, the text contents registered at this point in time include the first line "Chiyoda Elementary School", the second line "Class 2 in $2^{nd}$ grade" and the third line "Taro Suzuki." Moreover, various specifications (settings) are as follows: the entire label width LW=54 mm, the each line print width of the first line PW1=15 mm, the each line print width of the second line PW2=10 mm and the each line print width of the third line PW3=20 mm. Thus, the entire print width PW=15+10+20=45 mm. Moreover, information on the various settings described above is registered as accompanying information of files together with information on the reference positions selected in the reference position selection screen (D60) described above in FIG. 16. Specifically, the information described above is registered in a state of being compressed or the like so as to be decompressible in reading the files.

Figure 22A:
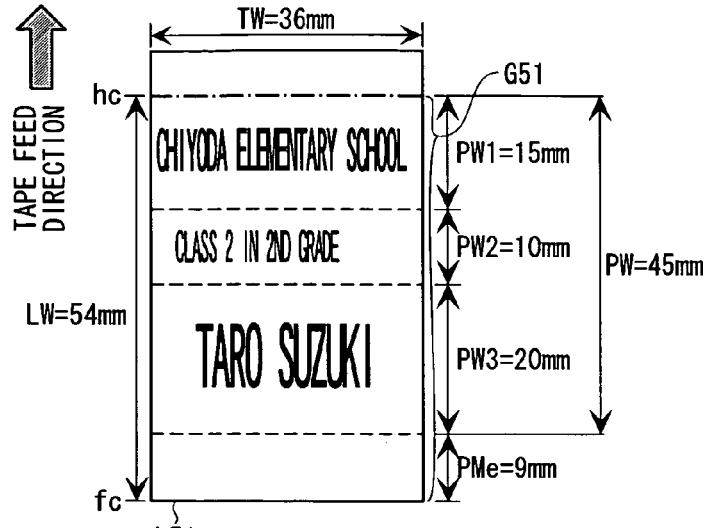
FIGS. 22A to 22C are explanatory views similar to FIGS. 10A and 10B, showing one example in the case of performing "file creation" by the method of FIGS. 16 to 20.

Here, in case where "front end alignment" is subjected to the selection operation in the reference position selection (D60 in FIG. 16), printing of the file "03" is instructed by "file printing" to be described later. Accordingly, as shown in FIGS. 22A, "Chiyoda Elementary School", "Class 2 in $2^{nd}$ grade" and "Taro Suzuki" are arranged in the centers of the each line print widths PW1 to PW3 of the respective lines, which are PW1=15 mm, PW2=10 mm and PW3=20 mm, by using the character size (arrangement width) suitable for the each line print width of each line. Moreover, since "front end alignment" is selected, a print image G51 is created so as to align the front end of the entire print width PW=45 mm with the front end of the entire label width LW=54 mm and to have the rear end side margin PMe=18 mm. Thereafter, the print image G51 is printed, for example, on the tape T having the tape width TW=36 mm. Subsequently, the tape T is subjected to the half cut hc and the full cut fc at its rear end to directly produce a label L51 having a (horizontal) length of 36 mm×a (vertical) width of 54 mm. When the reference position is set at the front end, it is also possible that reference positions of character string images of the respective lines are also set at the front end (upper side in FIG. 22A: line of an upper end of the character strings) and front ends of the character string images of the respective lines are arranged so as to coincide with the front ends of the respective line print widths.

Figure 22B:
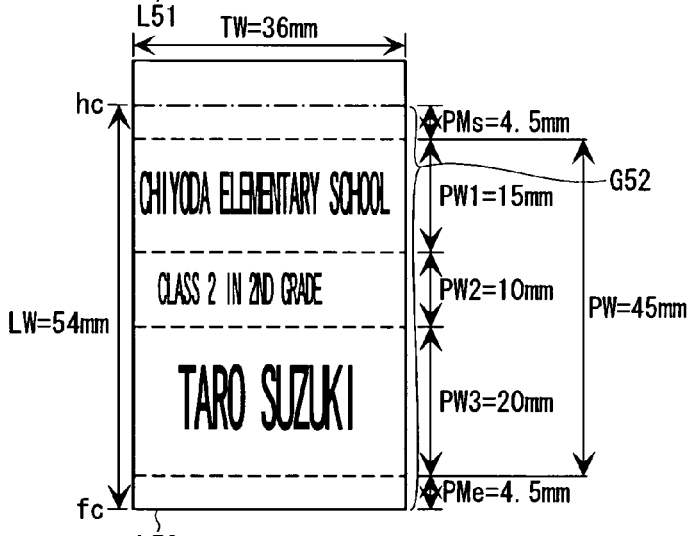

Moreover, when "center alignment" is subjected to the selection operation as the reference position and, thereafter, the file creation is finished in a manner similar to the above, printing is instructed. Accordingly, as shown in FIG. 22B, in a manner similar to the case described above, the character string images of the respective lines are arranged in the centers of the respective line print widths PW1 to PW3 of the respective lines, which are PW1=15 mm, PW2=10 mm and PW3=20 mm, by using the arrangement widths suitable for the each line print widths PW1 to PW3. Moreover, since "center alignment" is selected, a print image G52 is created so as to align the center of the entire print width PW=45 mm with the center of the entire label width LW=54 mm and to have the front end side margin PMs=4.5 mm and the rear end side margin PMe=4.5 mm. Thereafter, similarly, the tape T is cut to produce a label L52 having a (horizontal) length of 36 mm×a (vertical) width of 54 mm.

Figure 22C:
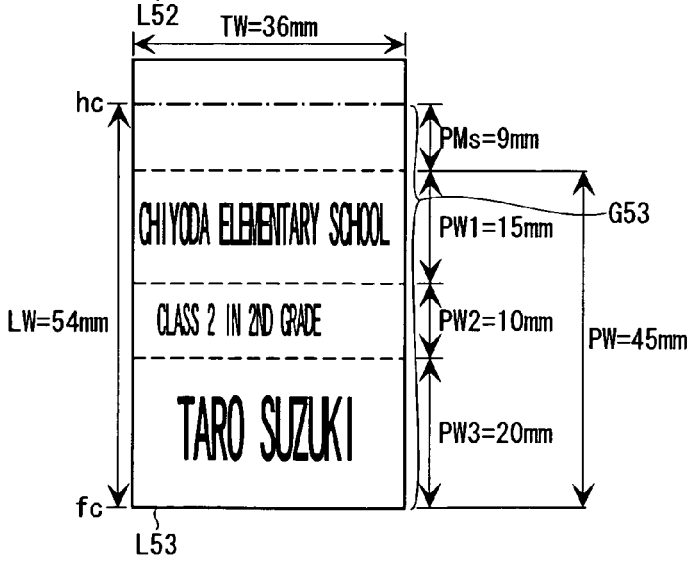

Moreover, similarly, when "rear end alignment" is subjected to the selection operation, the file creation is finished and printing is instructed. Accordingly, as shown in FIG. 22C, in a manner similar to the case described above, the character string images of the respective lines are arranged in the centers of the each line print widths PW1 to PW3 of the respective lines by using the arrangement widths suitable for the each line print widths PW1 to PW3. Moreover, since "rear end alignment" is selected, a print image G53 is created so as to align the rear end of the entire print width PW=45 mm with the rear end of the entire label width LW=54 mm and to have the front end side margin PMs=18 mm. Thereafter, similarly, the print image G53 is printed and the tape T is cut to produce a label L53 having a (horizontal) length of 36 mm×a (vertical) width of 54 mm. When the reference position is set at the rear end, it is also possible that reference positions of the character string images of the respective lines are also set at the rear end (lower side in FIG. 22C: line of a lower end of the character strings) and rear ends of the character string images of the respective lines are arranged so as to coincide with the rear ends of the each line print widths.

Figure 23A:
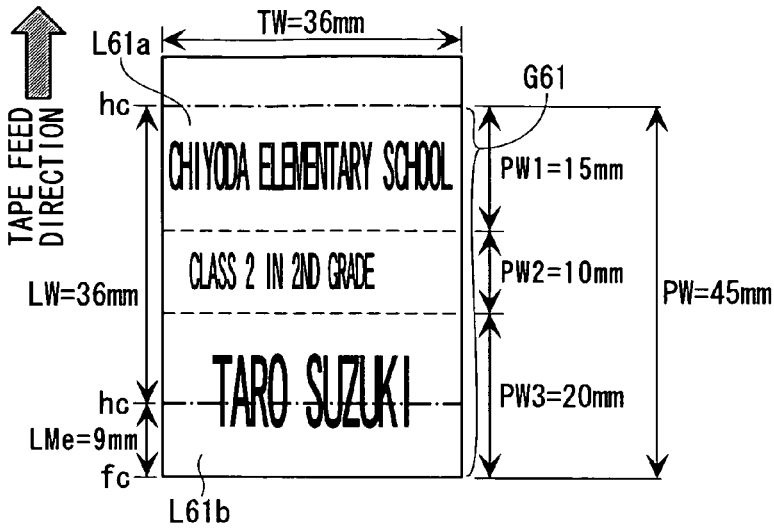
FIGS. 23A to 23C are explanatory views similar to FIGS. 22A to 22C, showing another example.
Figure 23B:
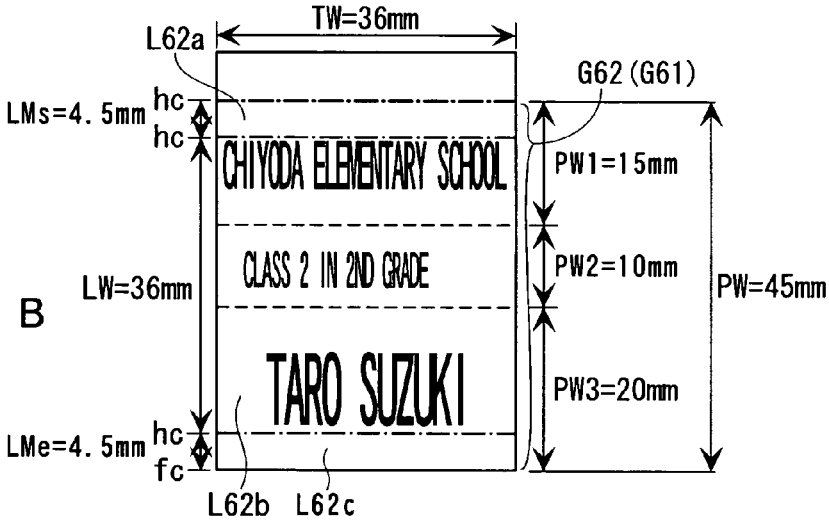
Figure 23C:
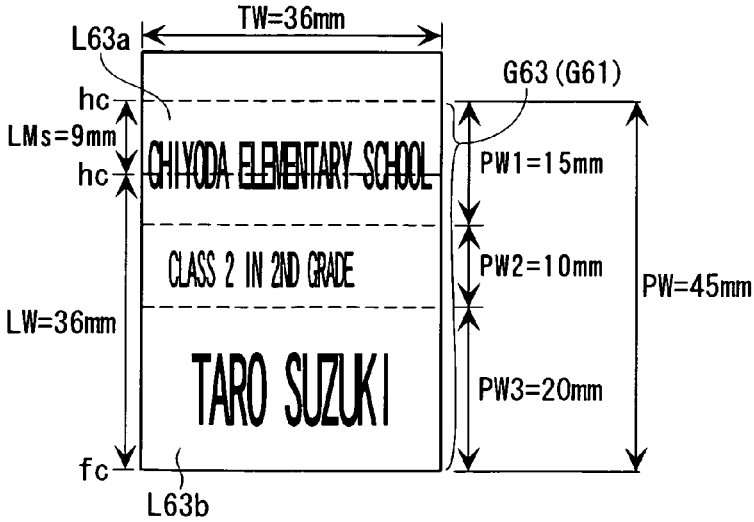

Also in the case of "each line print width designation" described above, the each line print widths PW1 to PW3 and the like can be designated so as to make the total entire print width PW larger than the entire label width LW. For example, "36" (36 mm) is designated in the input screen (D30) of the entire label width described above in FIG. 8 and the each line print widths PW1=15 mm, PW2=10 mm and PW3=20 mm of the respective lines are designated in a manner similar to the case described above in FIG. 16 and those subsequent thereto. Accordingly, since the entire print width PW=45 mm, the relationship of LW<PW is established. Similarly, when the reference position is subjected to the selection operation in the reference position selection screen (D60 in FIG. 16), the file creation is finished and printing is instructed. Accordingly, as shown in FIGS. 23A to 23C, the character strings of the respective lines are arranged in the center by using the arrangement widths suitable for corresponding each line print widths PW1 to PW3. Thus, a print image G61 having the entire print width PW=45 mm (print images G62 and G63 in FIGS. 23B and 23C are the same) is created regardless of the reference position. Thereafter, a front end thereof is printed so as to coincide with the position of the half cut hc.

However, in case where the reference position selection described above is "front end alignment", as shown in FIG. 23A, so as to align the front end of the entire label width LW with the front end of the print image G61, a label L61*a* having the entire label width LW=36 mm is produced by performing the half cut hc. In addition, so as to allow a total label width to coincide with the entire print width PW=45 mm, a label L61*b* having the rear surplus label width LMe=9 mm is produced by performing the half cut hc and the full cut fc. Moreover, in the case of "center alignment", as shown in FIG. 23B, so as to align the center of the entire label width LW with the center of the entire print width PW, a label L62*a* having the front surplus label width LMs=4.5 mm is produced by performing the half cut hc. Further, a label L62*b* having the entire label width LW=36 mm is produced by performing the half cut hc so as to continue from the label L62*a*. Furthermore, a label L62*c* having the rear surplus label width LMe=4.5 mm is produced by performing the full cut fc. In addition, in the case of "rear end alignment", as shown in FIG. 23C, a label L63*a* having the front surplus label width LMs=9 mm is produced by performing the half cut hc so as to align the rear end of the entire label width LW with the rear end of the entire print width PW. Thereafter, a label L63*b* having the entire label width LW=36 mm is produced by performing the full cut fc so as to continue from the label L63*a*.

As described above, in the tape printing apparatus 1, other than "automatic print width" and "entire print width designation" which are described above, "each line print width designation" capable of individually designating the each line print widths (the widths for arranging the respective lines) can be selected. Thus, more flexible and various combinations of the label width and the print width are possible. In addition, a desired (arbitrary) print width (set width) can be accurately set and fine adjustment thereof can be performed. Thus, especially, in the case of designating a divided label to be described later or the like, it is advantageous that the print width can be adjusted in accordance with a width of each divided label. Moreover, in file registration, the each line print widths of the respective lines are also registered as accompanying information. Thus, it is possible to easily and quickly perform creation of a desired print image as well as label production just by reading the registered files without requiring resetting and the like. Other advantages and the like are similar to those in the case of "automatic print width" and "entire print width designation" which are described above. Thus, a description thereof will be omitted.

The respective examples described above are examples in which "entire label width designation" is selected. Namely, "entire label width designation" is for producing basically one piece of label, which has the entire print image printed thereon, in the selection screen displaying the relationship between the print image created and printed based on each of the registered files and the label to be produced, i.e., the selection screen for designating the principal number of labels eventually (D22: common in FIGS. 7, 8 and 24: hereinafter referred to as a "label number selection screen"). However, in the tape printing apparatus 1, as described above, "divided label width designation" can be also selected. Specifically, in "divided label width designation", by designating label widths of respective labels (respective divided label) of multiple pieces, the respective labels of multiple pieces, which are obtained by printing a desired print image by dividing the image into pieces, are produced. Accordingly, as a fourth embodiment, a description will be given below by using an example of selecting "divided label width designation."

In the tape printing apparatus 1 of this embodiment, it is assumed that "divided label width designation" is subjected to the selection operation, as shown in FIG. 24, in the label number selection screen described above in FIG. 7 and the like (D22 described above). Accordingly, next, as a screen in a lower hierarchy, an input screen which encourages input of "divided label number" is displayed (D90). Here, immediately after the screen transition, the divided label number "00" is displayed as default. From this state (D90), the user can designate the divided label number=2 (pieces) by pressing the selection key after inputting "2", for example, by operating the numeric key. Here, when the selection key is pressed (determination is made) after the numeric value "0" is inputted (or nothing is inputted), the display returns to the same screen (D90) after error annunciation (for a predetermined period of time). On the other hand, when determination is made after the numeric value "1" is inputted, "entire label width designation" is determined. Accordingly, the display moves to the input screen (D30) of "entire label width" described above in FIG. 8.

When multiple pieces (here, 2 pieces) are designated (inputted) as the divided label number, next, as a screen in a still lower hierarchy, a setting screen for the label width of each divided label (divided label width) is displayed (D91).

In this setting screen (D91), the divided label number "02" (2 pieces) is clearly indicated. In addition, immediately after the screen transition, so as to encourage input of a divided label width of a first piece, an input position thereof is first designated by the cursor (D91). Thus, by inputting the number "25" (25 mm), for example, by operating the numeric key, the user can designate the divided label width=2.5 cm (25 mm) of the first piece. Thereafter, when determination is made by pressing the selection key, next, so as to encourage input of a divided label width of a second piece, an input position thereof is designated by the cursor (D92). Thus, similarly, by inputting the number "20", the user can designate the divided label width=2.0 cm (20 mm) of the second piece (D93: common in FIGS. 24 and 25).

Figure 25:
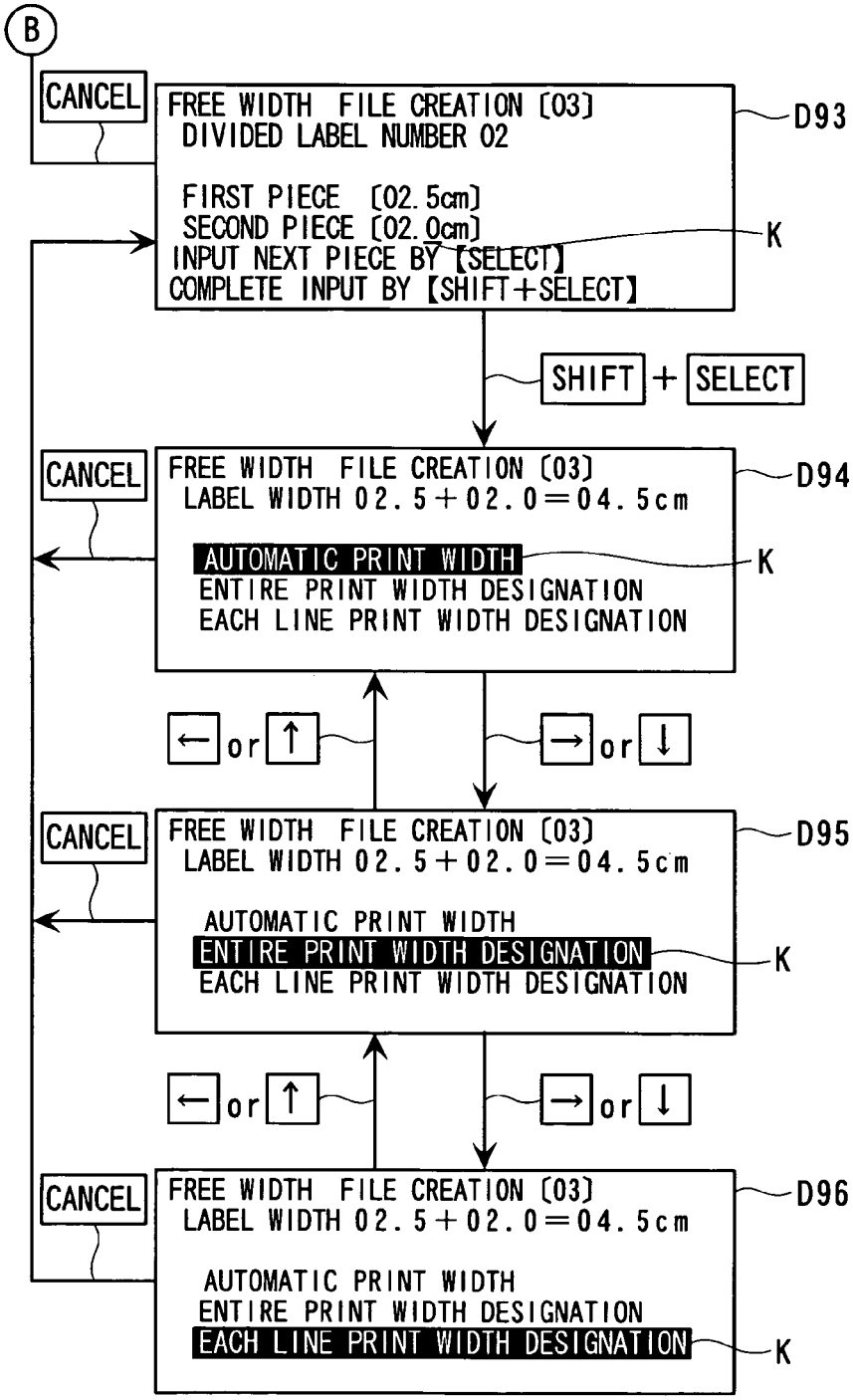
FIG. 25 is an explanatory view similar to FIG. 24, following FIG. 24.

As shown in FIG. 25, when determination is made by using shift key+selection key from the state described above (D93), next, a selection screen in a still lower hierarchy is displayed (D94). This selection screen (D94) is a screen similar to the selection screen (D31) of the method for designating the print width described above in FIG. 8 except that the (entire) label width 4.5 cm is displayed as a total of divided label widths, such as 02.5+02.0=04.5 cm, in a title part at an upper side of the screen. Here, options thereof include "automatic print width", "entire print width designation", "each line print width designation" and the like, which are similar to those described above (D94 to D96).

Figure 26:
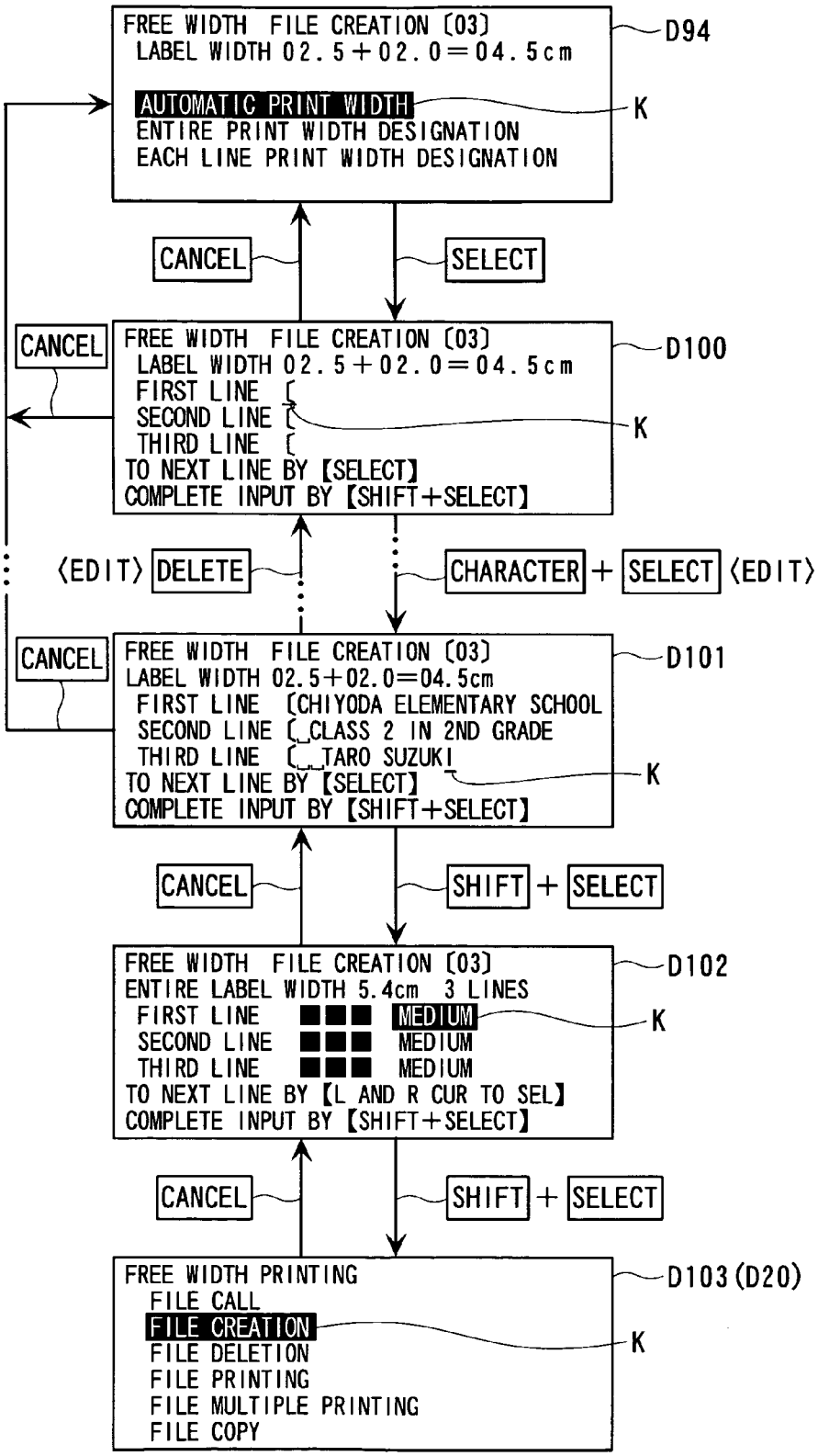
FIG. 26 is an explanatory view similar to FIG. 7, which follows FIG. 25 and shows one example in case where "file creation" is performed by "automatic print width" of "divided label width designation"

Here, as shown in FIG. 26, it is assumed that "automatic print width" is subjected to the selection operation from the selection screen described above (D94: common in FIGS. 25 and 26). Accordingly, next, as a screen in a still lower hierarchy, an input screen of text data is displayed (D100). This input screen (D100) is a screen similar to the input screen (D40) described above in FIG. 9 except for a title part thereof (display of the label width) at its upper side, which is different from that of D40. Thus, thereafter (similar to D40 to D42 in FIG. 9), the first line "Chiyoda Elementary School", the second line "Class 2 in $2^{nd}$ grade" and the third line "Taro Suzuki" are inputted and edited (D101). Subsequently, in a setting screen (D102) in a still lower hierarchy, the abstract sizes of the respective lines are designated so as to be "middle", "small" and "large", respectively. Thereafter, the file creation of the file "03" is finished and the display returns to the function selection screen of "free width printing" (D103: the same as D43 in FIG. 9 and D20 in FIG. 7).

Figure 27A:
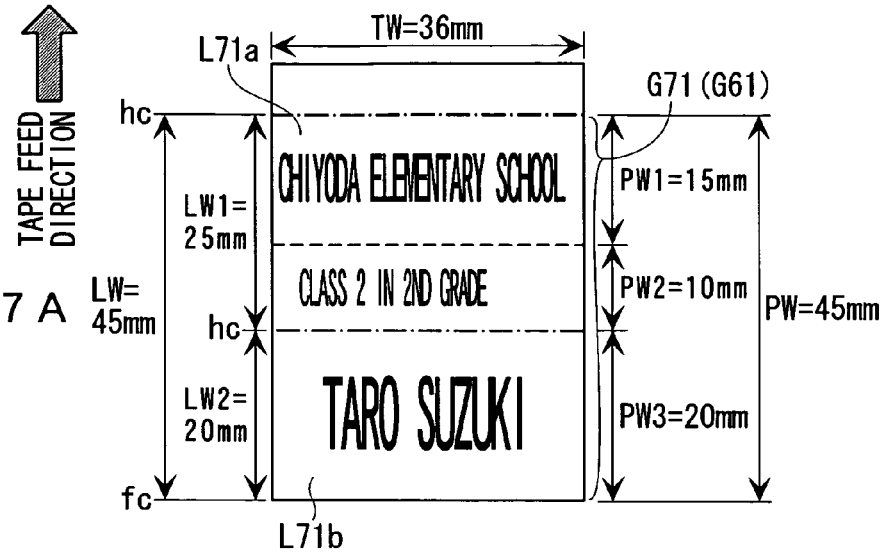
FIGS. 27A to 27C are explanatory views similar to FIGS. 10A and 10B, showing one example in the case of performing "file creation" by the method of FIGS. 24 to 26, FIG. 28 and FIG. 29.

In this case, accompanying information in file registration includes the divided label number and the respective divided label widths, all of which are described above. Thus, thereafter, when printing of the file "03" is performed on the tape T having the tape width TW=36 mm by "file printing" to be described later, as shown in FIG. 27A, a print image G71 (the same as G61 in FIG. 23A) is printed to have the entire print width PW=45 mm. Thereafter, a divided label L71*a* having a divided label width LW=25 mm of a first piece, out of two pieces, is produced by performing the half cut hc. Specifically, the divided label widths are obtained by dividing the range of the entire label width LW=45 mm from the half cut hc at the front end to the full cut fc at the rear end into two pieces, i.e., the divided label number. Subsequently, a divided label L71*b* having a divided label width LW2=20 mm of a second piece is produced by performing the full cut fc so as to continue from the divided label L71*a*.

Figure 27B:
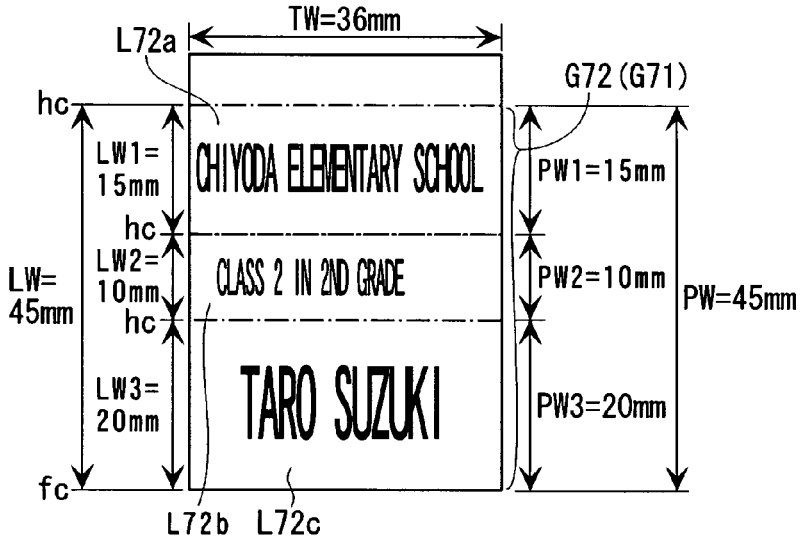
Figure 27C:
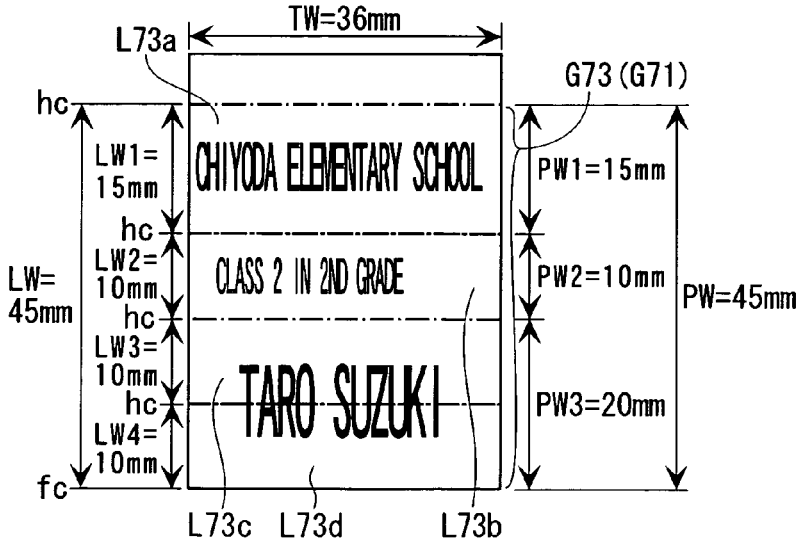

To be precise, despite slight divergence, it is assumed that each line print width PW2=10 mm of the second line, which is shown in FIGS. 27A to 27C, is an actual size (absolute size) which corresponds to the abstract size of "small." Accordingly, each line print width PW1=15 mm (to be precise, more than 14 mm) of the first line is approximately an actual size corresponding to the abstract size of "medium" since PW1 is a size obtained by multiplying "small" by about $\sqrt{2}$. In addition, each line print width PW3=20 mm of the third line is an actual size corresponding to the abstract size of "large" since PW3 is a size about twice as large as "small." Thus, in case where "each line print width designation" is subjected to the selection operation (D96 in FIG. 25) in the selection screen of the method for designating the print width described above in FIG. 25 and the each line print widths PW1=15 mm, PW2=10 mm and PW3=20 mm are designated and registered for the first to third lines, when printing is instructed, in general, a print result and a label production result in FIG. 27A are obtained similarly. Moreover, also when "entire print width designation" is subjected to the selection operation (D95 in FIG. 25) and the entire print width PW=45 mm is designated and registered, similar results are obtained.

Accordingly, for description of all results of FIGS. 27A to 27C, description of an example in the case of selecting "each line print width designation" or "entire print width designation" will be shared below.

Figure 28:
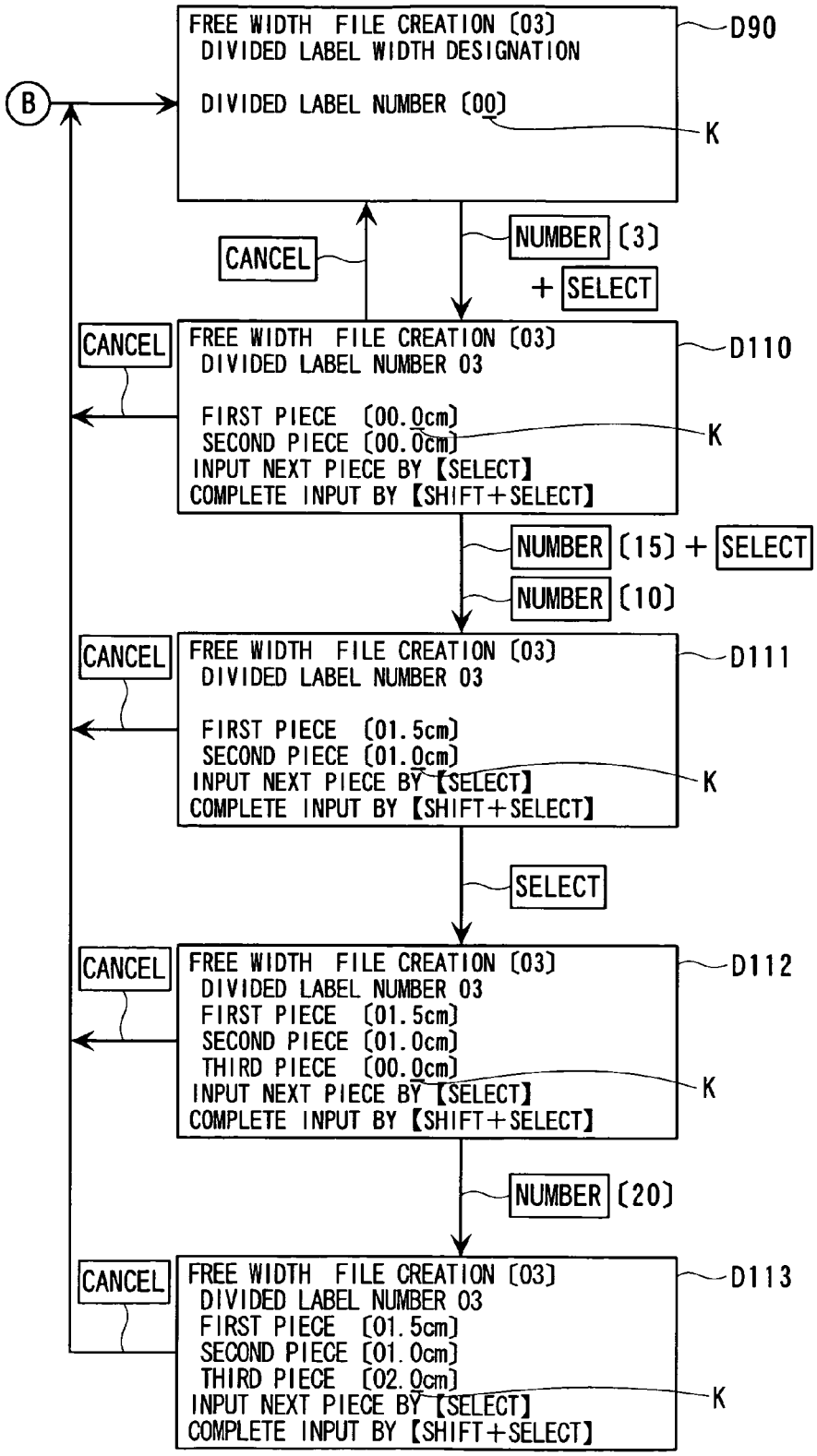
FIG. 28 is an explanatory view similar to FIG. 24, showing another example.

Next, supplemental description will be given of an example in which the divided label number is different from the number described above (2 pieces). For example, as shown in FIG. 28, from the input screen of "divided label number" described above (D90: common to FIG. 24), "3", for example, is inputted and determination is made (by pressing the selection key). Accordingly, "3" (3 pieces) is designated as the divided label number. In addition, in a setting screen of the divided label width (D110) in a still lower hierarchy, the number "15" is inputted as the divided label width of a first piece and the divided label width=1.5 cm (15 mm) of the first piece is designated and determination is made (by pressing the selection key). Moreover, the number "10" is inputted as the divided label width of a second piece and the divided label width=1.0 cm (10 mm) of the second piece is designated (D111) and determination is made (by pressing the selection key). Accordingly, so as to encourage input of the divided label width of a third piece similarly, an input position thereof is designated by the cursor (D112). Thus, similarly, the number "20" is inputted and the divided label width=2.0 cm (20 mm) of the third piece can be designated (D113).

From the state described above (D113), in the selection screen of the method for designating the print width, which is similar to the selection screen described above in FIG. 25 (D94 to D96), any one of "automatic print width", "entire print width designation" and "each line print width designation" is subjected to the selection operation. Subsequently, text input to arrangement width (abstract size and print width) designation are performed (see FIGS. 16 to 20 for "each line print width designation") in a manner similar to the processing described above in FIG. 26 (see D100 to D102 in FIG. 26). Thereafter, the file creation of the file "03" is finished and the display returns to the function selection screen of "free width printing" (see D102 in FIG. 26, D43 in FIG. 9, D20 in FIG. 7 and the like).

In this case, when printing of the file "03" is performed on the tape T having the tape width TW=36 mm by "file printing" to be described later, as shown in FIG. 27B, a print image G72 (the same as G71 in FIG. 27A) is printed to have the entire print width PW=45 mm. Thereafter, a divided label L72*a* of a first piece having a divided label width LW1=15 mm, out of three pieces, is produced by performing the half cut hc. Specifically, the divided label widths are obtained by dividing the range of the entire label width LW=45 mm from the half cut hc at the front end to the full cut fc at the rear end into three pieces, i.e., the divided label number. Subsequently, a divided label L72*b* of a second piece having a divided label width LW2=10 mm is produced by performing the half cut hc so as to continue from the divided label L72*a*. Thereafter, a divided label L72*c* of a third piece having a divided label width LW3=20 mm is produced by performing the full cut fc so as to continue from the divided label L72*b*. In this case, the respective divided label widths and the each line print widths coincide with each other. Thus, it is possible to produce the divided labels L72*a* to L72*c* as if the three pieces of labels are divided just by the respective lines.

Figure 29:
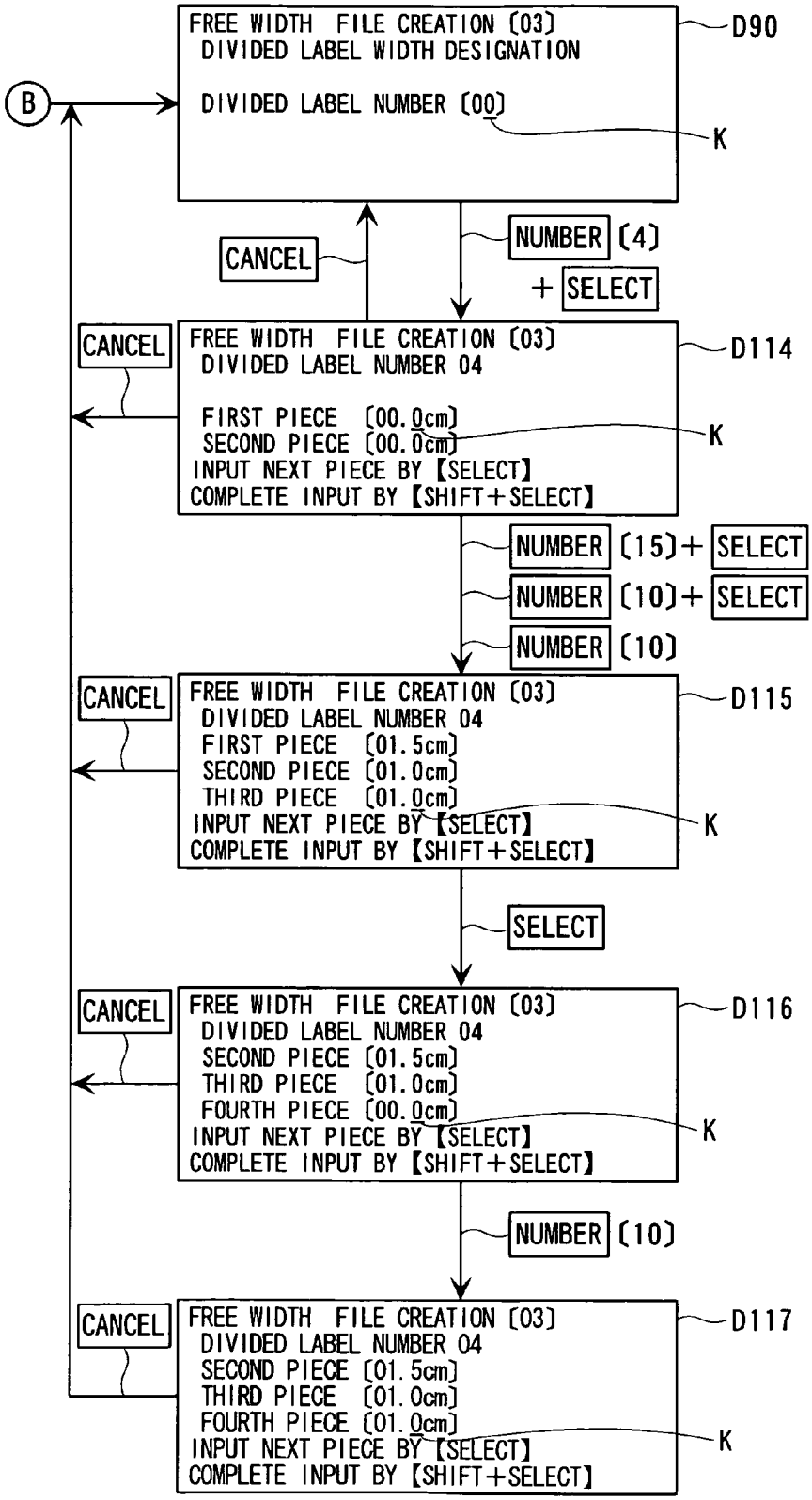
FIG. 29 is an explanatory view similar to FIG. 24, showing still another example.

Similarly, as shown in FIG. 29, for example, from the input screen of "divided label number" (D90: common to FIG. 24), "4", for example, is inputted and determined to designate the divided label number "4" (4 pieces). Accordingly, in a setting screen of the divided label width (D114), the number "15" is inputted to designate and determine the divided label width=1.5 cm (15 mm) of a first piece. Thereafter, the number "10" is inputted to designate and determine the divided label width=1.0 cm (10 mm) of a second piece. Subsequently, the number "10" is inputted to designate the divided label width=1.0 cm (10 mm) of a third piece (D115) and determination is made (by pressing the selection key). Accordingly, so as to encourage input of the divided label width of a fourth piece similarly, an input position thereof is designated by the cursor (D116). Thus, similarly, the number "10" is inputted and the divided label width=1.0 cm (10 mm) of the fourth piece can be designated (D117).

From the state described above (D117), any one of the options of the method for designating the print width is subjected to the selection operation in a manner similar to the example described above and the text input to the arrangement width designation are similarly performed. Thereafter, the file creation of the file "03" is finished and the display returns to the function selection screen of "free width printing" (see D102 in FIG. 26, D43 in FIG. 9, D20 in FIG. 7 and the like).

In this case, when printing of the file "03" is similarly performed, as shown in FIG. 27C, a print image G73 (the same as G71 in FIG. 27A) is printed to have the entire print width PW=45 mm. Thereafter, a divided label L73*a* of a first piece having a divided label width LW1=15 mm, out of four pieces, is produced by performing the half cut hc. Specifically, the divided label widths are obtained by dividing the range of the entire label width LW=45 mm into four pieces. Thereafter, a divided label L73*b* of a second piece having a divided label width LW2=10 mm and a divided label L73*c* of a third piece having a divided label width LW3=10 mm are produced, respectively, by performing the half cut hc. Subsequently, a divided label L73*d* of a fourth piece having a divided label width LW4=10 mm is produced by performing the full cut fc so as to continue from the divided label L73*c*.

The example described above is an example of the entire label width LW=the entire print width PW (=45 mm). However, also in the case of "divided label width designation", by subjecting "entire print width designation" or "each line print width designation" to the selection operation (D95 and D96 in FIG. 25), it is possible to set the entire label width LW≠the entire print width PW (i.e., LW>PW or LW<PW).

Figure 30:
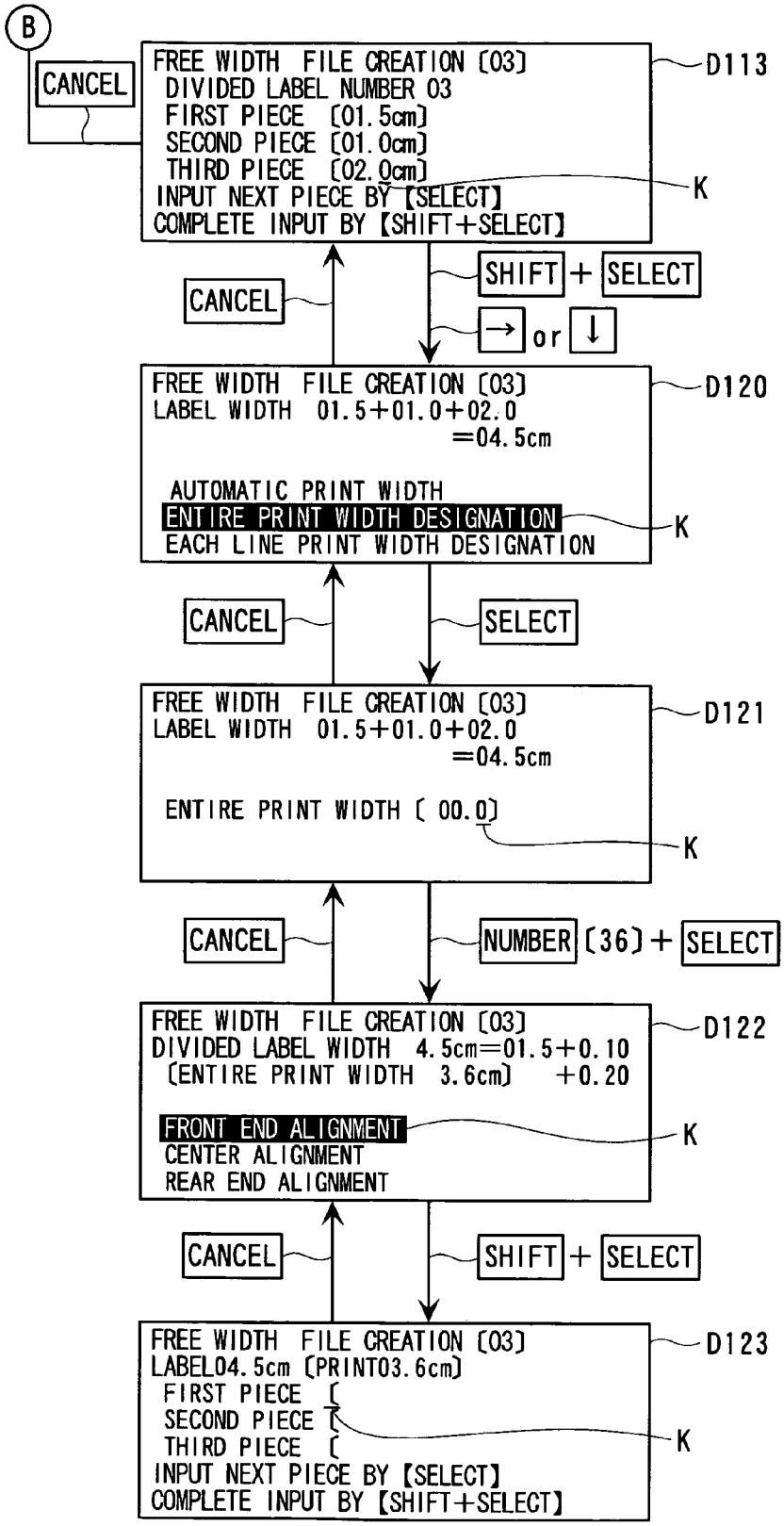
FIG. 30 is an explanatory view similar to FIG. 7, which follows FIG. 28 and shows one example in case where "file creation" is performed by "entire print width designation" of "divided label width designation"

For example, as shown in FIG. 30, after inputting the divided label widths by using the divided label number "03" (3 pieces) (D113: common to FIG. 28), determination is made by using shift key+selection key and "entire print width designation" is subjected to the selection operation (D120). Thereafter, in a manner similar to the example described above in FIG. 12, as a screen in a lower hierarchy, an input screen of "entire print width" is displayed (D121). Thus, the number "36" (36 mm) is inputted and determined (by pressing the selection key) and the entire print width=3.6 cm (36 mm) can be designated. Subsequently, in a reference position selection screen in a still lower hierarchy, assuming that "front end alignment" of default is subjected to the selection operation (D122), next, an input screen of text data in a still lower hierarchy is displayed (D122). This input screen is a screen similar to the input screen described above in FIG. 9 (D40) except for a title part (description related to the label width) at an upper side of the screen. Thus, thereafter, in a manner similar to D40 to D42 in FIG. 9, the first to third lines are inputted and edited and the abstract sizes of the respective lines are designated in a setting screen in a still lower hierarchy. Thereafter, the file creation of the file "03" is finished and the display returns to the function selection screen of "free width printing" (see D43 in FIG. 9 and D20 in FIG. 7).

Figure 31A:
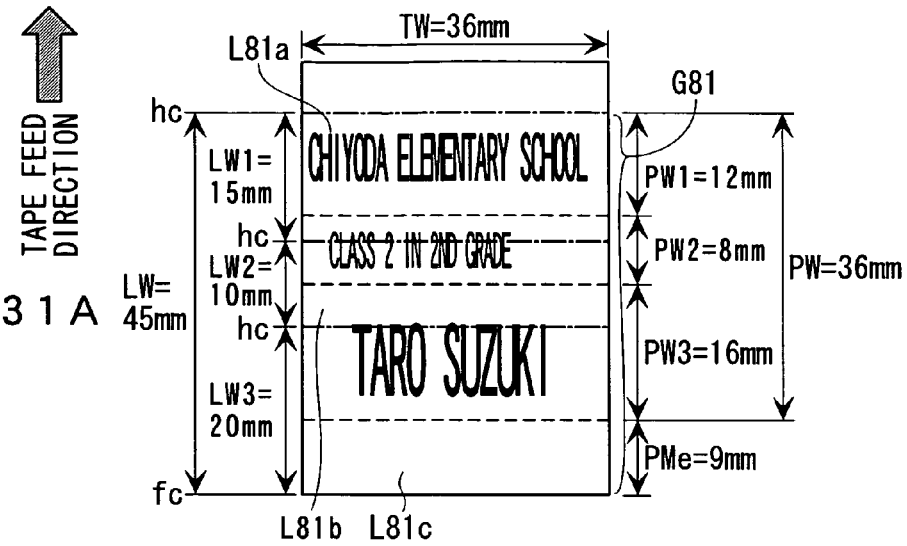
FIGS. 31A to 31C are explanatory views similar to FIGS. 10A and 10B, showing one example in the case of performing "file creation" by the method of FIG. 30.

In this case, when printing of the file "03" is instructed, as shown in FIG. 31A, a print image G81 is created. Specifically, since "front end alignment" is selected, the print image G81 is created so as to align the front end of the entire print width PW=36 mm with the front end of the entire label width LW=45 mm and to have the rear end side margin PMe=9 mm. Thereafter, the print image G81 is printed, for example, on the tape T having the tape width TW=36 mm. Subsequently, in a manner similar to the example described above in FIG. 27B, divided labels L81*a* to L81*c* having divided label widths LW1=15 mm, LW2=10 mm and LW3=20 mm, respectively, are produced by performing the half cut hc and the full cut fc. Specifically, the divided label widths are obtained by dividing the range of the entire label width LW=45 mm from the half cut hc at the front end to the full cut fc at the rear end into three pieces, i.e., the divided label number.

Figure 31B:
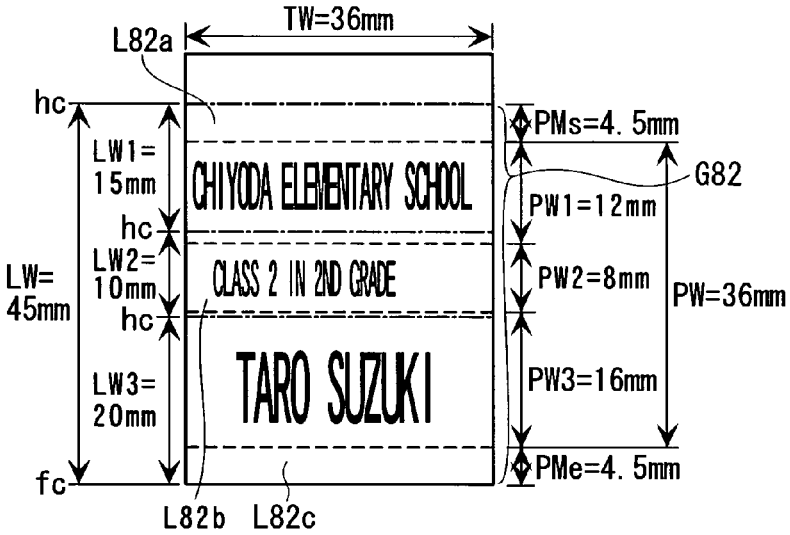

Moreover, in case where "center alignment" is subjected to the selection operation in the reference position selection, similarly, the file creation is finished and printing of the file "03" is instructed. Accordingly, as shown in FIG. 31B, a print image G82 is created so as to align the center of the entire print width PW=36 mm with the center of the entire label width LW=45 mm and to have the front end side margin PMs=4.5 mm and the rear end side margin PMe=4.5 mm. Thereafter, printing and cuts are similarly performed. Thus, divided labels L82*a* to L82*c* having divided label widths LW1=15 mm, LW2=10 mm and LW3=20 mm, respectively, are produced.

Figure 31C:
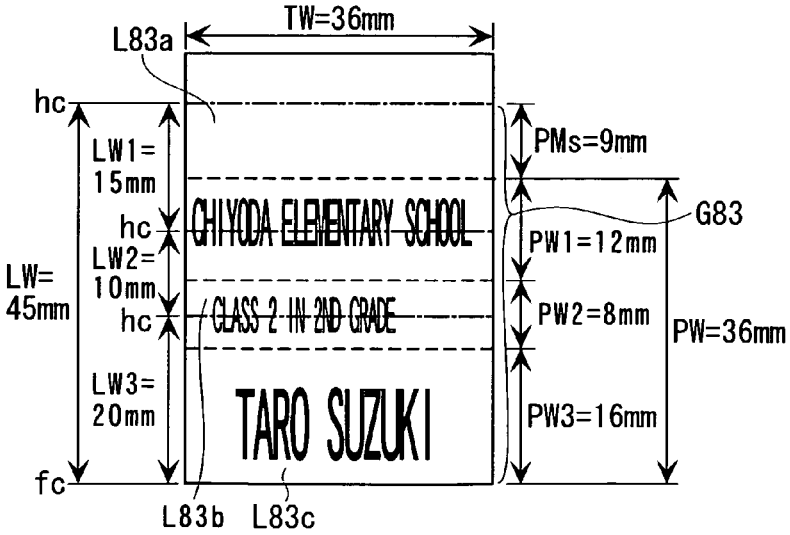

Similarly, after "rear end alignment" is subjected to the selection operation and the file creation is finished, printing is instructed. Accordingly, as shown in FIG. 31C, a print image G83 is created so as to align the rear end of the entire print width PW=36 mm with the rear end of the entire label width LW=54 mm and to have the front end side margin PMs=9 mm. Thereafter, printing and cuts are similarly performed. Thus, divided labels L83*a* to L83*c* having divided label widths LW1=15 mm, LW2=10 mm and LW3=20 mm, respectively, are produced.

For example, in the selection screen of the method for designating the print width in FIG. 30 (D120), "each line print width designation" is subjected to the selection operation instead of "entire print width designation." Thereafter, in a manner similar to the example described above in FIGS. 16 to 20 and the like, text input to each line print width designation are performed and printing is instructed after file creation. Also in this case, the results described above in FIGS. 31A to 31C are obtained if, for example, the each line print widths PW1=12 mm, PW2=8 mm and PW3=16 mm are designated for the respective first to third lines (a ratio between the respective lines is the same as that of 15, 10 and 20 when PW=45 mm in FIGS. 27A to 27C).

Moreover, the example described above is an example of the relationship of the entire label width LW>the entire print width PW. However, by subjecting "entire print width designation" or "each line print width designation" to the selection operation (D95 and D96 in FIG. 25), contrary to the example described above, it is possible to set the relationship of the entire label width LW<the entire print width PW. For example, the divided label number and the respective divided label widths are set to be the same as those described above (in other words, the divided label number is "03" and the respective divided label widths are LW1=15 mm, LW2=10 mm and LW3=20 mm) and the entire print width PW=54 mm is set. Alternatively, in "each line print width designation", the each line print widths of the first to third lines are set to PW1=18 mm, PW2=12 mm and PW3=24 mm, respectively. In these cases, print results and label production results as shown in FIGS. 32A to 32C are obtained.

Specifically, a print image G91 having the entire print width PW=54 mm (the same as the print image G10 described above in FIG. 10B) is created regardless of the reference position. Thereafter, a front end thereof is printed so as to coincide with the position of the half cut hc.

Figure 32A:
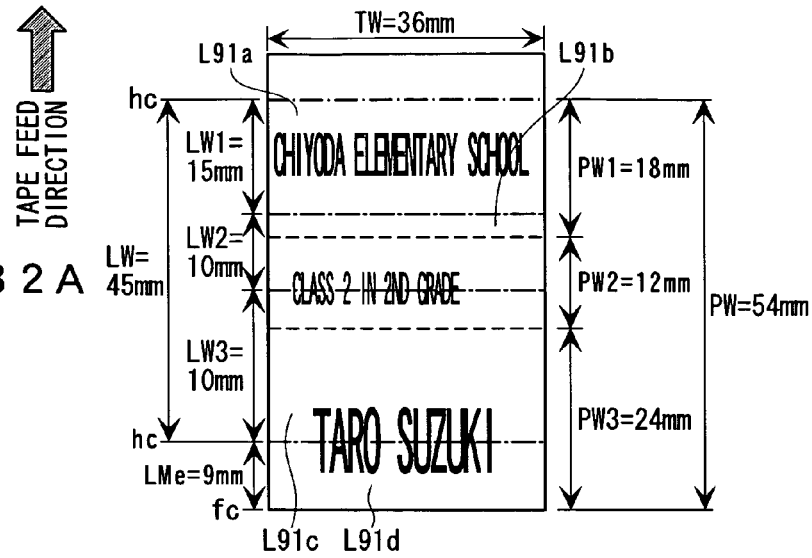
FIGS. 32A to 32C are explanatory views similar to FIGS. 31A to 31C, showing another example.

However, when "front end alignment" is subjected to the selection operation in the reference position selection, as shown in FIG. 32A, divided labels L91*a* to L91*c* having divided label widths LW1=15 mm, LW2=10 mm and LW3=20 mm, respectively, are produced by performing the half cut hc. Specifically, since "front end alignment" is selected, the divided labels are produced so as to align the front end of the entire label width LW=45 mm with the front end of the print image G91. Moreover, the divided label widths are obtained by dividing the range of the entire label width LW=45 mm into three pieces, i.e., the divided label number. At the same time, a label L91*d* having the rear surplus label width LMe=9 mm is produced by performing the full cut fc so as to allow the total label width to coincide with the entire print width PW=54 mm and to continue from a rear end of the label L91*c*.

Figure 32B:
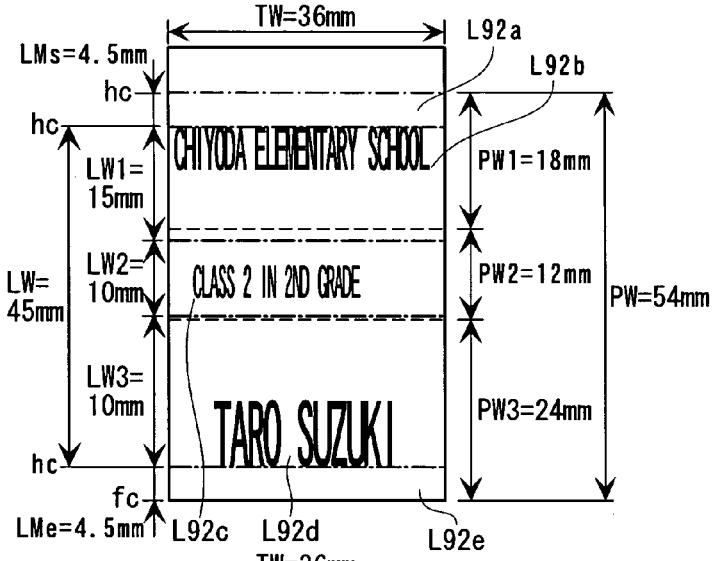
Figure 32C:
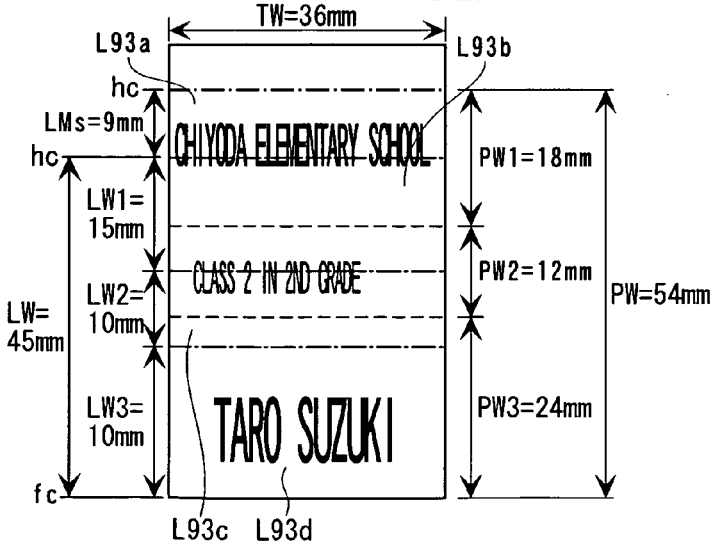

Moreover, when "center alignment" is subjected to the selection operation, as shown in FIG. 32B, a label L92*a* having the front surplus label width LMs=4.5 mm is first produced by performing the half cut hc so as to align the center of the entire label width LW=45 mm with the center of the entire print width PW=54 mm. Thereafter, divided labels L92*b* to L92*d* having divided label widths LW1=15 mm, LW2=10 mm and LW3=20 mm, respectively, are produced by performing the half cut hc so as to continue from the label L92*a*. Specifically, the divided label widths are obtained by dividing the range of the entire label width LW=45 mm into three pieces, i.e., the divided label number. At the same time, a label L92*e* having the rear surplus label width LMe=4.5 mm is produced by performing the full cut fc so as to continue from a rear end of the label L92*d*.

Similarly, when "rear end alignment" is subjected to the selection operation, as shown in FIG. 32C, a label L93*a* having the front surplus label width LMs=9 mm is first produced by performing the half cut hc so as to align the rear end of the entire label width LW=36 mm with the rear end of the entire print width PW=54 mm. Thereafter, divided labels L93*b* to L93*d* having divided label widths LW1=15 mm, LW2=10 mm and LW3=20 mm, respectively, are produced by performing the half cut hc and the full cut fc so as to continue from a rear end of the label L93*a*. Specifically, the divided label widths are obtained by dividing the range of the entire label width LW=45 mm into three pieces, i.e., the divided label number.

As described above, in the tape printing apparatus 1, a label corresponding to a print image can be realized as a series of multiple divided labels. In this case, the number of the divided labels is designated and each label widths of the respective divided labels are set. Thereafter, the tape is cut in accordance with the respective label widths. Thus, the multiple divided labels can be produced as the label. Consequently, it is possible to set more flexible and various combinations of the label width and the print width and to produce more various labels. Moreover, in the file registration, the divided label number and the respective divided label widths are registered as the accompanying information. Thus, also in the case of producing labels by dividing a label having a print image printed thereon into multiple pieces of labels, it is possible to easily and quickly perform creation of a desired print image and label production just by reading the registered files without requiring resetting and the like. Other advantages and the like are similar to those in the case of "entire label width designation" described above. Thus, a description thereof will be omitted.

As described above, the files created in various forms (for example, the file "03") by utilizing the function of "file creation" among the various functions of "free width printing" (see D20 in FIG. 7 and the like) are registered in a predetermined region in the RAM 240. However, in the file registration of the respective files, various pieces of information related to creation and printing of a print image as well as label production are registered as the accompanying information of the respective files. Specifically, the various pieces of information include: various label widths (the divided label width LW1 and the like) which include the entire label width LW or which can derive the entire label width LW; various print widths (each line print width PW1 and the like) which include the entire print width PW or which can derive the entire print width PW; and the like. Thus, for example, even immediately after other operations are performed such as creation of files having different individual settings (especially, specifications and settings related to the width direction printing such as the print width and the label width), it is possible to easily and quickly perform label production based on a desired individual setting just by reading the registered files without requiring resetting related to the width direction printing.

Accordingly, next, various utilization methods for the respective registered files will be described below. First, the function of "file printing" will be described.

Figure 33:
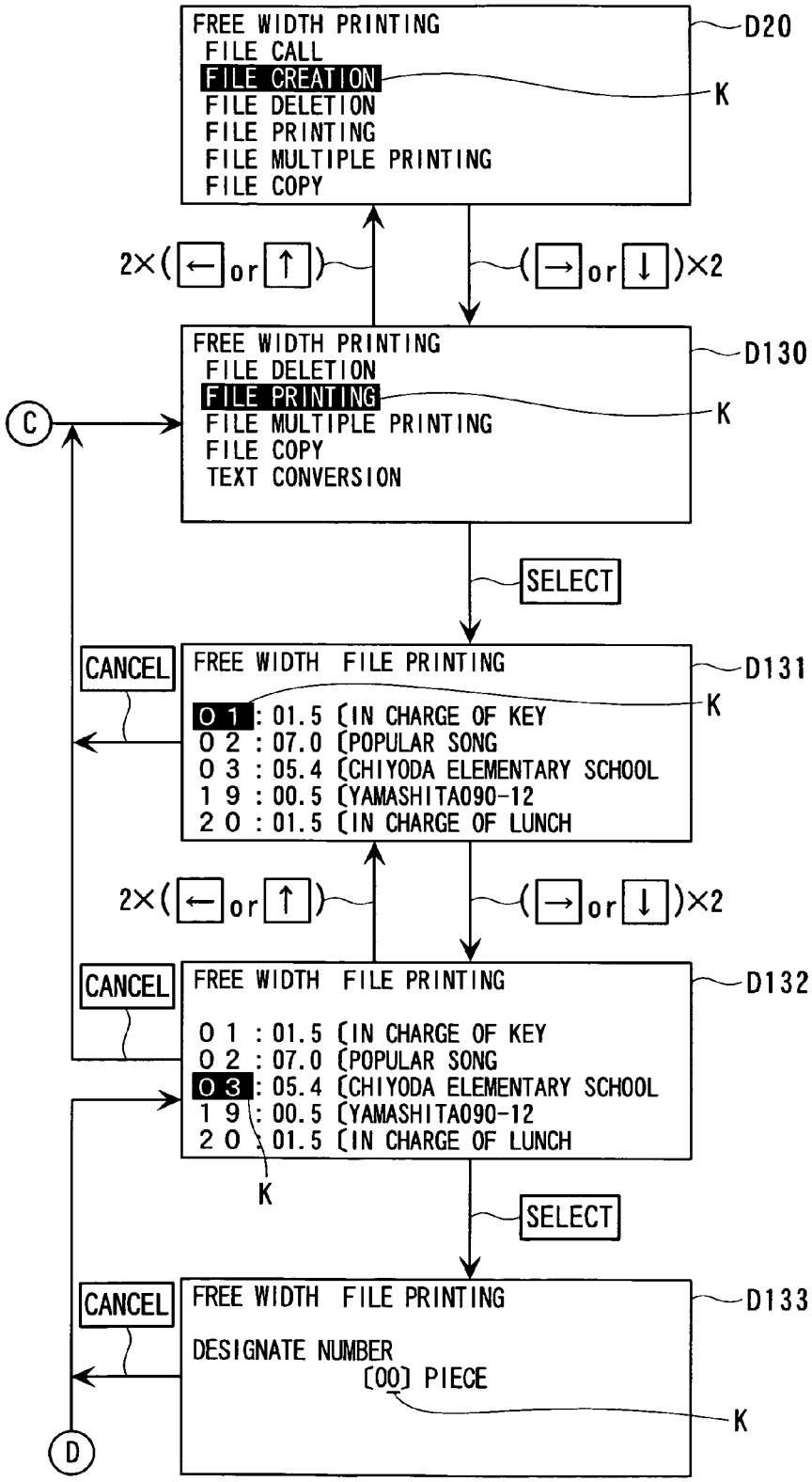
FIG. 33 is an explanatory view similar to FIG. 7, showing one example in the case of performing "file printing" among the functions of "free width printing"

For example, as shown in FIG. 33, from the state in which "file creation" described above is subjected to selection display in the function selection screen of "free width printing" (D20: common to FIG. 7), "file printing" is subjected to the selection display (D130) by cursor operation. Thereafter, determination is made (by pressing the selection key) ("file printing" is subjected to selection operation). Next, as a screen in a lower hierarchy, a selection screen (print file selection screen) for selecting (designating) a file to be subjected to the file printing is displayed (D131).

In this selection screen (D131), a title part in an upper part of the screen clearly indicates the file printing in the free width printing. In addition, file numbers of the registered files are displayed in ascending order and in a format of "file number: necessary size [head portion of text data]" for respective lines. However, the necessary size=a larger size of either the entire label width LW or the entire print width PW (necessary size in the longitudinal direction as the tape T). Here, for example, it is assumed that the file "03" is created and registered in a manner similar to the example described in FIG. 9 and FIGS. 10A and 10B. Accordingly, the file "03" is displayed as "03: 05.4 [Chiyoda Elementary School]" (D131 and D132: see FIG. 9 and FIGS. 10A and 10B) as shown in FIG. 33. Moreover, the position of the cursor is indicated by the negative display of the file number.

Figure 34:
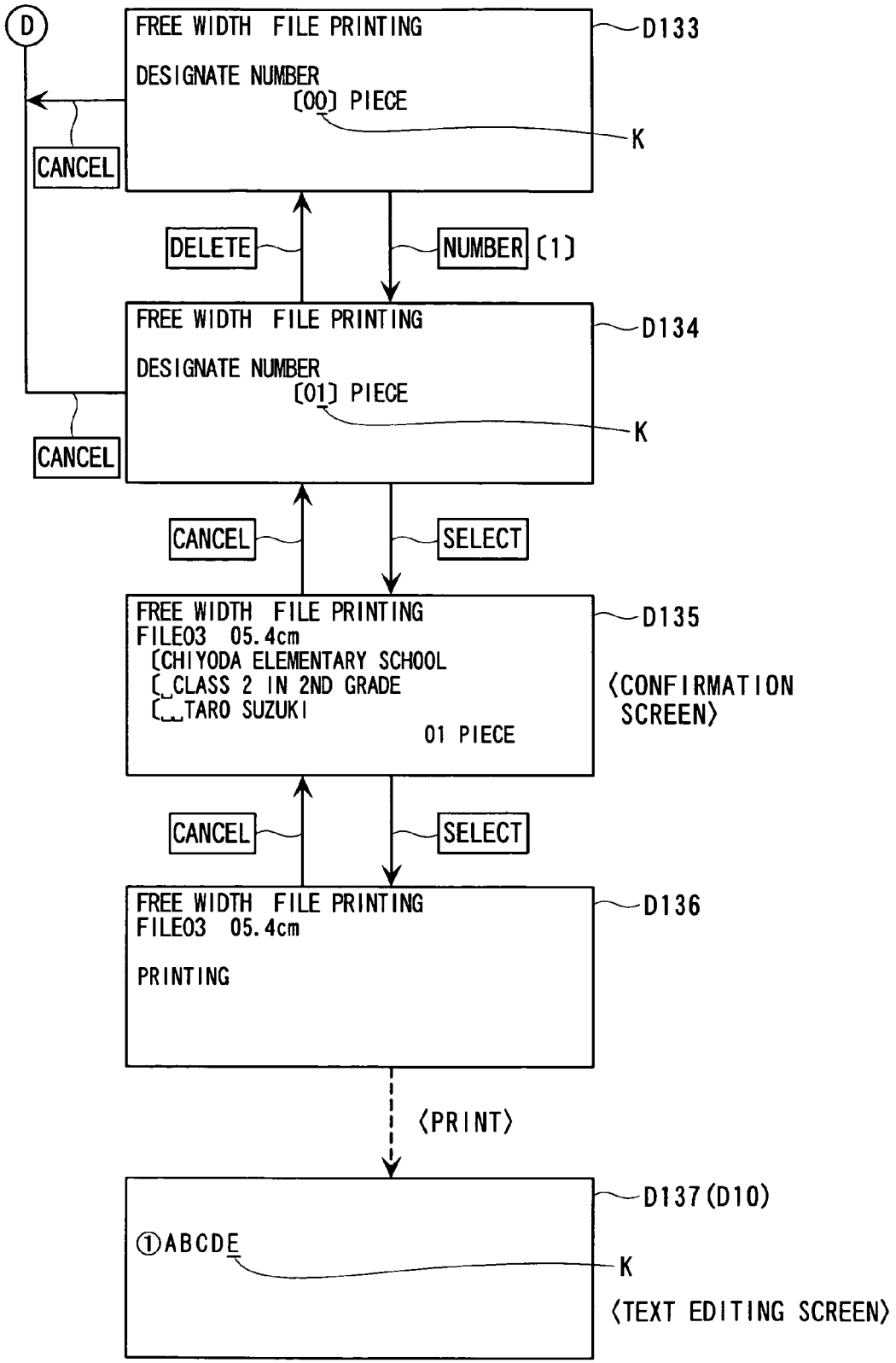
FIG. 34 is an explanatory view similar to FIG. 33, following FIG. 33.

Here, for example, when the file "03" described above is subjected to the selection operation, next, as a screen in a still lower hierarchy, an input screen which encourages input of the number of copies is displayed (D133: common in FIGS. 33 and 34). Here, immediately after the screen transition, the number of copies "00" is displayed as default. Thus, as shown in FIG. 34, from this state (D133), the user can designate the number of copies=1 (piece) by making determination (pressing the selection key) after inputting "1", for example, by operating the numeric key. Here, if the selection key is pressed (the determination is made) after the numeric value "0" is inputted (or nothing is inputted), the display returns to the same screen (D133) after error annunciation (for a predetermined period of time). Here, assuming that "1" is inputted and determined, next, a confirmation screen is displayed (D135) as a screen in a still lower hierarchy.

In this confirmation screen (D135), besides a title part similar to that described above, the file number of the file selected to be printed (here, the file "03"), the necessary size (here, "05.4 cm"), text contents (here, the first line "Chiyoda Elementary School", the second line "Class 2 in $2^{nd}$ grade" and the third line "Taro Suzuki") and the number of copies (here, "01 piece") are displayed.

Here, when determination is made (the selection key is pressed) after confirmation by the user, the message of "printing" is displayed (D11) together with the title part, the file number and the necessary size, in a manner similar to the case of the longitudinal direction printing described above in FIG. 6A. Thereafter, a corresponding print image (here, the print image G10 described above in FIG. 10B) is created and printed based on the file (here, the file "03"). Subsequently, the label L10 (see FIG. 10B) is produced by performing cuts (the half cut hc at the front end and the full cut fc at the rear end) in accordance with the settings indicated by the registered accompanying information (here, the entire label width LW=the entire print width PW=54 mm). Once the printing is finished, the display returns to the original text editing screen (D137: the same as D10 in FIG. 6A).

As described above, the tape printing apparatus 1 can selectively perform the longitudinal direction printing and the width direction printing. In the tape printing apparatus 1, text data (data) and accompanying information for creating a print image for "free width printing" (the width direction printing) are registered as corresponding files (here, the file "03"). Accordingly, when "file printing" (the width direction printing) is selected, a file to be printed (the file "03") among the registered files is designated. Thereafter, a corresponding print image (here, the print image G10) is created and printed based on the file "03." In this case, files for the width direction printing are prepared without diverting files for the longitudinal direction printing. Thus, contents (information) suitable for the width direction printing can be registered.

Moreover, the label width corresponding to the print image G10 (here, the entire label width LW=54 mm) is set before registration of the file "03" corresponding to the print image G10. Thereafter, the accompanying information is registered while including information on the label width (the entire label width LW=54 mm). Subsequently, cut processing is performed based on the information described above.

Therefore, even when the state of the screen (for example, D10 in FIG. 6A or the like) before moving to the function selection screen (for example, D20 in FIG. 7 or FIG. 33) is immediately after other operations are performed such as creation of files having label widths which are designated differently, it is possible to easily and quickly perform label production based on a desired individual setting (production of the label L10) just by reading the registered file (the file "03") without requiring resetting related to the width direction printing (here, at least the label width).

As described above, not only in the case of "entire label width designation" and "the entire label width LW=the entire print width PW=54 mm" (see FIG. 10A) but also in cases of other settings (see FIGS. 13A to 13C, 14A to 14C, 15A and 15B, 22A to 22C, 23A to 23C, 27A to 27C and 32A to 32C), various pieces of information related to the creation and printing of the print image as well as the label production are registered in the file registration of the respective files as the accompanying information of the respective files. Specifically, the various pieces of information include: information on various label widths which include the entire label width LW or which can derive the entire label width LW (information on the divided label number, the divided label width LW1 and the like); information on various print widths which include the entire print width PW or which can derive the entire print width PW (information on the number of lines of character strings, each line print width PW1 and the like); information on the reference position (the front end, the center or the rear end) in the case of "the entire label width LW≠the entire print width PW" (see FIGS. 13A to 13C, 14A to 14C, 15A and 15B, 22A to 22C, 23A to 23C, 27A to 27C and 32A to 32C); and the like.

Thus, in the tape printing apparatus 1, for example, even immediately after other operations are performed such as creation of files having different individual settings (especially, designations and settings related to the width direction printing such as the print width and the label width), it is possible to easily and quickly perform label production based on a desired individual setting just by reading the registered files without requiring resetting related to the width direction printing.

In the example described above in FIG. 34, the label of the file "03" is produced as one piece of label. However, in the case of producing the label as multiple labels (see FIGS. 14A to 14C, 15B, 23A to 23C, 27A to 27C, 31A to 31C and 32A to 32C), the message of "printing" is displayed in a format of "printing—x/y" (see FIG. 41: where y represents the number of labels to be produced and x represents which one of labels a portion in printing becomes). As a matter of course, in the case of producing one piece of label, similarly, the message may be displayed as "printing—1/1."

Moreover, in the example described above, only one piece (one time: one copy) of a desired label (the label corresponding to the file "03" in the example described above) is produced. However, the same label can be continuously (collectively) produced for multiple pieces (multiple copies).

Figure 35:
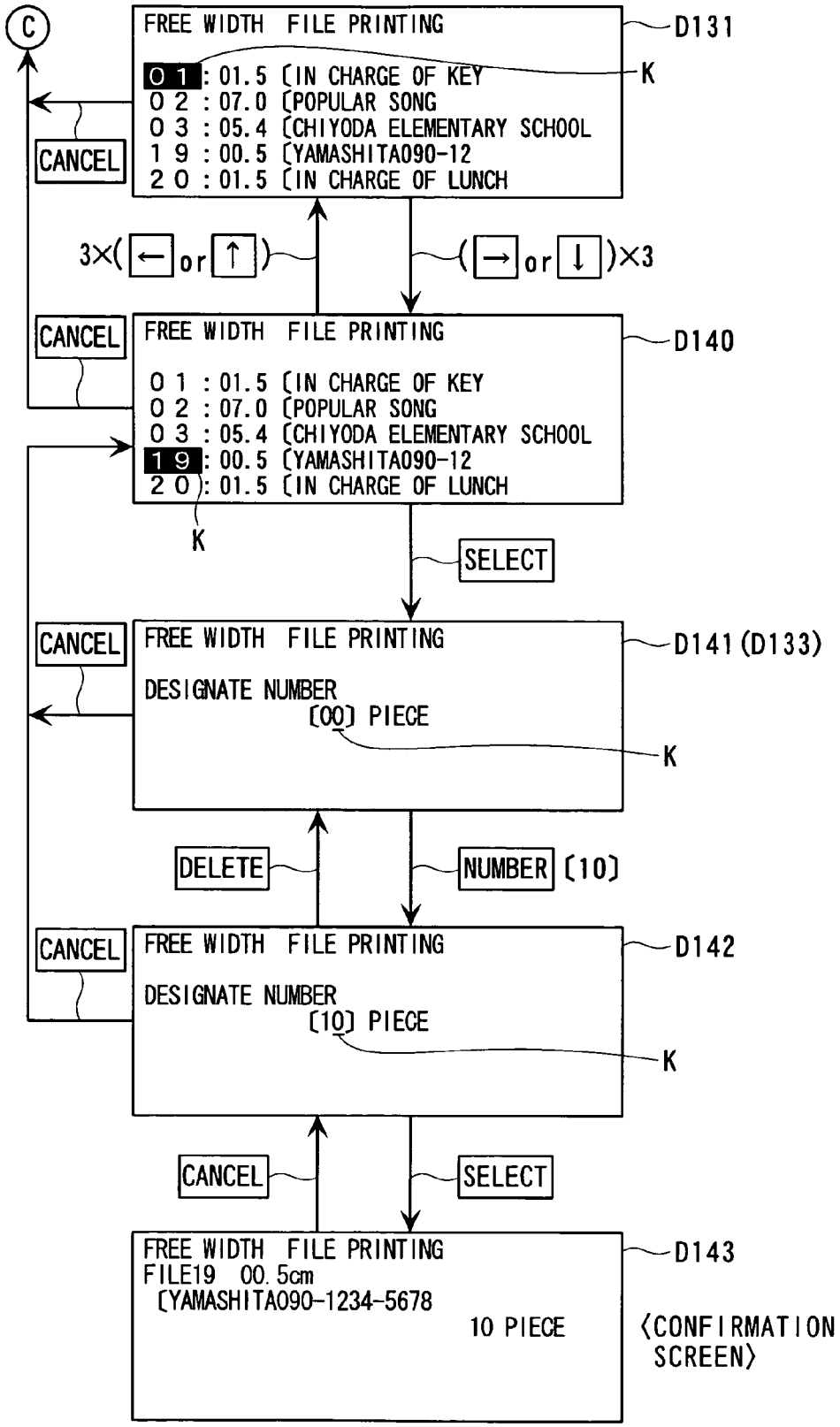
FIG. 35 is an explanatory view similar to FIG. 34, showing another example.

For example, as shown in FIG. 35, when the file "19" of the necessary size "00.5 cm" (5 mm), for example, is subjected to the selection operation (D140) from the print file selection screen (D131: common to FIG. 33), an input screen of the number of copies in a lower hierarchy is displayed (D141: the same as D133 in FIG. 33 or the like). Thus, for example, when the number "10" is inputted (D142) and determination is made (the selection key is pressed), and the number of copies=10 pieces is set. Next, as a screen in a still lower hierarchy, a confirmation screen is displayed (D143: common in FIGS. 35 and 36). In this confirmation screen (D143), besides the title part of "free width file printing", the file to be printed "19", the necessary size "00.5 cm", the text content "Yamashita 090-1234-5678" and the number of copies "10 pieces" are displayed.

Figure 36:
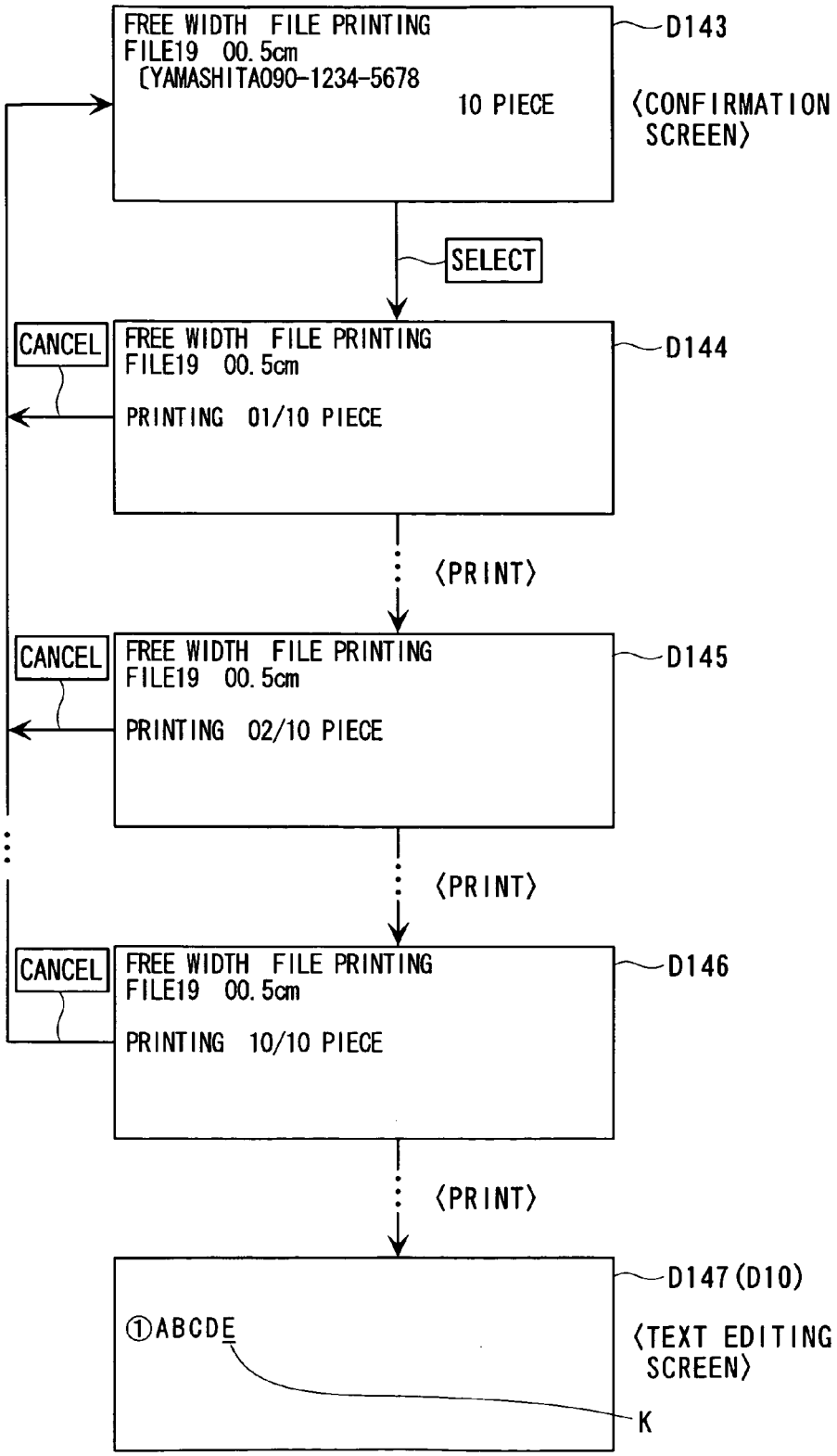
FIG. 36 is an explanatory view similar to FIG. 33, following FIG. 35.
Figure 37:
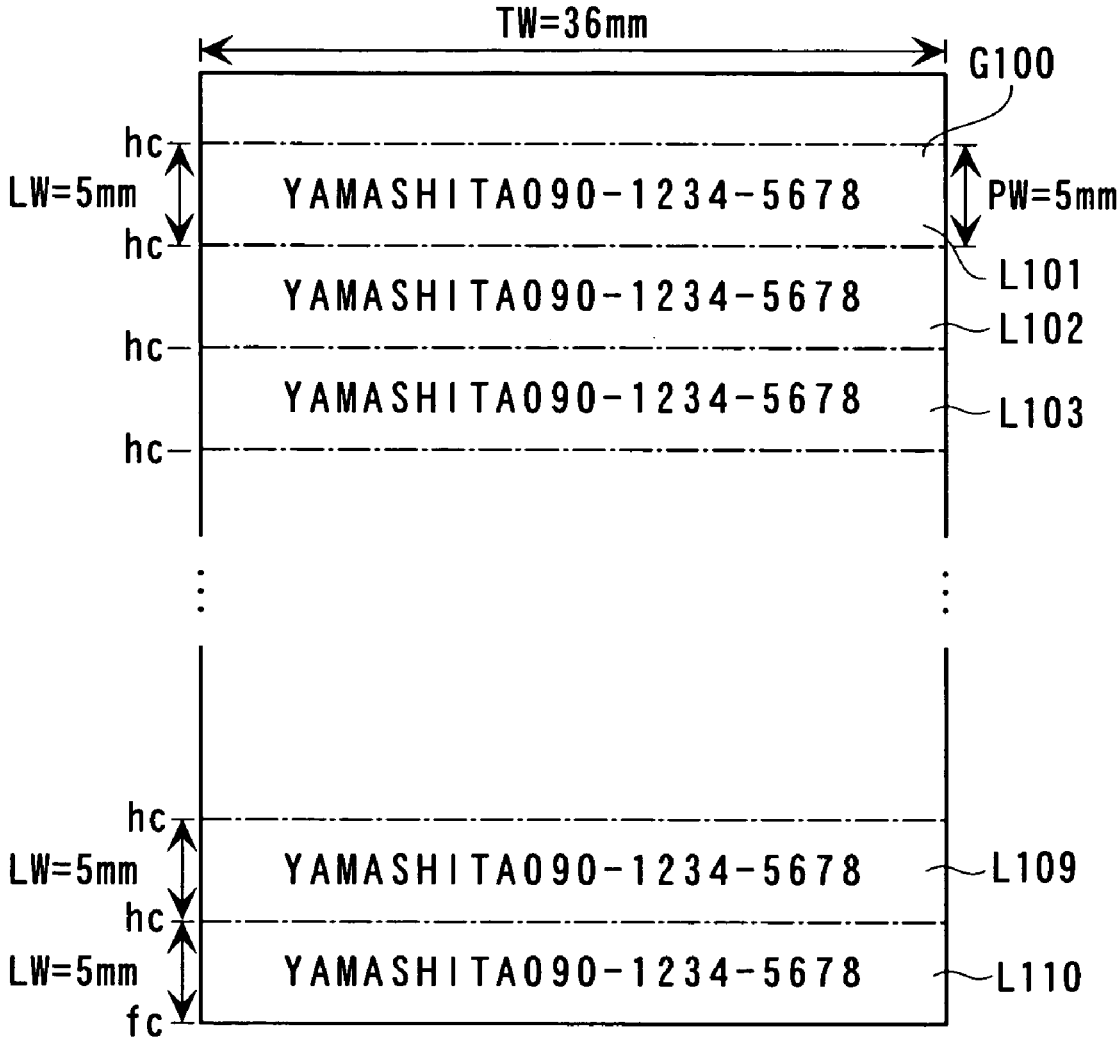
FIG. 37 is an explanatory view similar to FIGS. 10A and 10B, showing one example in the case of performing "file creation" by the method of FIGS. 35 and 36.

As shown in FIG. 36, determination is made from the state described above (D143) after confirmation by the user. Thereafter, the message of "printing" is displayed together with the title part, the file number and the necessary size as well as which piece/total number of copies (here, 01/10 pieces to 10/10 copies) in printing is displayed (D144 to D146). Subsequently, as shown in FIG. 37, based on the file "19", a corresponding print image G100 is created and the print image G100 is printed for the designated number of copies=10 pieces. Along with the printing, 10 pieces of labels L101 to L110 are produced by performing cuts (however, the full cut fc is performed only at the last and the half cut hc is performed in the middle) in accordance with the setting indicated by the accompanying information registered for each time of printing one piece (the entire label width LW=the entire print width PW=5 mm). Once the printing is finished, the display returns to the original text editing screen (D147: the same as D10 in FIG. 6A).

As described above, in the tape printing apparatus 1, it is possible to set the number of repetitions of printing (so-called the number of copies or the number of sets) for a print image (the print image G100) which corresponds to a file to be printed (the file "19" in the example described above). Accordingly, the same print image (G100) is repetitively printed for this number of repetitions. Thereafter, every time the print image is printed, cutting processing (the half cut hc in the example described above) is performed for separating respective labels, which correspond to the respective printed print images, from each other. Thus, the same labels can be easily and quickly produced for the number of necessary and desired copies (sets).

The example described above is an example of continuously (collectively) creating multiple pieces (multiple sets) of the same labels. However, when multiple types of files having different contents from each other are classified by the file number and the like and registered, several types thereof can be collectively designated and several types of labels corresponding to the designated several types of files can be also continuously (collectively) produced. This is the function of "file multiple printing", which will be described below.

Figure 38:
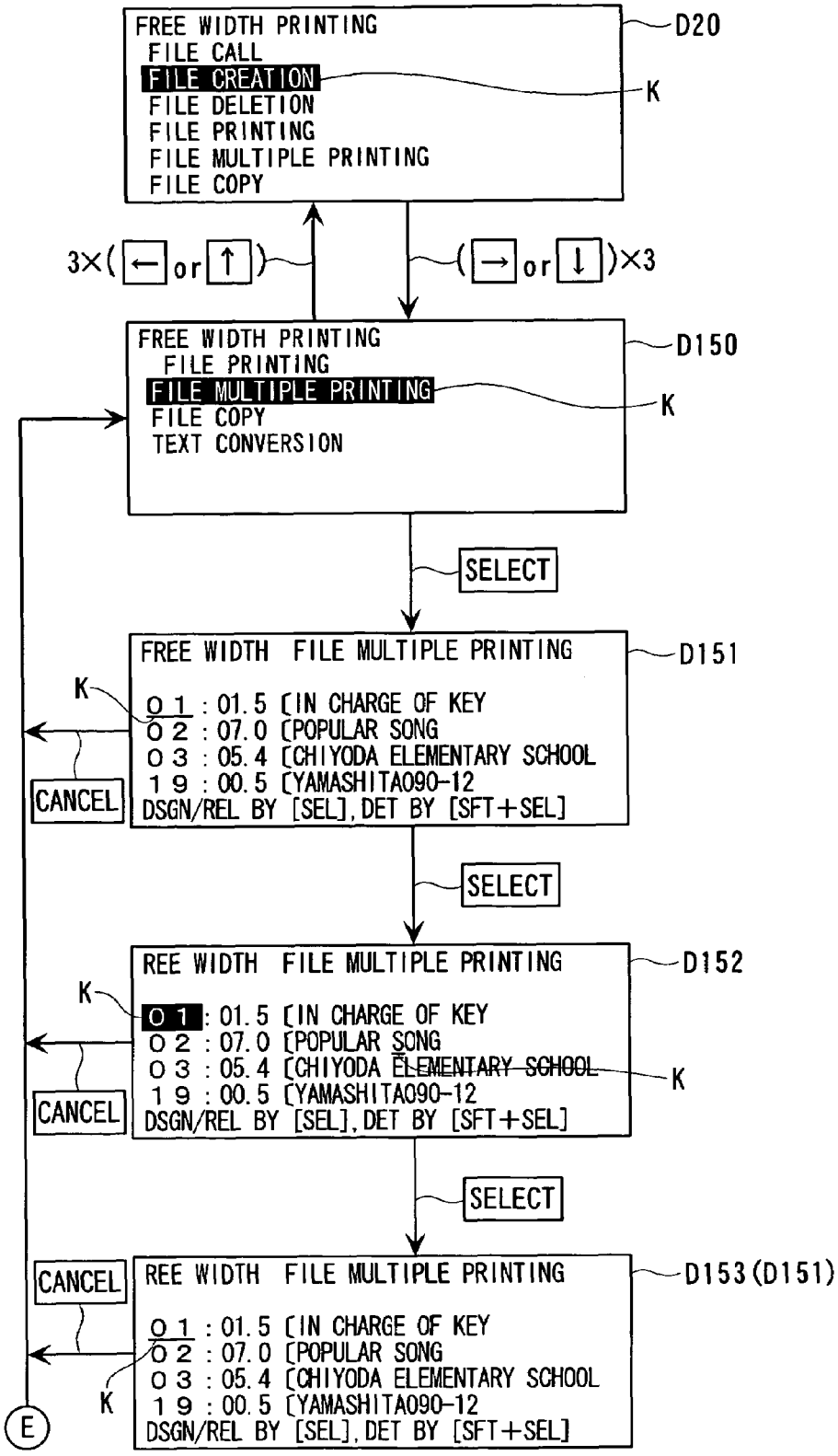
FIG. 38 is an explanatory view similar to FIG. 7, showing one example in the case of performing "file multiple printing" among the functions of "free width printing"

For example, as shown in FIG. 38, "file multiple printing" is subjected to selection display (D150) from the state in which "file creation" is subjected to the selection display in the function selection screen (D20: common in FIG. 7, FIG. 33 and the like) and determination is made. Next, as a screen in a lower hierarchy, a selection screen (collective print file selection screen) is displayed (D151), which is similar to the print file selection screen (D131) described above in FIG. 33 or the like.

In this selection screen (D151), together with the title "file multiple printing", the registered file is displayed in a format similar to that described above. In addition, in a manner similar to the example described above, the negative display of the file number is the display for selection (selection display). However, in this case, the cursor position immediately after the screen transition (the file number of the file "01" in the example shown in FIG. 38) is not subjected to the negative display but is subjected to the negative display when the selection key is first pressed. Thereafter, every time the selection key is pressed, the cursor position is displayed by being inverted as positive display→negative display→positive display→negative display→ . . . (D151 to D153: D153 is common to FIG. 39). Specifically, every time the selection key is pressed, the selection display (negative display) and cancel thereof (positive display) are switched therebetween.

Figure 39:
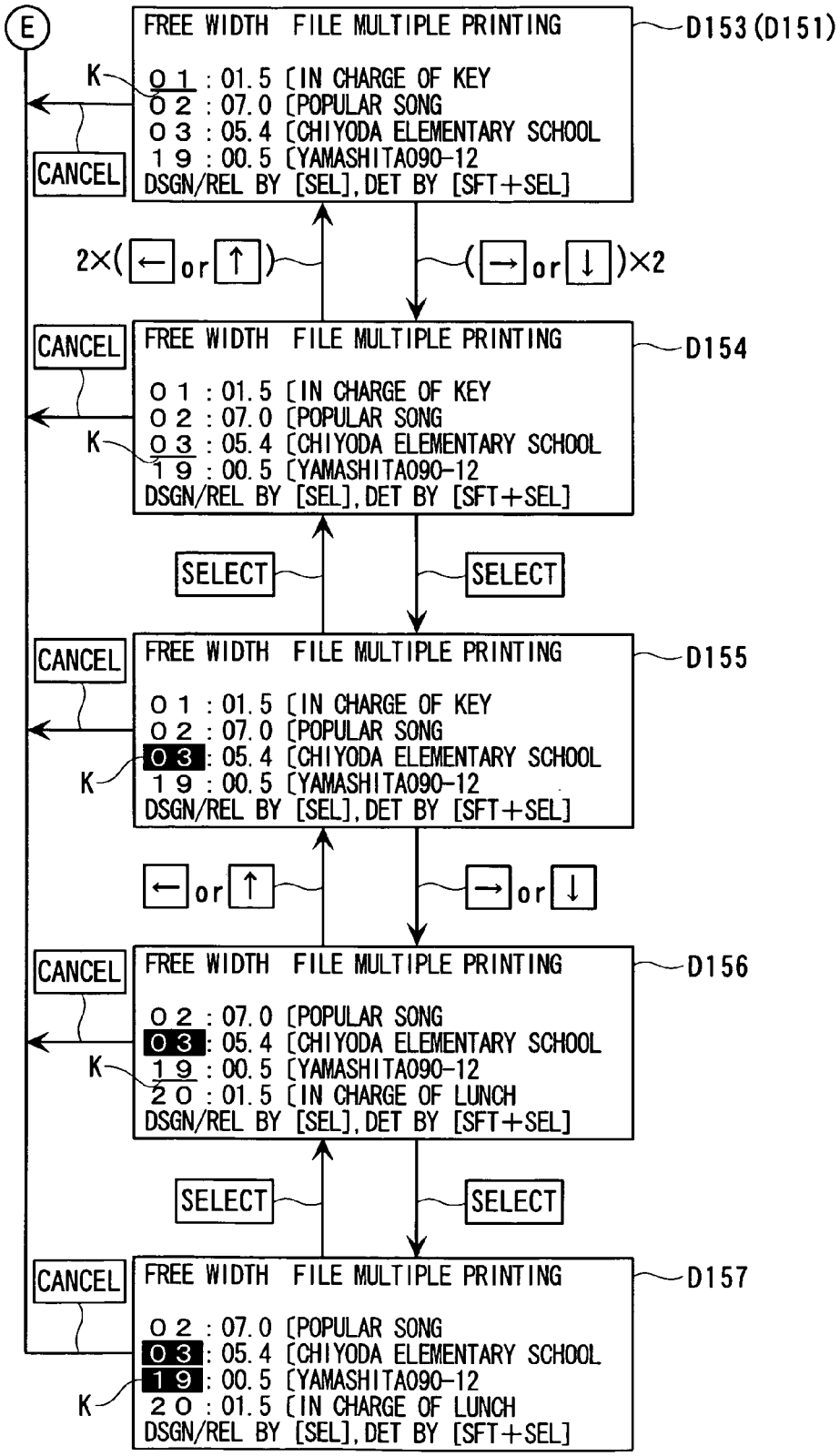
FIG. 39 is an explanatory view similar to FIG. 38, following FIG. 38.

Next, for example, as shown in FIG. 39, from the state in which the selection of the file "01" described above is canceled (D153), the user operates the cursor to designate (the file number of) the file "03" (D154) and select the file by using the selection key (D155). Thereafter, the user can designate (the file number of) another file by operating the cursor while subjecting the file "03" to the selection display. Here, for example, when the user designates the next file "19" by the cursor (D156) and selects the file (by using the selection key), the file "19" is subjected to the selection display (negative display) in addition to the file "03" (D157: common in FIGS. 39 and 40).

Figure 40:
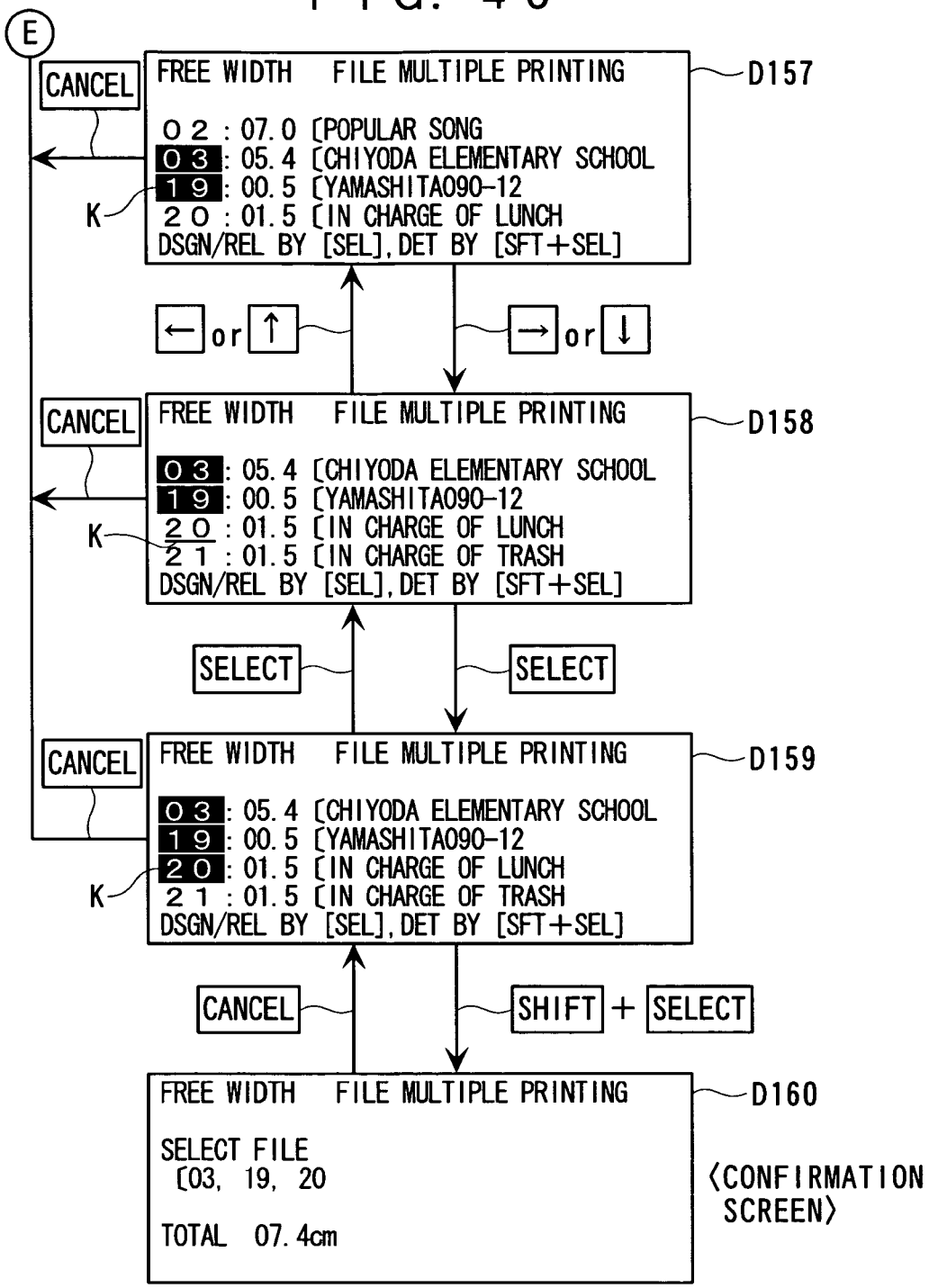
FIG. 40 is an explanatory view similar to FIG. 38, following FIG. 39.

Next, as shown in FIG. 40, for example, from the state described above (D157), the next file "20" is furthermore designated by the cursor (D158) and selected. Then, the file "20" is subjected to the selection display (D159).

Thereafter, when determination is made by using shift key+selection key from the state described above (D159), three of the files "03", "19" and "20" are collectively determined (set) as designated (collective printing) files to be printed. Next, as a screen in a still lower hierarchy, a confirmation screen is displayed (D160: common in FIGS. 40 and 41). In this confirmation screen (D160), besides the title part "free width file multiple printing", the file to be printed "selected file [03, 19, 20]" and the necessary size "total 07.4 cm" are displayed. Here, the necessary size "07.4 cm" (74 mm) is a total of the respective necessary sizes "05.4 cm" (54 mm), "00.5 cm" (5 mm) and "01.5 cm" (15 mm) of the selected files "03", "19" and "20."

Figure 41:
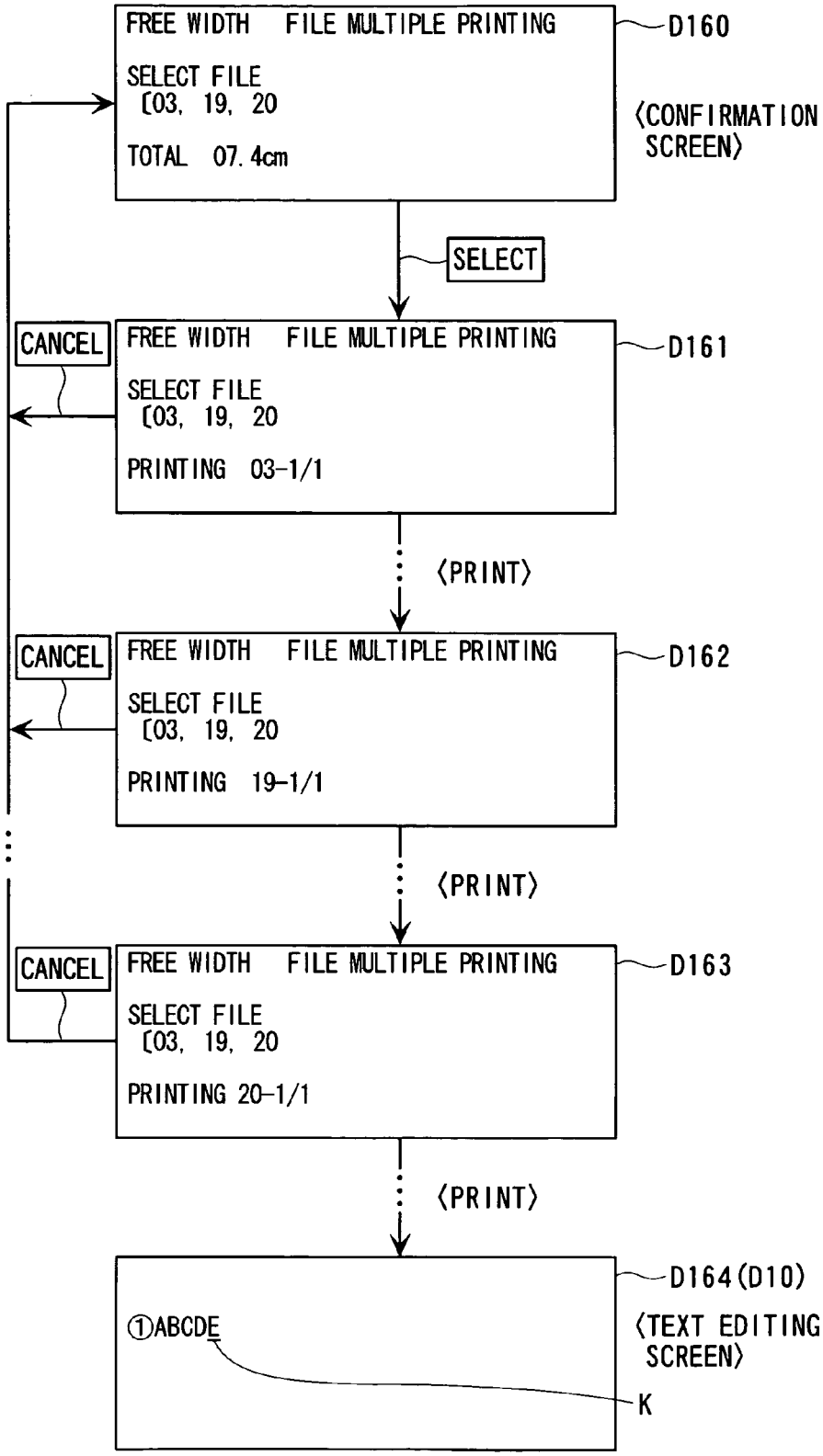
FIG. 41 is an explanatory view similar to FIG. 38, following FIG. 40.
Figure 42:
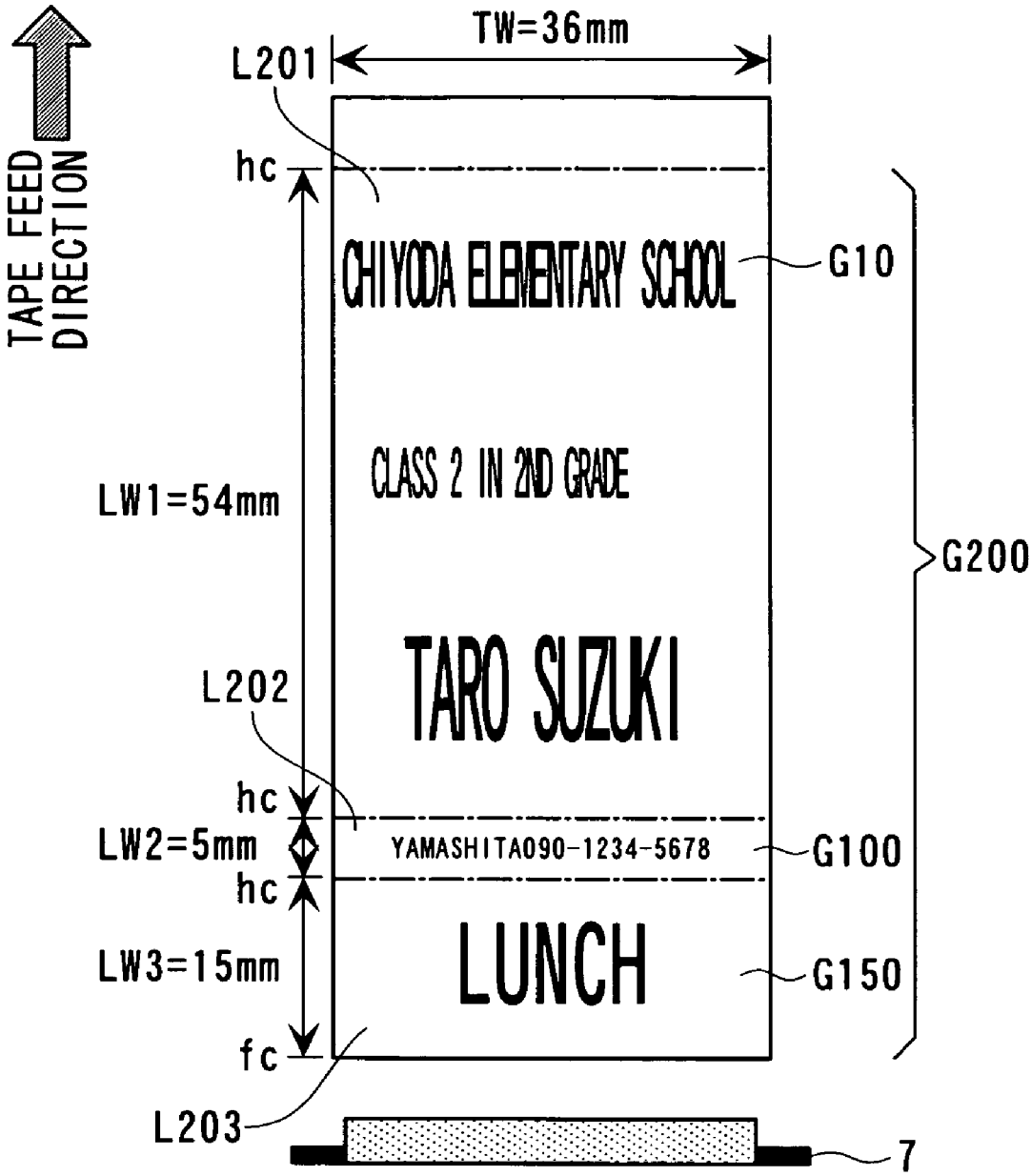
FIG. 42 is an explanatory view similar to FIG. 10A, showing one example in the case of performing "file creation" by the method of FIGS. 38 to 41.

Next, for example, as shown in FIG. 41, determination is made from the state described above (D160) after confirmation is made. Thereafter, together with the title part and the selected file number, the message of "printing—x/y" (y: the number of labels to be produced while corresponding to each file and x: which one of labels) is displayed (D161 to D163). Along with the display of the message, as shown in FIG. 42, in accordance with the setting information related to the label width and the print width, which is indicated by accompanying information of the files "03", "19" and "20", respective print images G10, G100 and G150 corresponding thereto (or a print image G200 obtained by combining those images) are created and printed. Thereafter, cut processing is performed (the full cut fc is performed only at the last and the half cut hc is performed in the middle). Thus, desired labels L201 to L203 are produced. Once the printing is finished, the display returns to the original text editing screen (D164: the same as D10 in FIG. 6A).

As described above, in the tape printing apparatus 1, when there exist multiple types of the registered files, several files thereof (the three files "03", "19" and "20" in the example described above) can be collectively designated as the files to be printed. When the files are collectively designated, multiple print images corresponding thereto (the above-described print images G10, G100 and G150) are continuously printed (or the combined print image G200 is printed). Thereafter, the cut processing (the half cut hc in the example described above) is performed for separating the respective labels, which correspond to the printed multiple print images, respectively, from each other. Thus, just by collectively designating the corresponding files, it is possible to easily and quickly produce desired multiple types of labels continuously (collectively).

The tape printing apparatus 1 can perform the half cut hc and the full cut fc as described above in FIG. 4 and the like. In the respective examples described above including the previous example, when there are a plurality of labels to be continuously produced (see FIGS. 14A to 14C, 15B, 23A to 23C, 27A to 27C, 31A to 31C, 32A to 32C, 37 and 42), as the cut processing, only the rear end of the last label is subjected to the full cut fc and the other positions (between the respective labels and the like) are subjected to the half cut hc. Thus, in the case of collectively managing the produced labels after all the cutting is finished, the labels can be managed as one piece of tape up to the position in which the full cut fc is performed. Moreover, since the respective labels are subjected to the half cut hc between each other, the user can attach the label when he/she wishes to attach by peeling off only the label he/she wishes to attach. Accordingly, the labels become a label (group) which is easily managed.

Figure 43:
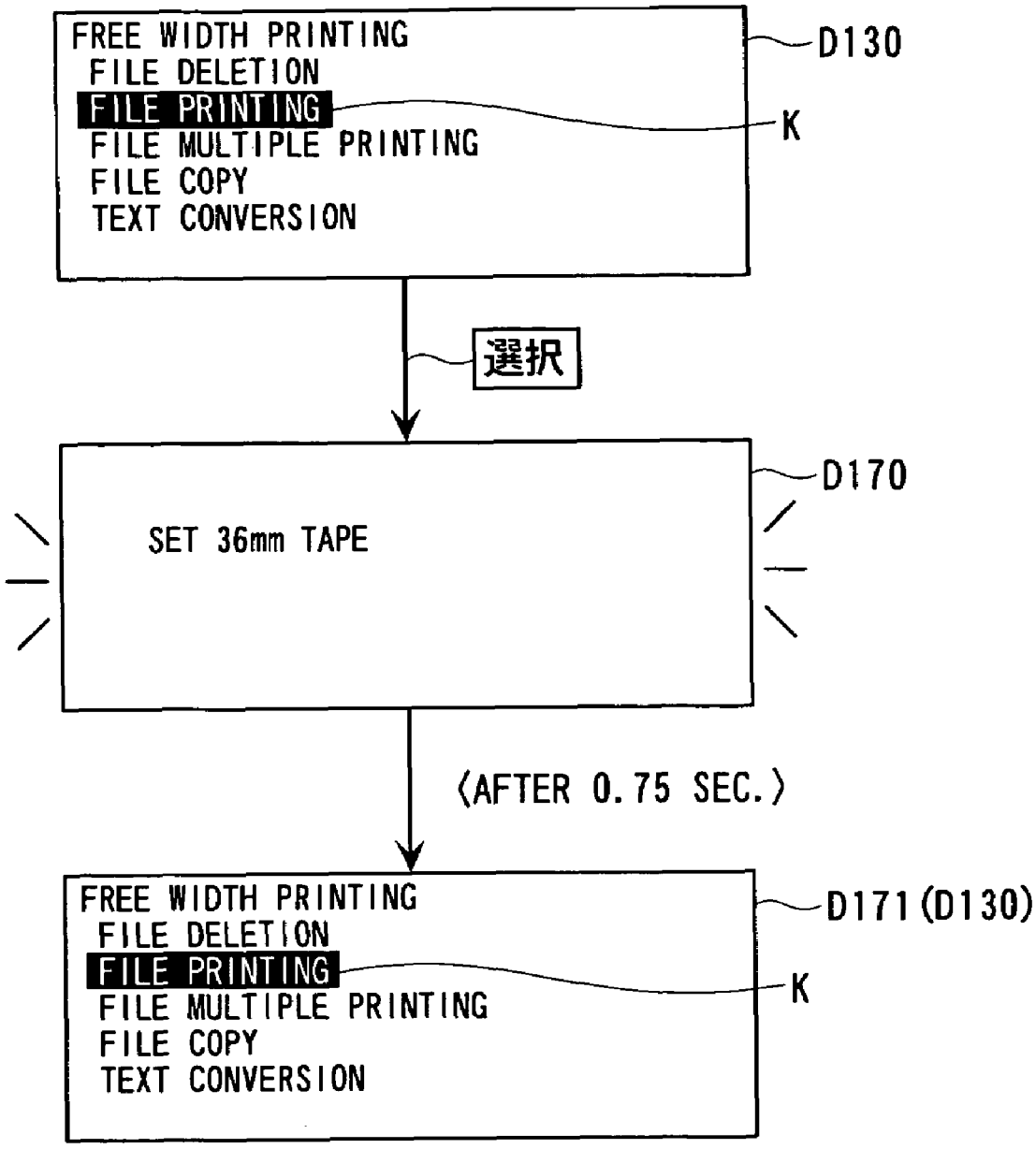

The option "free width printing" described above is the width direction printing and is the function which is more advantageous when the tape width TW is wider. Thus, in terms of specifications, for example, the tape width TW may be defined such as the tape width TW≧36 mm. Alternatively, the tape width TW may be further limited such as only the tape width TW=36 mm. In such a case, for example, as shown in FIG. 43, when the tape having the predetermined tape width TW=36 mm is not mounted at the point in which "file printing" (D130: common to FIG. 33) or "file multiple printing" (see D150 in FIG. 38) is subjected to the selection operation in the function selection screen, error (warning) annunciation and flashing display to that effect may be displayed (D170) and the screen may return to its original state (D171: the same as D130 and the like) after a predetermined period of time (for example, 0.75 second).

The text editing screen (D10) described above in FIG. 6A or the like is, so to speak, the screen for inputting texts for the longitudinal direction printing (see FIG. 6B) to editing. The screen for inputting texts for "free width printing" (the width direction printing) to editing is separately provided (see D40 and D41 in FIG. 9, D40 to D44 in FIG. 11, D52 in FIG. 12, D61 to D71 in FIGS. 16 to 18, D75 to D80 in FIG. 20, D100 and D101 in FIG. 26, D123 in FIG. 30 and the like). In addition, the methods for using the screens described above (the methods for printing and the like) are different from each other (see FIG. 6A, FIG. 33 and the like for comparison). Thus, basically, the text data of the files created for "free width printing" may be registered in a different form from that of the text data for the longitudinal direction printing. Meanwhile, in the tape printing apparatus 1, high convenience is achieved by making it possible to divert (the text data of) the files registered for "free width printing" described above also to the longitudinal direction printing.

Since the function described above is for converting the form of the data or the like as described above, the function may be called "data conversion" or the like. Alternatively, since the function converts the form of the files or the like in the case of storing (or registering) the files, the function can be also called "file conversion" or the like. Here, the function develops converted text data in a text editing region for the longitudinal direction printing and displays the data in the text editing screen. Thus, the function will be described below by using a name of "text conversion."

Figure 44:
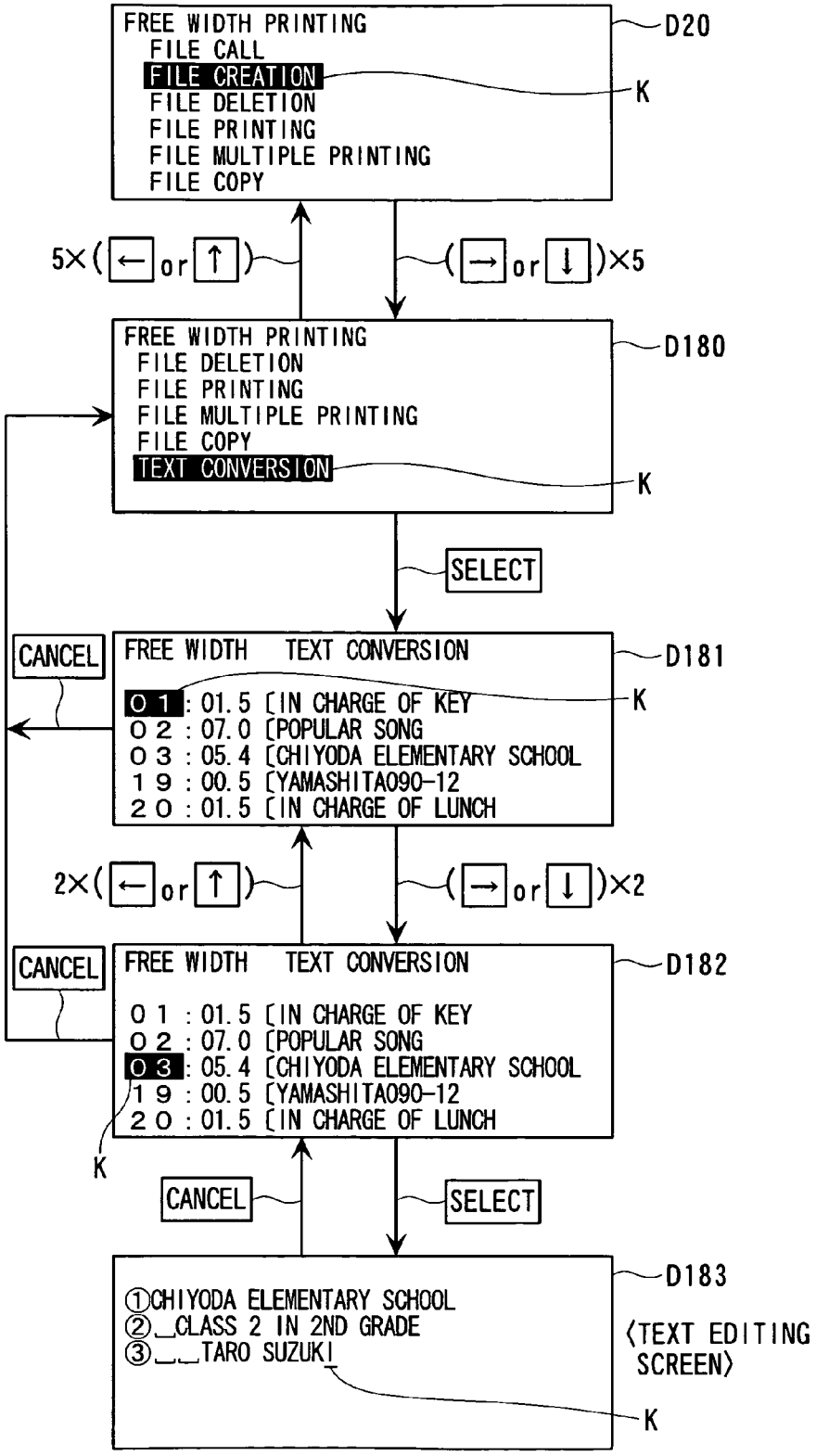
FIG. 44 is an explanatory view similar to FIG. 7, showing one example in the case of performing "file multiple printing" among the functions of "free width printing"

For example, as shown in FIG. 44, "text conversion" is subjected to selection display (D180) from the state in which "file creation" is subjected to the selection display in the function selection screen (D20: common in FIGS. 7, 33, 38 and the like) and determination is made. Next, as a screen in a lower hierarchy, a selection screen (conversion file selection screen) is displayed (D181), which is similar to the print file selection screen (D131 and D151) and the like which are described in FIGS. 33, 38 and the like.

In this selection screen (D181), together with the title display of "text conversion", the registered files are displayed in a format similar to that described above and selected. Here, for example, when the file "03" described above is subjected to the selection display (D182) and determination is made, the text data of the selected file "03", i.e., the text data including the first line "Chiyoda Elementary School", the second line "Class 2 in $2^{nd}$ grade" and the third line "Taro Suzuki" is developed in the text editing region for the longitudinal direction printing. Thereafter, the text data is displayed in a form which conforms to the text editing screen for display thereof (D183).

As described above, in the tape printing apparatus 1, high convenience is achieved since it is made possible to divert (the text data of) the files created and registered for "free width printing" (the width direction printing) also to the longitudinal direction printing. Moreover, the tape printing apparatus 1 is designed to easily perform creation, editing and printing of the print image as well as label production not only in the width direction printing but also in the longitudinal direction printing. Thus, high operability and working efficiency are achieved.

Accordingly, the various processing methods described above (label producing method, file processing method such as file creation, registration and printing, text conversion method and the like) are applicable as programs which are processed by various tape printing apparatuses capable of program processing. Moreover, the methods are also applicable to storage media such as a CD, an MD and a DVD, for example, for storing such kinds of programs. Accordingly, these kinds of programs are previously stored or read from the storage medium or the like and executed. Thus, based on the files which are registered for "free width printing" (the width direction printing) and selected and designated for printing, it is possible to easily and quickly perform creation, editing and printing of a print image suitable for the width direction printing as well as label production. In addition, by using the files, the accompanying information thereof and the like, it is possible to freely set various combinations of the label width and the print width in performing the label production by the width direction printing. Moreover, it is possible to easily and quickly perform label production based on a desired individual setting just by reading the registered files without requiring resetting related to the width direction printing. Furthermore, it is possible to improve convenience and working efficiency since the data of the files prepared and registered for the width direction printing can be diverted to the longitudinal direction printing. Thus, effects such as those described above are obtained. As a matter of course, aside from those described above, changes can be made accordingly without departing from the scope of this invention.

In the embodiments described above (the first to fourth embodiments), the stand-alone tape printing apparatus has been described as an example. Meanwhile, a configuration (system), in which a similar tape printing apparatus is connected to a supply unit for preparing and supplying image data of a print image (print image data) by using predetermined communication means, can be also viewed as one tape printing apparatus. As a fifth embodiment, a description will be given below of this type of tape printing apparatus (hereinafter referred to as a "printing system" so as to make a distinction from the stand-alone tape printing apparatus).

Figure 45:
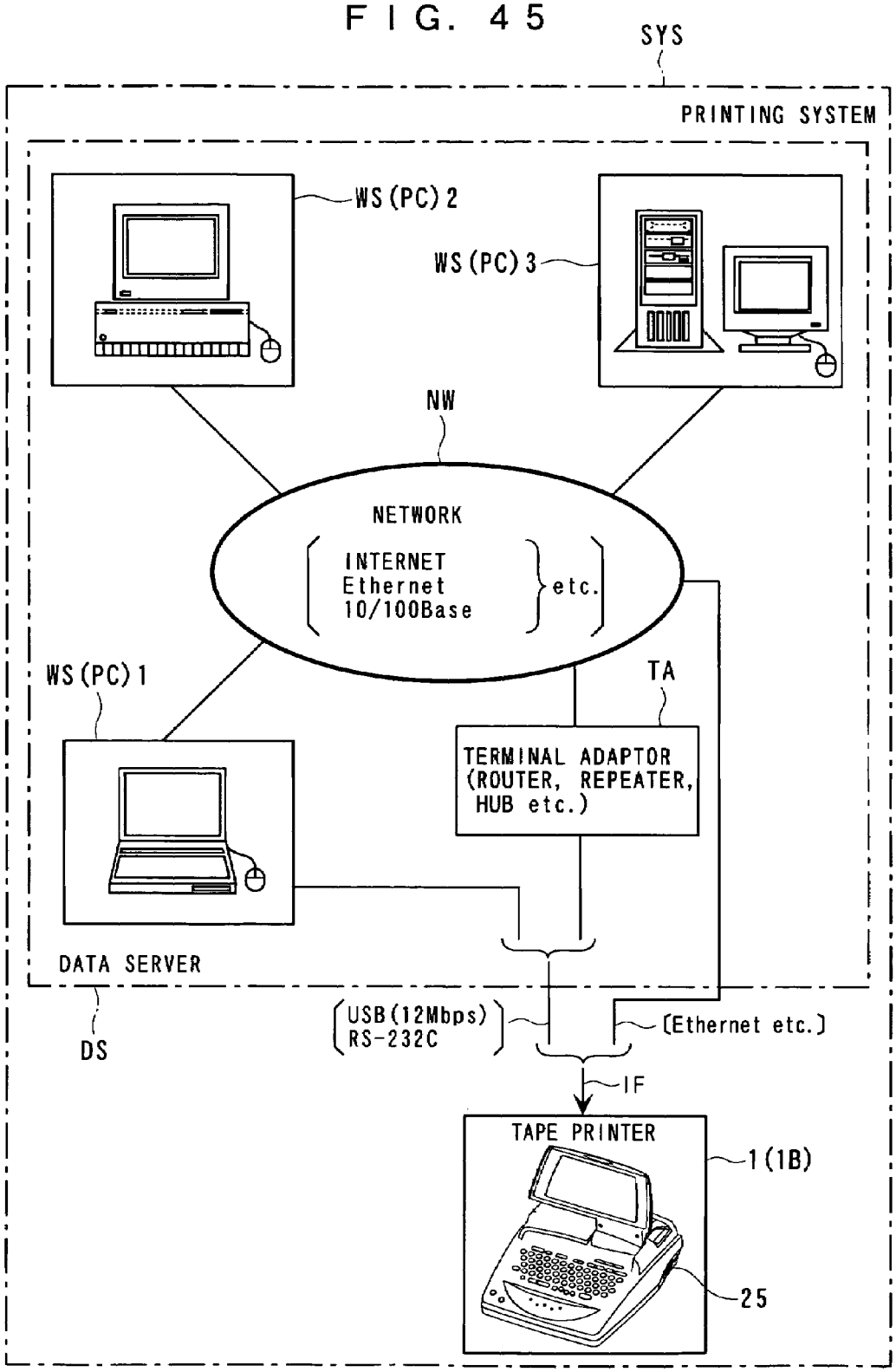
FIG. 45 is an explanatory view showing a first configuration example of a printing system according to a fifth embodiment.
Figure 46:
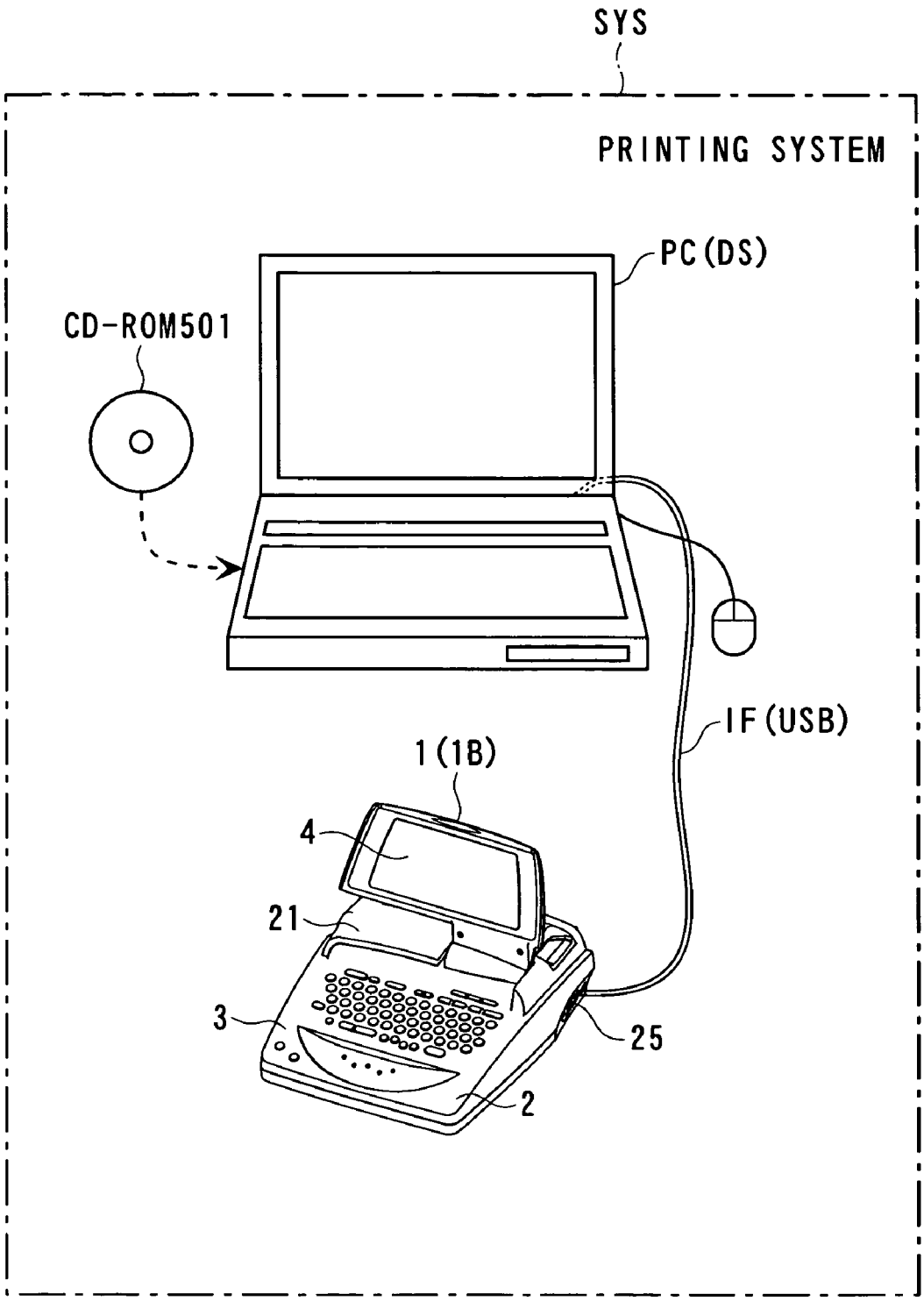
FIG. 46 is an explanatory view similar to FIG. 45, showing a second configuration example.

As shown in FIGS. 45 and 46, first, the tape printing apparatus 1 of this embodiment (it is assumed that the tape printing apparatus of the first to fourth embodiments is 1A and that of the fifth embodiment is 1B when a distinction is made therebetween) is connected to a data server (supply unit) DS through an interface IF and is included in the printing system SYS as a whole. The data server DS supplies the tape printing apparatus 1 (1B) with print image data to be printed.

Thus, as shown in FIG. 45, for example, the data server DS includes a network NW, a plurality of work stations WS (a personal computer PC and the like) 1 to 3, a terminal adaptor (including a router, a repeater, a hub and the like) TA and the like, all of which are connected to each other around the network NW. Specifically, the plurality of work stations WS and the terminal adaptor TA become terminals. The tape printing apparatus 1 may be connected to any of these terminals through the interface IF or may be connected directly to the network NW as the interface IF. In this case, as the network NW, one according to communication protocols compliant with the IEEE standard LAN, for example, so-called the Internet and various local area networks (LAN: Ethernet (trademark), 10/100 Base and the like) can be adopted. Moreover, the interface IF through the terminals may be of either serial data communication (RS-232C, USBs, IEEE1394 and the like) or parallel data communication (Centronics and the like). Although these communications are standards of wire communication, wireless communication can be also utilized.

Alternatively, as a simpler configuration, the data server DS may be a stand-alone unit. For example, as shown in FIG. 46, the printing system SYS can be configured just by connecting a stand-alone personal computer PC and the tape printing apparatus 1 (1B) with each other by using the interface IF such as the USB. In the configuration of FIG. 45 (the first configuration), print image data prepared (stored) in the respective devices (WS 1 to 3, TA and the like) in the data server DS is supplied and printed. On the other hand, in the configuration of FIG. 46 (the second configuration), print image data stored in the personal computer PC (the data server DS), for example, is supplied and printed.

Figure 47:
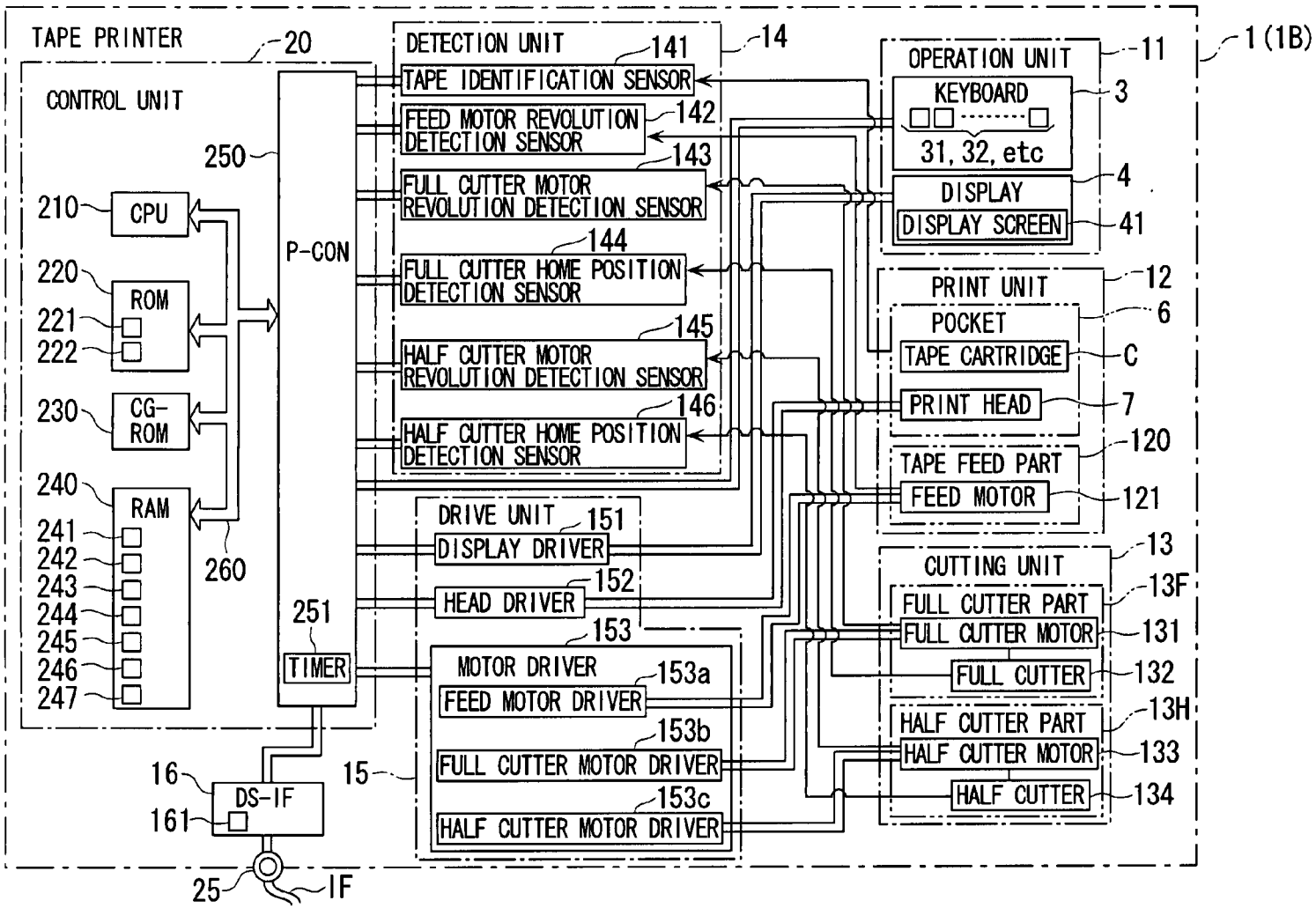
FIG. 47 is a block diagram schematically showing a control system of a tape printing apparatus according to the first and second configuration examples of FIGS. 45 and 46.

The printing system SYS having the relatively simple second configuration shown in FIG. 46 will be mainly described below. Here, as shown in FIG. 47, the tape printing apparatus 1 (1B) has a configuration in which a data supply interface (DS-IF) 16 is added to a similar configuration to that of the tape printing apparatus 1 (1A) of the first embodiment (see FIG. 3). Specifically, the data supply interface 16 communicates with the data server DS through a USB connector 25 from the interface IF (by using a USB cable) based on USB specifications (protocols).

The DS-IF 16 has a receive buffer 161 for receiving various data (the print image data and the like) from the data server DS. Moreover, a P-CON 250 takes various detection signals from the detection unit 14 described above in FIG. 3, various instructions from the keyboard 3, input data and the like into the internal bus 260. In addition, the P-CON 250 is connected to the DS-IF 16 and takes control signals, various (download) data and the like from the data server DS into the internal bus 260. Specifically, the data, signals and the like described above are taken into the internal bus 260 directly or after being processed. At the same time, in conjunction with the CPU 210, the P-CON 250 outputs data and control signals, which are outputted to the internal bus 260 from the CPU 210 and the like, directly or after being processed, to the drive unit 15 described above and the DS-IF 16.

Accordingly, for example, in the data server DS having the second configuration shown in FIG. 46, a text editing screen similar to the text editing screen (D10) of the character string "ABCDE" described in FIG. 6A is displayed in the case of the longitudinal direction printing. Alternatively, when the user gives a predetermined print instruction (by pressing the print key or the like) in a state in which a print image G00 is displayed as an image screen display or the like, the data server DS displays a message of "printing" and the like. At the same time, the data server DS transmits, through the interface IF, print image data of the print image G00 of the character string "ABCDE" and cut instruction data (a cut instruction signal) for instructing a type of a required cut and timing (here, the full cut fc for the rear end in the tape feed direction in FIG. 6B).

Meanwhile, in the tape printing apparatus 1 (1B), while receiving the print image data of the print image G00 and the cut instruction signal by the DS-IF 16, the print image G00 is printed and a label L00 is produced by performing the full cut fc at the rear end. 0239

In terms of specifications, print image creation data (text data, element image data and the like) for creating the print image G00 may be directly transmitted to the tape printing apparatus 1 from the data server DS through the interface IF. Thereafter, the tape printing apparatus 1 may execute processing from creation of (the print image data of) the print image G00 to label production. Moreover, a form of the data for creating the print image G00 may be selected between a form of the print image data and a form of the print image creation data described above.

Next, as to the width direction printing, the functions other than those concerning printing (file printing and file multiple printing) among the functions of "free width printing" described above (see D20 in FIG. 7 and the like), for example, are processed only by the data server DS. Moreover, in the data server DS, for example, when the user instructs "file printing" or "file multiple printing", which are described above in FIGS. 33 to 36, FIGS. 38 to 41 and the like, a message similar to that of "printing" or the like is displayed. At the same time, based on the designated file, the data server DS transmits, through the interface IF, the print image data of the print image G10 or the like (see FIGS. 13A to 13C, 14A to 14C, 15A, 15B, 22A to 22C, 23A to 23C, 27A to 27C, 32A to 32C, 37, 42 and the like) and the cut instruction signal for performing cuts (the half cut hc and the full cut fc).

Meanwhile, in the tape printing apparatus 1 (1B), while receiving the print image data of the print image G10 or the like and the cut instruction signal by the DS-IF 16, the print image G10 or the like is printed and the label L10 or the like is produced by performing the cut processing.

As described above, also in the printing system SYS, based on the files which are registered for "free width printing" (the width direction printing) and selected and designated for printing, it is possible to easily and quickly perform creation, editing and printing of a print image suitable for the width direction printing as well as label production. In addition, by using the files, the accompanying information thereof and the like, it is possible to freely set various combinations of the label width and the print width in performing the label production by the width direction printing. Moreover, it is possible to easily and quickly perform label production based on a desired individual setting just by reading the registered files without requiring resetting related to the width direction printing. Thus, effects such as those described above are obtained.

Also in the case of "free width printing" (the width direction printing), in terms of specifications, the data of the files which are selected (designated) to be printed in "file printing" and the like (the print image creation data (the text data, the element image data and the like) and the accompanying information thereof (the information on the label width, the print width, the reference position and the like)) may be directly transmitted through the interface IF. Thus, the tape printing apparatus 1 may execute processing from creation of (the print image data of) the print image G10 or the like to label production. Moreover, also in this case, a form of the data to be transmitted may be selected between a form of the print image data and a form of the file data described above.

Moreover, in the example described above, a description is given of the case in which the files are created and prepared (registered and stored) in the data server DS. However, as shown in FIG. 46, the files can be also supplied as already created files by using a compact disk (a CD or a CD-ROM) 501 or the like from the outside. In this case, various files can be prepared just by replacing the CD-ROM 501 with a new one. Alternatively, the files can be changed in accordance with purposes and the like.

Moreover, control programs for various processing (processing programs: dedicated application programs) may be previously prepared (stored) in the data server DS. Alternatively, the control programs may be stored in the CD-ROM 501 independently or with files and the like and may be run (after being downloaded or the like). Furthermore, in this case, if the control programs are applications which can be executed by a general operation system (OS), the programs can be used just by mounting the CD-ROM 501 in a personal computer or the like which includes the OS.

Although the CD-ROM is described as an example in the example described above, other storage media such as an FD, an MD and a DVD may be used. Moreover, unlike the configuration of FIG. 46, when the network NW is utilized as shown in FIG. 45, various files and various programs can be received from various other devices (WS2, WS3 and the like in the example shown in FIG. 45), which are connected to the network NW, through the network NW or through devices directly connected to the tape printing apparatus 1 (the supply unit: PC1 or TA in the example shown in FIG. 45). Thus, just by receiving from the various devices, various new files and programs can be stored (prepared) and changed. Moreover, in these cases, the programs at the data server DS side can also include programs at the tape printing apparatus 1 side, a part of which can be downloaded and utilized by the tape printing apparatus 1.

Figure 48:
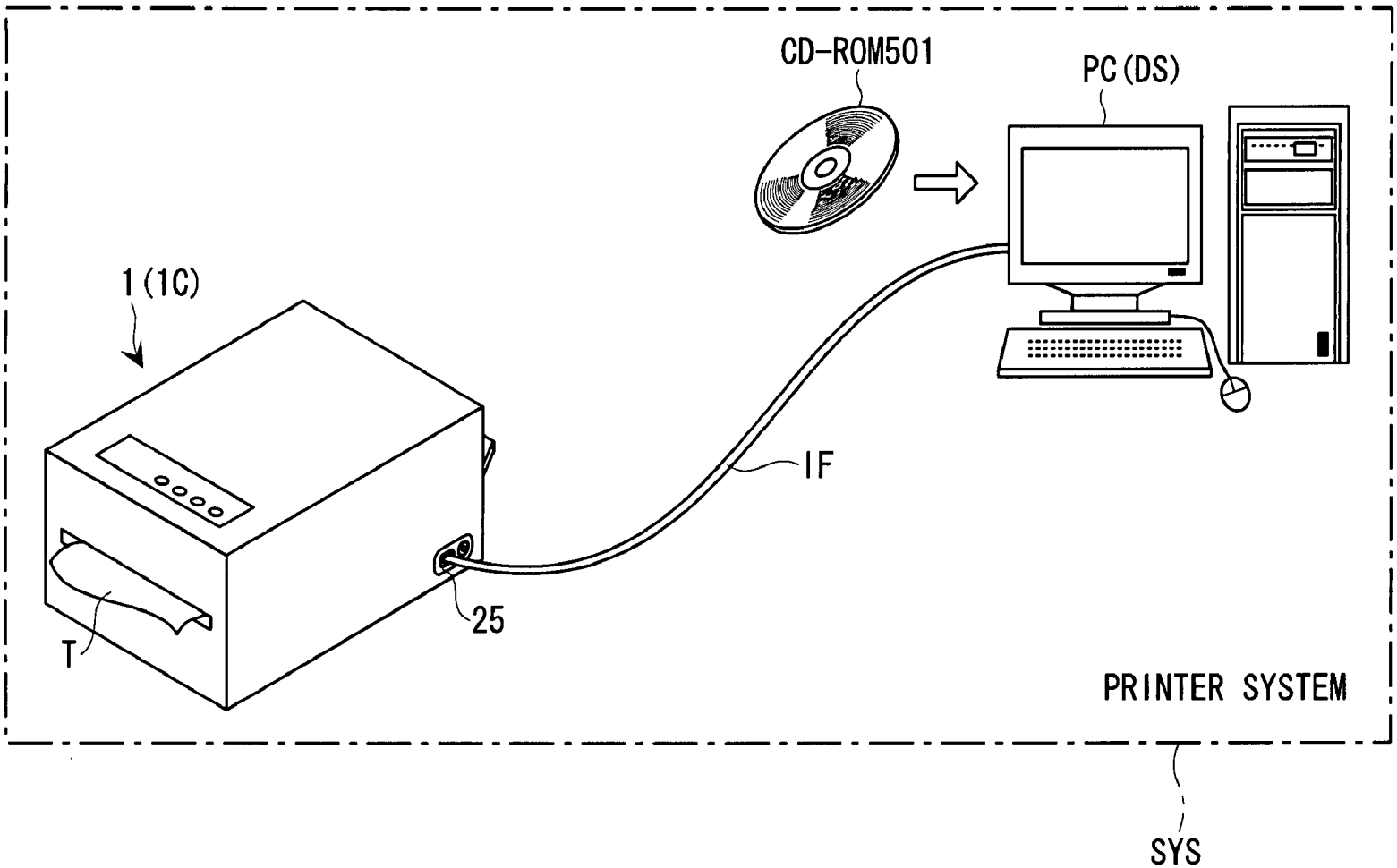
FIG. 48 is an explanatory view similar to FIG. 45, showing a third configuration example.
Figure 49:
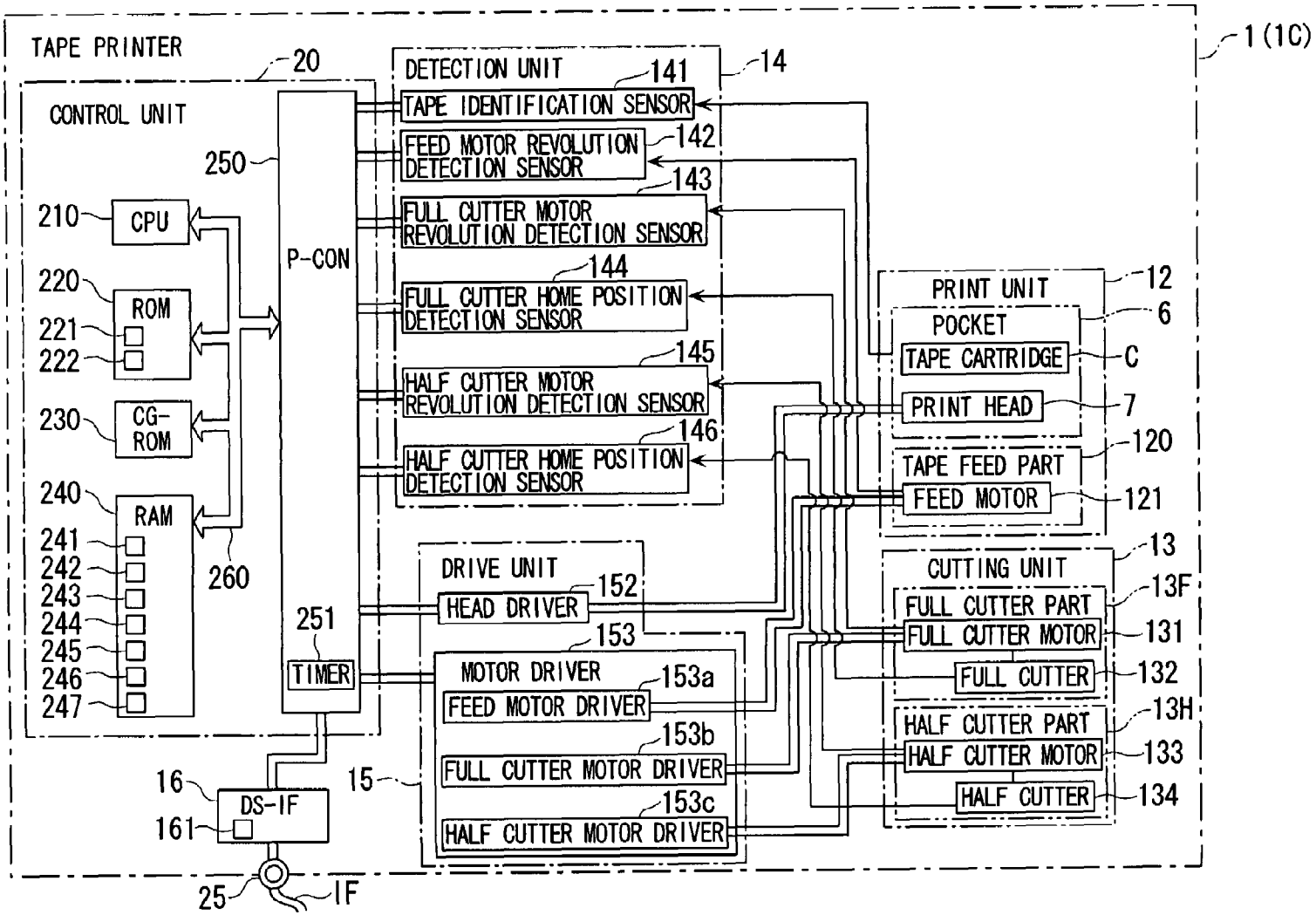
FIG. 49 is a block diagram similar to FIG. 47, showing a control system of a tape printing apparatus according to the third configuration example of FIG. 48.

Further, in the (fifth) embodiment described above, the tape printing apparatus 1 (1B) including the operation unit 11 having the keyboard 3, the display 4 and the like is exemplified as a printer. However, in case in which all or most operations are performed according to instructions from the data server DS, the operation unit 11 or the like is not required in the printer. Thus, the printer can be also configured while omitting the functions thereof. For example, it is also possible to configure the tape printing apparatus, which is similar to the tape printing apparatus 1B (see FIGS. 46 and 47), while omitting the operation unit 11 or the like, such as a tape printing apparatus 1C shown in FIGS. 48 and 49.

Accordingly, various processing methods of the printing system SYS described above (various label producing methods, file processing methods and the like) are also applicable as programs which are processed by various printing systems capable of program processing. Moreover, the methods are also applicable to the various storage media described above for storing such kinds of programs. Accordingly, these kinds of programs are previously stored or read from the storage media and the like or downloaded through the network and-executed. Thus, even if the printing system is a separate type, based on the files which are registered and designated for the width direction printing, it is possible to easily and quickly perform creation, editing and printing of a print image suitable for the width direction printing as well as label production. In addition, by using the files, the accompanying information thereof and the like, it is possible to freely set various combinations of the label width and the print width in performing the label production by the width direction printing. Moreover, it is possible to easily and quickly perform label production based on a desired individual setting just by reading the registered files without requiring resetting related to the width direction printing. Furthermore, it is possible to improve convenience and working efficiency since the data of the files prepared and registered for the width direction printing can be diverted to the longitudinal direction printing. Thus, effects such as those described above are obtained. As a matter of course, besides those described above, changes can be made accordingly without departing from the scope of this invention.

As described above, by using the tape printing apparatus, the label producing method, the data processing method for the tape printing apparatus, the printing system, the label producing method for the printing system, the programs and the storage medium according to this invention, the following effects and the like are obtained. Specifically, first, it is possible to easily and quickly perform creation, editing and printing of a print image suitable for the width direction printing as well as label production. Second, it is possible to freely set various combinations of the label width and the print width in performing the label production by the width direction printing. Third, it is possible to easily and quickly perform label production based on a desired individual setting just by reading the registered files without requiring resetting related to the width direction printing. Fourth, it is possible to improve convenience and working efficiency since the data of the files prepared and registered for the width direction printing can be diverted to the longitudinal direction printing. Fifth, even in (the printing system of) the separate type, it is possible to easily and quickly perform creation and printing of a print image suitable for the width direction printing as well as label production.

What is claimed is:

1. A tape printing apparatus capable of producing a label in such a manner that any one of longitudinal direction printing in which an arranging direction of character strings coincides with a longitudinal direction of a tape, and width direction printing in which the arranging direction coincides with a width direction of the tape, is selected, images of the character strings are arranged in an arrangement area of a print image and printed on the tape, and the tape is cut in the width direction, comprising:

label width setting means for setting a label width as a size of a label in the longitudinal direction when the width direction printing is selected;

width direction character string input means capable of inputting character strings for the width direction printing when the width direction printing is selected;

arrangement width setting means for setting a size in the longitudinal direction of the character string images in the arrangement area as an arrangement width when the width direction printing is selected;

print image creation means for creating the print image by arranging the character string images in the arrangement area according to the arrangement width;

print means for printing the created print image; and cut means for cutting the tape having the print image printed thereon in accordance with the label width;

wherein, when there are multiple lines of the character string images in the arrangement area, the arrangement width setting means is capable of setting the arrangement width for each of the lines of the character string images.

2. The tape printing apparatus according to claim 1, wherein the arrangement width setting means comprises abstract size designation means capable of designating the arrangement width of each line of the character string images by using an abstract name indicating a size.

3. A tape printing apparatus capable of producing a label in such a manner that any one of longitudinal direction printing in which an arranging direction of character strings coincides with a longitudinal direction of a tape, and width direction printing in which the arranging direction coincides with a width direction of the tape, is selected, images of the character strings are arranged in an arrangement area of a print image and printed on the tape, and the tape is cut in the width direction, comprising:

label width setting means for setting a label width as a size of a label in the longitudinal direction when the width direction printing is selected;

width direction character string input means capable of inputting character strings for the width direction printing when the width direction printing is selected;

arrangement width setting means for setting a size in the longitudinal direction of the character string images in the arrangement area as an arrangement width when the width direction printing is selected;

print image creation means for creating the print image by arranging the character string images in the arrangement area according to the arrangement width;

print means for printing the created print image; and cut means for cutting the tape having the print image printed thereon in accordance with the label width;

wherein the arrangement width setting means comprises arrangement width menu selection means for selecting the arrangement width from a standard menu.

4. A tape printing apparatus capable of producing a label in such a manner that any one of longitudinal direction printing in which an arranging direction of character strings coincides with a longitudinal direction of a tape, and width direction printing in which the arranging direction coincides with a width direction of the tape, is selected, images of the character strings are arranged in an arrangement area of a print image and printed on the tape, and the tape is cut in the width direction, comprising:

label width setting means for setting a label width as a size of a label in the longitudinal direction when the width direction printing is selected;

width direction character string input means capable of inputting character strings for the width direction printing when the width direction printing is selected;

arrangement width setting means for setting a size in the longitudinal direction of the character string images in the arrangement area as an arrangement width when the width direction printing is selected;

print image creation means for creating the print image by arranging the character string images in the arrangement area according to the arrangement width;

print means for printing the created print image; and cut means for cutting the tape having the print image printed thereon in accordance with the label width;

further comprising:

file registration means for registering data for creating the print image as files, wherein the file registration means includes accompanying information registration means for registering the set label width as accompanying information of the files.

5. A tape printing apparatus capable of producing a label in such a manner that any one of longitudinal direction printing in which an arranging direction of character strings coincides with a longitudinal direction of a tape, and width direction printing in which the arranging direction coincides with a width direction of the tape, is selected, images of the character strings are arranged in an arrangement area of a print image and printed on the tape, and the tape is cut in the width direction, comprising:

label width setting means for setting a label width as a size of a label in the longitudinal direction when the width direction printing is selected;

width direction character string input means capable of inputting character strings for the width direction printing when the width direction printing is selected;

arrangement width setting means for setting a size in the longitudinal direction of the character string images in the arrangement area as an arrangement width when the width direction printing is selected;

print image creation means for creating the print image by arranging the character string images in the arrangement area according to the arrangement width;

print means for printing the created print image; and cut means for cutting the tape having the print image printed thereon in accordance with the label width;

further comprising:

print width setting means for setting a size in the longitudinal direction of the arrangement area of the print image as a print width corresponding to the label width when the width direction printing is selected, wherein the print means is capable of printing a single print image so as to exceed the label width and the print width setting means is capable of setting a size above the label width as the print width.

6. The tape printing apparatus according to claim 5, further comprising:

reference position setting means for determining, as reference positions in the longitudinal direction, a reference position within the print width and determining a reference position within the label width, wherein the print means prints the print image so as to allow the reference position of the print width and the reference position of the label width to coincide with each other.

7. The tape printing apparatus according to claim 6, wherein the reference position setting means comprise reference position selection means for selecting any of one end of the print width and the label width and respective centers thereof as the reference positions.

8. A tape printing apparatus capable of producing a label in such a manner that any one of longitudinal direction printing in which an arranging direction of character strings coincides with a longitudinal direction of a tape, and width direction printing in which the arranging direction coincides with a width direction of the tape is selected, images of the character strings are arranged in an arrangement area of a print image and printed on the tape and the tape is cut in the width direction, comprising:

label width setting means for setting a label width as a size of a label in the longitudinal direction when the width direction printing is selected;

print width setting means for setting a size in the longitudinal direction of the arrangement area of the print image as a print width corresponding to the label width when the width direction printing is selected;

arrangement width setting means for setting a size in the longitudinal direction of the character string images within the print width as an arrangement width corresponding to the print width;

print image creation means for creating the print image by arranging the character string images in the arrangement area according to the arrangement width;

print means for printing the print image in accordance with the print width; and cut means for cutting the tape having the print image printed thereon in accordance with the label width:

further comprising:

file registration means for registering data for creating the print image as files, wherein the file registration means includes accompanying information registration means for registering at least one of the set label width and the set print width as accompanying information of the files.

9. A tape printing apparatus capable of producing a label in such a manner that any one of longitudinal direction printing in which an arranging direction of character strings coincides with a longitudinal direction of a tape, and width direction printing in which the arranging direction coincides with a width direction of the tape is selected, images of the character strings are arranged in an arrangement area of a print image and printed on the tape and the tape is cut in the width direction, comprising:

label width setting means for setting a label width as a size of a label in the longitudinal direction when the width direction printing is selected;

print width setting means for setting a size in the longitudinal direction of the arrangement area of the print image as a print width corresponding to the label width when the width direction printing is selected;

arrangement width setting means for setting a size in the longitudinal direction of the character string images within the print width as an arrangement width corresponding to the print width;

print image creation means for creating the print image by arranging the character string images in the arrangement area according to the arrangement width;

print means for printing the print image in accordance with the print width; and cut means for cutting the tape having the print image printed thereon in accordance with the label width;

wherein the print means is capable of printing a single print image so as to exceed the label width, and the print width setting means is capable of setting the size above the label width as the print width.

10. A tape printing apparatus capable of producing a label in such a manner that any one of longitudinal direction printing in which an arranging direction of character strings coincides with a longitudinal direction of a tape, and width direction printing in which the arranging direction coincides with a width direction of the tape is selected images of the character strings are arranged in an arrangement area of a print image and printed on the tape and the tape is cut in the width direction, comprising:

label width setting means for setting a label width as a size of a label in the longitudinal direction when the width direction printing is selected;

print width setting means for setting a size in the longitudinal direction of the arrangement area of the print image as a print width corresponding to the label width when the width direction printing is selected;

arrangement width setting means for setting a size in the longitudinal direction of the character string images within the print width as an arrangement width corresponding to the print width;

print image creation means for creating the print image by arranging the character string images in the arrangement area according to the arrangement width;

print means for printing the print image in accordance with the print width; and cut means for cutting the tare having the print image printed thereon in accordance with the label width;

wherein a label corresponding to a single print image is realized as a series of multiple divided labels, the label width setting means comprises divided label setting means for setting the number of divided labels in realizing the label as the divided labels and each of divided label widths and the cut means cuts the tape in accordance with each of the divided label widths.

11. A tape printing apparatus capable of producing a label in such a manner that any one of longitudinal direction printing in which an arranging direction of character strings coincides with a longitudinal direction of a tape, and width direction printing in which the arranging direction coincides with a width direction of the tape is selected, images of the character strings are arranged in an arrangement area of a print image and printed on the tape and the tape is cut in the width direction, comprising:

label width setting means for setting a label width as a size of a label in the longitudinal direction when the width direction printing is selected;

print width setting means for setting a size in the longitudinal direction of the arrangement area of the print image as a print width corresponding to the label width when the width direction printing is selected;

arrangement width setting means for setting a size in the longitudinal direction of the character string images within the print width as an arrangement width corresponding to the print width;

print image creation means for creating the print image by arranging the character string images in the arrangement area according to the arrangement width;

print means for printing the print image in accordance with the print width; and cut means for cutting the tape having the print image printed thereon in accordance with the label width:

wherein the label width setting means comprises label width numeric input means for numerically inputting the label width.

12. A tape printing apparatus capable of producing a label in such a manner that any one of longitudinal direction printing in which an arranging direction of character strings coincides with a longitudinal direction of a tape, and width direction printing in which the arranging direction coincides with a width direction of the tape is selected, a print image having arranged images of the character strings is printed on the tape and the tape is cut in the width direction, comprising:

label width setting means for setting a label width as a size of a label in the longitudinal direction when the width direction printing is selected;

file registration means for allowing accompanying information of width direction printing data for creating a print image in the width direction printing to include information on the set label width as well as registering the width direction printing data and the accompanying information as files corresponding to the print image;

file designation means for designating a file to be printed among the registered files;

print means for creating and printing a corresponding print image based on the designated file to be printed; and cut means for subjecting the tape having the print image printed thereon to cut processing for producing the label based on the information on the label width in the file to be printed.

13. The tape printing apparatus according to claim 12, wherein a label corresponding to a single print image is realized as a series of multiple divided labels, the label width setting means includes divided label setting means for setting the number of divided labels in realizing the label as the divided labels and each of divided label widths, the accompanying information includes information on the number of divided labels and each of the divided label widths as the information on the label width, and the cut means cuts the tape in accordance with each of the divided label widths as the cut processing.

14. The tape printing apparatus according to claim 12, further comprising:

print width setting means for setting a size in the longitudinal direction for printing the print image as a print width corresponding to the label width, wherein the accompanying information includes information on the set print width, and the print means prints the print image based on the information on the print width included in the accompanying information of the file to be printed.

15. The tape printing apparatus according to claim 14, wherein when there are multiple lines of the character string images in the print image, the print width setting means includes each line print width setting means for setting each line print width, which is a print width of each line, for each of the lines, the accompanying information includes information on each line print width for each line as the information on the print width, and the print means includes each line print means for printing the character string images of the print image for each line based on the information on the each line print width for each line.

16. The tape printing apparatus according to claim 15, further comprising:

reference position selection means for selecting one end of the print width and the label width or respective centers thereof as the reference positions, wherein the accompanying information includes information on the selected reference positions, and when the print width and the label width have different sizes from each other, the print means performs printing so as to allow a reference position of the print width and a reference position of the label width to coincide with each other based on the accompanying information of the file to be printed.

17. The tape printing apparatus according to claim 12, further comprising:

multiple printing setting means for setting the number of repetitions of printing of the print image corresponding to the file to be printed, wherein the print means repeatedly executes printing of the print image for the set number of repetitions, and the cut means performs the cut processing for separating respective labels from each other for each time of printing of the print image, the respective labels corresponding to respective print images which are printed.

18. The tape printing apparatus according to claim 12, wherein when there exist multiple types of the registered files, the file designation means is capable of collectively designating a plurality of files there among as the files to be printed, when the plurality of files are collectively designated as the files to be printed, the print means continuously prints a plurality of print images corresponding to the plurality of designated files, and the cut means performs the cut processing for separating respective labels from each other, the respective labels corresponding to the plurality of printed print images.

19. The tape printing apparatus according to claim 12, wherein the tape includes a base material tape which has a printing face on its front face and an adhesive face on its rear face, and a release tape which covers the adhesive face, the cut means comprises half cutting means for half cutting only the base material tape in the width direction and full-cutting means for full-cutting both of the base material tape and the release tape in the width direction, and when there are a plurality of labels to be continuously produced, the cut means performs, as the cut processing, the full-cutting only for a rear end of the last label and the half-cutting for other positions.

20. The tape printing apparatus according to claim 12, further comprising:

longitudinal direction printing data editing means for editing longitudinal direction printing data in order to create a print image in the longitudinal direction printing; and data conversion means for designating any one of the registered files and converting the width direction printing data of the designated file into the longitudinal direction printing data.

21. A tape printing apparatus which selects any one of longitudinal direction printing in which an arranging direction of character strings coincides with a longitudinal direction of a tape, and width direction printing in which the arranging direction coincides with a width direction of the tape, and prints a print image on the tape, the print image having arranged images of the character strings, comprising:

longitudinal direction printing data editing means for editing character strings as longitudinal direction printing data when the longitudinal direction printing is selected;

width direction printing data editing means for editing character strings as width direction printing data when the width direction printing is selected;

file registration means for registering the edited width direction printing data as files corresponding to the print image;

data conversion instruction means for instructing data conversion in which the width direction printing data is converted into the longitudinal direction printing data; and data conversion means for designating any one of the registered files when the data conversion is instructed and performing the data conversion for the width direction printing data of the designated file to obtain longitudinal direction printing data for the editing.

22. A label producing method for producing a label in such a manner that any one of longitudinal direction printing in which an arranging direction of character strings coincides with a longitudinal direction of a tape, and width direction printing in which the arranging direction coincides with a width direction of the tape is selected, a print image having arranged images of the character strings is printed on the tape and the tape is cut in the width direction the method comprising:

a label width setting step of setting a label width as a size of a label in the longitudinal direction when the width direction printing is selected;

a file registration step of allowing accompanying information of width direction printing data for creating a print image in the width direction printing to include information on the set label width as well as registering the width direction printing data and the accompanying information as files corresponding to the print image;

a file designation step of designating a file to be printed among the registered files;

a print step of creating and printing a corresponding print image based on the designated file to be printed; and a cut step of subjecting the tape having the print image printed thereon to cut processing for producing the label based on the information on the label width in the file to be printed.

23. A data processing method for a tape printing apparatus which selects any one of longitudinal direction printing in which an arranging direction of character strings coincides with a longitudinal direction of a tape, and width direction printing in which the arranging direction coincides with a width direction of the tape, and prints a print image on the tape, the print image having arranged images of the character strings, the method comprising:

a file registration step of registering character strings after being edited as width direction printing data as files corresponding to the print image for the width direction printing;

a data conversion instruction step of instructing data conversion for converting the width direction printing data into longitudinal direction printing data which is capable of being edited for the longitudinal direction printing; and a data conversion step of designating any one of the registered files when the data conversion is instructed and performing the data conversion for the width direction printing data of the designated file to obtain longitudinal direction printing data for editing.

24. A printing system comprising:

a supply unit which selects any one of longitudinal direction printing in which an arranging direction of character strings coincides with a longitudinal direction of a tape, and width direction printing in which the arranging direction coincides with a width direction of the tape, prepares communication data which expresses a print image having arranged images of the character strings and supplies the communication data through an interface capable of transmission; and a tape printing apparatus which receives the communication data through the interface, prints the print image on the tape based on the communication data and produces a label by cutting the tape in the width direction of the tape;

wherein the supply unit comprises:

file registration means for registering width direction print image creation data for creating the print image in the width direction printing as files corresponding to the print image; and file designation means for designating a file to be printed among the registered files when the width direction printing is selected, wherein print image data that is image data of the print image is created based on the width direction print image creation data of the designated file to be printed and the tape printing apparatus comprises print means for printing the print image based on the print image data.

25. The printing system according to claim 24, wherein the supply unit comprises source print image creation means for creating the print image data and the interface is capable of transmitting the communication data while including the print image data in the communication data.

26. The printing system according to claim 24, wherein the interface is capable of transmitting the communication data by including therein the width direction print image creation data of the designated file to be printed and the tape printing apparatus further comprises source print image creation means for creating the print image data based on the received width direction print image creation data.

27. The printing system according to claim 24, wherein the supply unit further comprises label width setting means for setting a label width as a size in the longitudinal direction of the label when the width direction printing is selected, the file registration means comprises accompanying information registration means for registering information on the set label width by including the information in accompanying information of the file, cut instruction data for instructing cut processing of cutting the tape having the print image printed thereon in accordance with the label width is generated based on the information on the label width included in the accompanying information of the file, and the tape printing apparatus further comprises cut means for performing the cut processing based on the cut instruction data.

28. The printing system according to claim 27, wherein the supply unit comprises source cut instruction generation means for generating the cut instruction data, and the interface is capable of transmitting the communication data by including the cut instruction data therein.

29. The printing system according to claim 27, wherein the interface is capable of transmitting the communication data by including therein the information on the label width included in the accompanying information of the designated file to be printed, and the tape printing apparatus further comprises source cut instruction generation means for generating the cut instruction data.

30. The printing system according to claim 24, wherein the supply unit further comprises mounting means capable of mounting a storage medium storing files registrable in the file registration means.

31. The printing system according to claim 24, wherein the supply unit comprise upper communication means which is connected with other devices through a predetermined network and is capable of receiving files registrable in the file registration means from the other devices.

32. The printing system according to claim 24, wherein the supply unit includes longitudinal direction printing data editing means for editing longitudinal direction print image creation data in order to create a print image in the longitudinal direction printing, and data conversion means for designating any one of the registered files and converting the width direction print image creation data of the designated file into the longitudinal direction print image creation data.

* * * * *